US011333376B2

(12) United States Patent
Lee et al.

(10) Patent No.: US 11,333,376 B2
(45) Date of Patent: May 17, 2022

(54) CEILING TYPE INDOOR UNIT OF AIR CONDITIONER

(71) Applicant: LG ELECTRONICS INC., Seoul (KR)

(72) Inventors: Juyoun Lee, Seoul (KR); Jaeheuk Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 251 days.

(21) Appl. No.: 16/718,794

(22) Filed: Dec. 18, 2019

(65) Prior Publication Data

US 2020/0191419 A1 Jun. 18, 2020

(30) Foreign Application Priority Data

Dec. 18, 2018 (KR) ..... 10-2018-0164265

(51) Int. Cl.
*F24F 11/00* (2018.01)
*F24F 1/0317* (2019.01)

(52) U.S. Cl.
CPC ..... *F24F 11/0001* (2013.01); *F24F 1/0317* (2019.02)

(58) Field of Classification Search
CPC ..... F24F 11/0001; F24F 11/79; F24F 1/0317; F24F 1/0014; F24F 1/0047; F24F 2013/0616
See application file for complete search history.

(56) References Cited

U.S. PATENT DOCUMENTS

2012/0174608 A1* 7/2012 Kumamoto ..... F24F 11/79 62/186
2012/0288363 A1* 11/2012 Yumoto ..... F24F 1/0047 415/182.1
2017/0336082 A1* 11/2017 Kamijo ..... F24F 11/30

FOREIGN PATENT DOCUMENTS

| | | | | |
|---|---|---|---|---|
| EP | 2 530 395 | | 12/2012 | |
| EP | 3 358 265 | | 8/2018 | |
| EP | 3358265 | A1 * | 8/2018 | ..... F24F 11/74 |
| JP | 2011-174705 | | 9/2011 | |
| JP | 2016-070604 | | 5/2016 | |
| KR | 10-2003-0012046 | | 2/2003 | |
| KR | 10-2009-0067593 | | 6/2009 | |
| KR | 10-2016-0101848 | | 8/2016 | |
| WO | WO 2011/093205 | | 8/2011 | |

OTHER PUBLICATIONS

European Search Report dated May 13, 2020 issued in Application No. 19217634.5.
International Search Report dated Apr. 20, 2020 issued in Application No. PCT/KR2019/018011.

* cited by examiner

*Primary Examiner* — Emmanuel E Duke
(74) *Attorney, Agent, or Firm* — KED & Associates LLP

(57) ABSTRACT

According to the present disclosure, it is determined whether or not the room is heated according to a temperature difference between a room temperature Tp and a set temperature Ts, and even when there is little or no heating load due to the temperature difference between the room temperature Tp and the set temperature Ts, the floor heating is performed by determining a temperature difference between the room temperature Tp and a floor temperature Tb.

20 Claims, 21 Drawing Sheets

CEILING TYPE INDOOR UNIT OF AIR CONDITIONER

CROSS-REFERENCE TO RELATED PATENT APPLICATIONS

This application claims priority benefit of Korean Application No. 10-2018-0164265 filed an Dec. 18, 2018, whose entire disclosure is hereby incorporated by reference.

BACKGROUND OF THE INVENTION

Field of the Invention

The present disclosure relates to a control method of a ceiling type indoor unit of an air conditioner, and more particularly, to a control method of a ceiling type indoor unit according to a floor temperature in a room.

Related Art

In general, an air conditioner includes a compressor, a condenser, an evaporator, and an expander, and uses an air conditioning cycle to supply cold air or warm air to a building or a room.

The air conditioner is structurally divided into a separate type air conditioner in which the compressor is disposed outdoors and an integrated type air conditioner in which the compressor is integrally manufactured.

In the separate type air conditioner, an indoor heat exchanger is installed in an indoor unit, an outdoor heat exchanger and a compressor are installed in an outdoor unit, and two separated units are connected to by a refrigerant pipe.

In the integrated type air conditioner, an indoor heat exchanger, an outdoor heat exchanger, and a compressor installed in one case. The integrated type air conditioner includes a window type air conditioner in which the air conditioner is directly installed in a window, and a duct type air conditioner in which a suction duct and a discharge duct are connected to each other and the air conditioner is installed outside the room.

In general, the separate air conditioner is distinguished according to an installation type of the indoor unit.

An air conditioner in which the indoor unit is vertically installed in an indoor space is referred to as a stand type air conditioner, an air conditioner in which the indoor unit is installed on an indoor wall is referred to as a wall-mounted air conditioner, and an air conditioner in which the indoor unit is installed on a ceiling of the room is referred to as a ceiling type indoor unit.

In addition, as a type of the separate air conditioner, there is a system air conditioner which can provide air-conditioned air in a plurality of spaces.

In a case of the system air conditioner, there are a system air conditioner which includes a plurality of indoor units and performs air conditioning on the room and a system air conditioner which supplies the air-conditioned air to each space through a duct.

The plurality of indoor units provided in the system air conditioner may include any of a stand type indoor unit, a wall type indoor unit or a ceiling type indoor unit.

In the related art, the ceiling type indoor unit includes a case which is suspended from a ceiling wall and a front panel which covers a bottom surface of the case and is installed on the same surface as a ceiling.

A suction port is disposed in a center of the front panel, a plurality of discharge ports are disposed outside the suction port, and a discharge vane is provided for each discharge port.

In the related art, during heating, there is a problem that the ceiling-type indoor unit provides only an airflow control according to an indoor temperature and a target temperature and a floor temperature in a room is not considered.

SUMMARY OF THE INVENTION

The present disclosure provides a control method of a ceiling type indoor unit which controls a first vane and a second vane and can directly control a floor temperature in a room.

The present disclosure provides a control method of a ceiling type indoor unit which controls discharge directions of the first vane and the second vane and minimizes a temperature difference between the floor temperature in the room and a temperature of indoor air.

The present disclosure provides a control method of a ceiling type indoor unit which senses temperatures of the floor temperature and the indoor air and minimizes a temperature difference between an upper side and a lower side in the room.

The present disclosure provides a control method of a ceiling type indoor unit according to the floor temperature in the room.

The present disclosure provides a control method of a ceiling type indoor unit which ascertains a position of an occupant via a vision sensor and minimizes a temperature difference between an upper side and a lower side in a space in which the occupant is located.

Objects of the present disclosure are not limited to the above-mentioned objects, and other objects not mentioned above may be clearly understood by those skilled in the art from the following description.

In the present disclosure, it is determined whether or not a room is heated according to a temperature difference between a room temperature Tp and a set temperature Ts, and even when there is litter or no heating load due to the temperature difference between the room temperature Tp and the set temperature Ts, it is possible to perform floor heating by determining the temperature difference between the room temperature Tp and a floor temperature Tb.

In the present disclosure, the heating load is determined according to the temperature difference between the room temperature Tp and the set temperature Ts, and a floor heating load is determined according to the temperature difference between the room temperature Tp and the floor temperature Tb.

In the present disclosure, even when there is litter or no heating load due to the temperature difference between the room temperature Tp and the set temperature Ts, in a case where the temperature difference between the room temperature Tp and the floor temperature Tb exceeds a first reference A, it is determined that the floor heating load is large, and thus, a vertical wind may be provided to the floor.

In an aspect, there is provided a ceiling type indoor unit including: a case which is installed to be suspended to a ceiling of a room, includes a suction port formed on a bottom surface, and includes a first discharge port and a third discharge port disposed to face each other based on the suction port and a second discharge port and a fourth discharge port disposed to face each other based on the suction port; a first vane module which is disposed in the first discharge port, constitutes one of a first discharge pair, and discharges air in a first discharge direction; a second vane module which is disposed in the second discharge port, constitutes one of a second discharge pair, and discharges air in a second discharge direction; a third vane module which is disposed in the third discharge port, constitutes the other one of the first discharge pair, and discharges air in a third discharge direction; and a fourth vane module which is disposed in the fourth discharge port, constitutes the other one of the second discharge pair, and discharges air in a fourth discharge direction.

In an aspect, there is provided a control method of a ceiling type indoor unit including: a step S10 of turning on a cooling mode; a temperature setting step S12 of, after Step S10, sensing a room temperature Tp and a floor temperature Tb and receiving a set temperature Ts; a step S14 of, after Step S12, comparing the room temperature Tp and the set temperature with each other; a step S20 of, in a case where the room temperature Tp is less than the set temperature Ts, operating at least on of the first discharge pair and the second discharge pair at one inclination angle; a step 332 of, after Step S20, comparing a temperature difference between the room temperature Tp and the floor temperature Tb with a first reference value A; a step S34 of, in a case where the temperature difference exceeds the first reference value A after Step S32, operating at least one of the first discharge pair and the second discharge pair at another inclination angle; a step S100 of, after Step S34, determining whether or not the heating mode is turned off; and a step of, in a case where Step S100 is satisfied, ending the heating mode, and in a case where the room temperature Tp is equal to or more than the set temperature Ts after Step S14, the step proceeds to Step S32, and another inclination angle is disposed more vertically in an up-down direction than the one inclination angle.

In a case where the temperature difference is equal to or less than the first reference value A after Step S32, the step may proceed to Step S100, and in a case where Step S100 is not satisfied, the step may be returned to a step before Step S14.

In Step S20, both the first discharge pair and the second discharge pair may be operated at the one inclination angle.

The control method may further include: a step S30 of, after Step S20, determining whether or not Step S20 exceeds a first predetermined time, in which in a case where the first predetermined is satisfied, the step may proceed to Step S32.

The control method may further include a step S36 of, after Step S34, determining whether or not Step S34 exceeds a second predetermined time, in which in a case where the second predetermined is satisfied, the step may be returned to Step S32.

In a case where the temperature difference is equal to or less than the first reference value after Step S32, the first discharge pair and the second discharge pair may be operated at inclination angles different from each other.

The control method may further include a first dynamic heating step S40 of, in a case where the temperature difference is equal to or less than the first reference value after Step S32, operating the first discharge pair and the second discharge pair at inclination angles different from each other; and a second dynamic heating step 380 of, after Step 340, alternating the inclination angles of the first discharge pair and the second discharge pair, in which in a case where Step S80 is satisfied, the step may proceed to Step S100.

The control method may further include a step S60 of, in a case where Step S50 is satisfied, operating the first discharge pair and the second discharge pair at the other inclination angle which is more horizontal than the one inclination angle, in which the other inclination angle may be disposed more horizontally than the one inclination angle.

The control method may further include a step S70 of determining whether or not Step 60 exceeds a third predetermined time, in which in a case where Step 370 is satisfied, the step may proceed to Step S880.

Each vane module may include a first vane configured to be disposed in the discharge port, a second vane configured to be disposed in the discharge port, a vane motor configured to be assembled to the case and supply a driving force to the first vane and the second vane, a drive link configured to be assembled to be rotatable relative to the case, to be coupled to the vane motor, and transmit the driving force of the vane motor to the first vane and the second vane, a first vane line configured to be assembled to be rotatable relative to the case and the first vane, and a second vane link configured to be assembled to be rotatable relative to the drive link and the second vane.

When the one inclination angle is provided, a rear end of the first vane may be located higher than a front end of the second vane.

In the one inclination angle, an inclination of the second vane may be more vertically in an up-down direction than an inclination of the first vane.

In another inclination angle, the inclination of the second vane may be more vertically in the up-down direction than the inclination of the first vane.

In the one inclination angle, the inclination of the second vane may be more vertically in the up-down direction than the inclination of the first vane, in another inclination angle, the inclination of the second vane may be more vertically in the up-down direction than the inclination of the first vane, the inclination of the first vane at another inclination angle may be more vertically in the up-down direction than the inclination of the first vane at the one inclination angle, and the inclination of the second vane at another inclination angle may be more vertically in the up-down direction than the inclination of the second vane at the one inclination angle.

DESCRIPTION OF EXEMPLARY EMBODIMENTS

Figure 1:
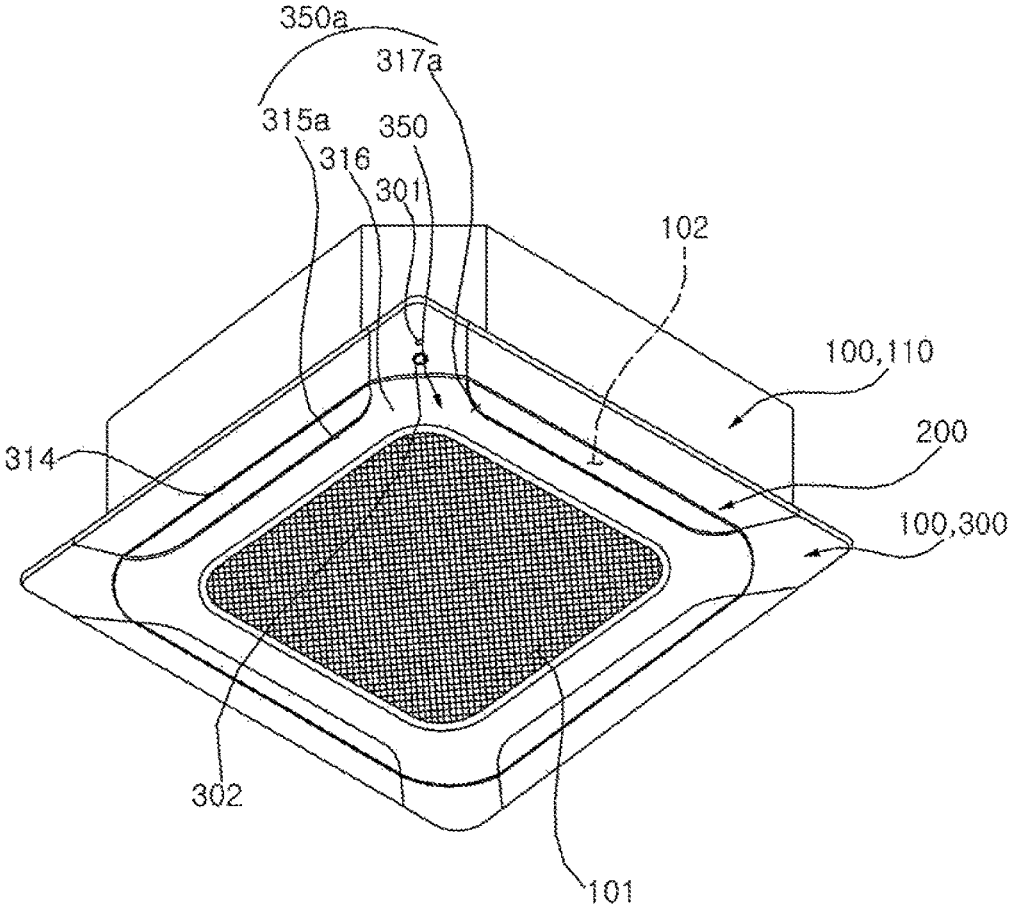
FIG. 1 is a perspective view showing an air conditioner indoor unit according to an embodiment of the present disclosure.

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the invention is fully understood by those skilled in the art to which the present disclosure belongs, and the present disclosure is only defined by the scope of the claims. The same reference numerals indicate the same components through the specification.

Hereinafter, the present disclosure will be more specifically described with reference the accompanying drawings.

Figure 2:
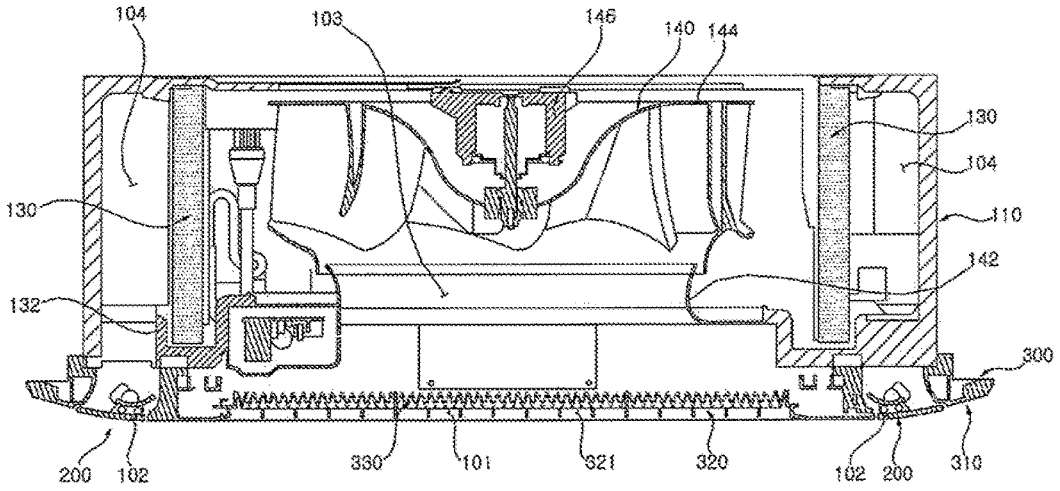
FIG. 2 is a cross-sectional view of FIG. 1.
Figure 3:
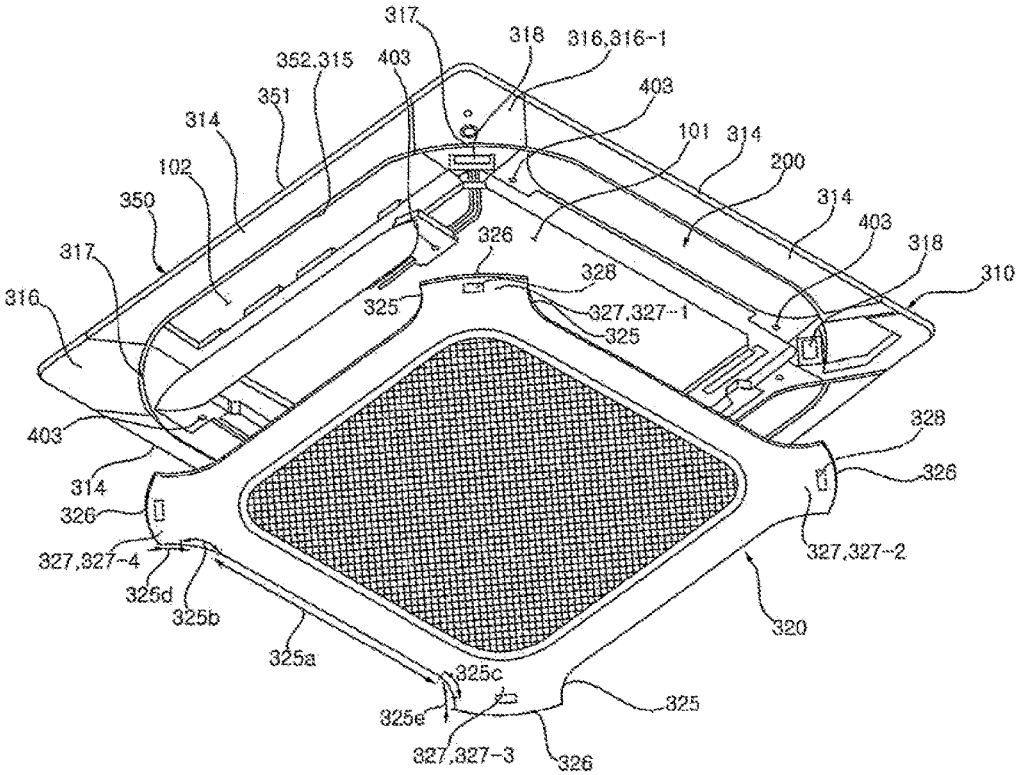
FIG. 3 is an exploded perspective view showing a front panel of FIG. 1.
Figure 4:
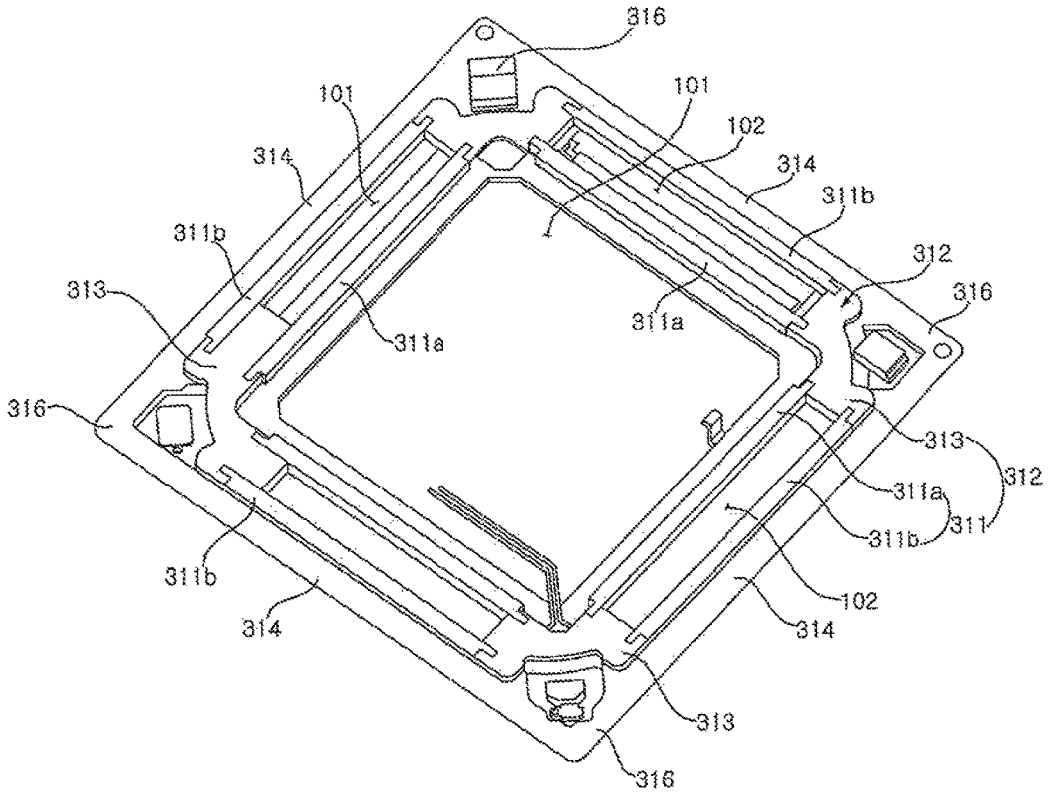
FIG. 4 is a perspective view showing a front panel upper portion of FIG. 1.
Figure 5:
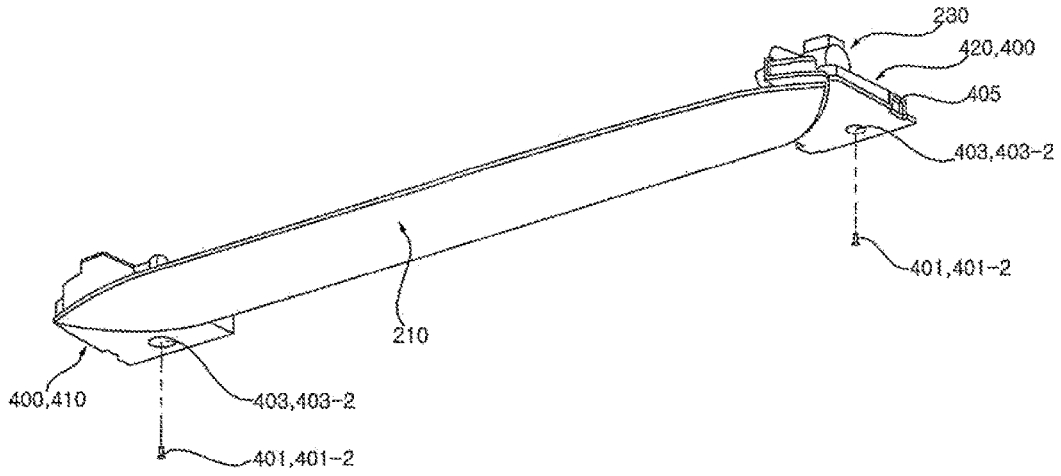
FIG. 5 is a perspective view of a vane module shown in FIG. 3.
Figure 6:
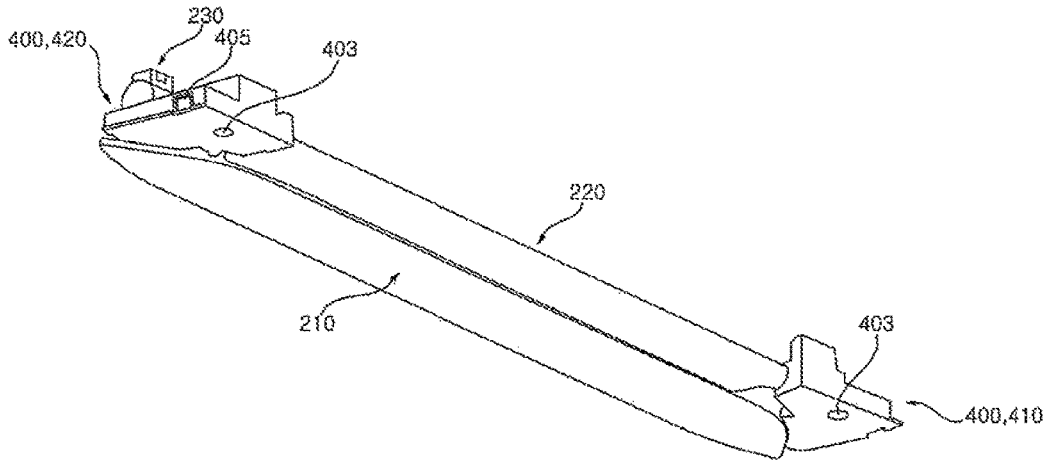
FIG. 6 is a perspective view when viewed in a different direction of FIG. 5.
Figure 7:
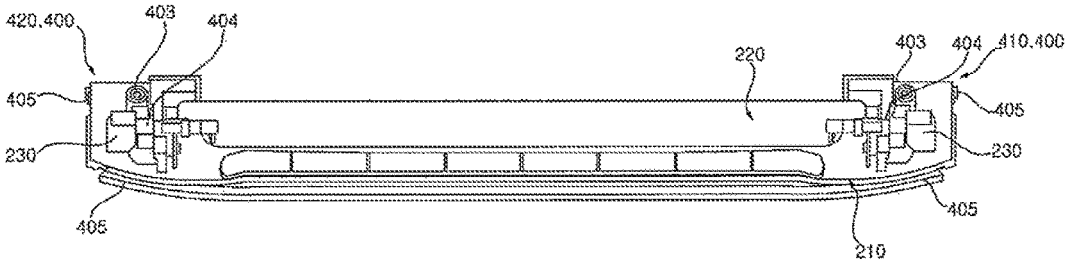
FIG. 7 is a perspective view of the vane module when viewed from above in FIG. 5.
Figure 8:
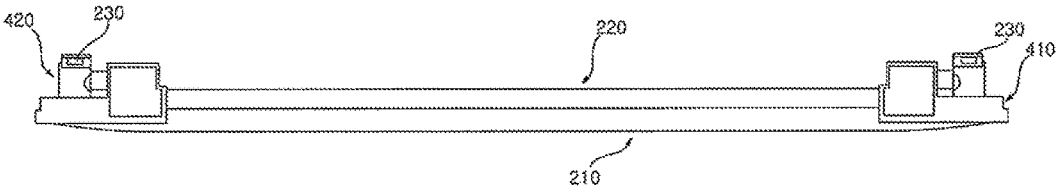
FIG. 8 is a front view of the vane module shown in FIG. 3.
Figure 9:
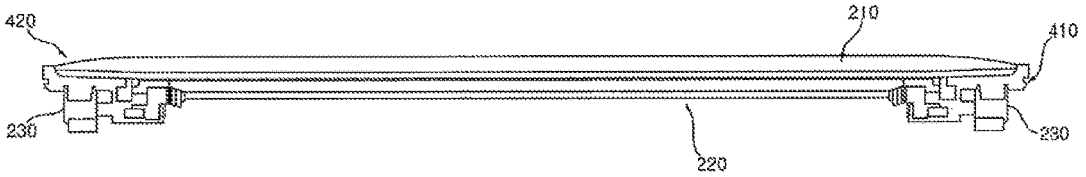
FIG. 9 is a rear view of the vane module shown in FIG. 3.
Figure 10:
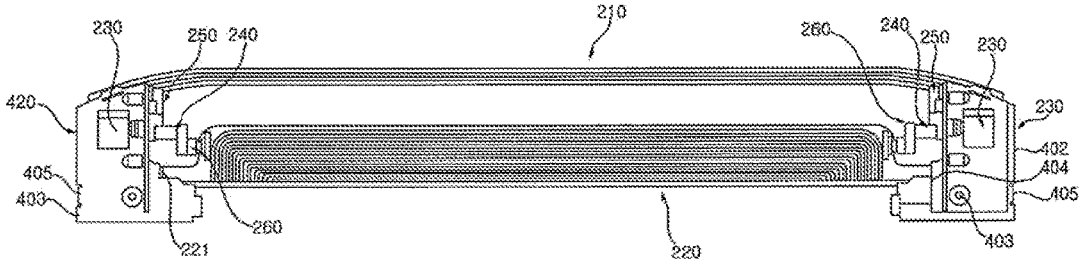
FIG. 10 is a plan view of the vane module shown in FIG. 3.
Figure 11:
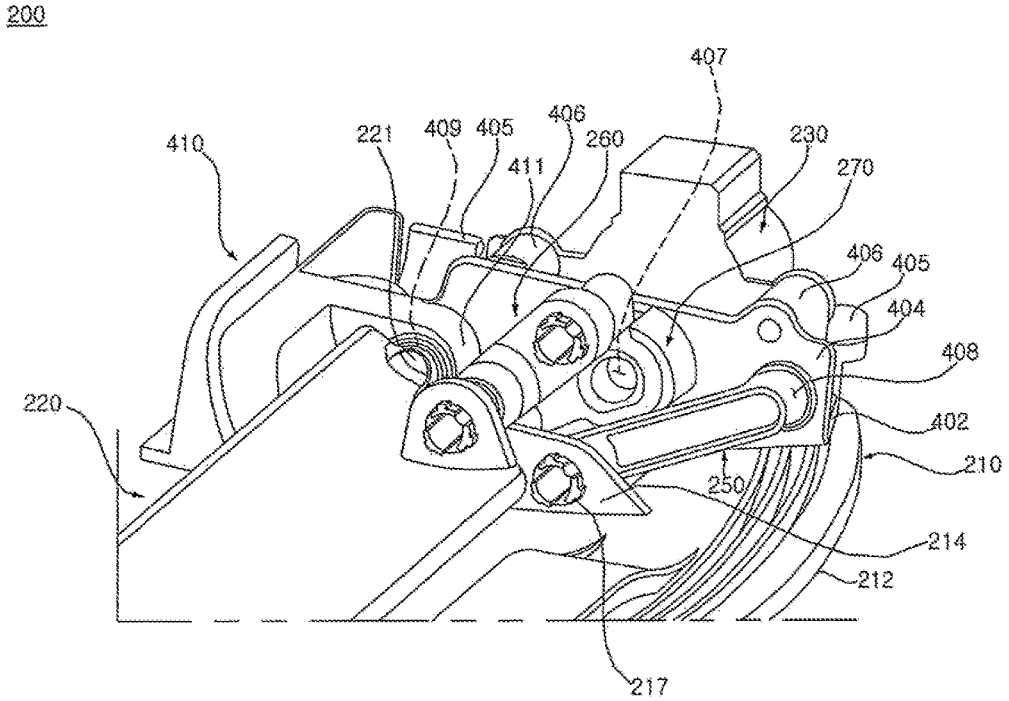
FIG. 11 is a perspective view showing an operation structure of the vane module shown in FIG. 5.
Figure 12:
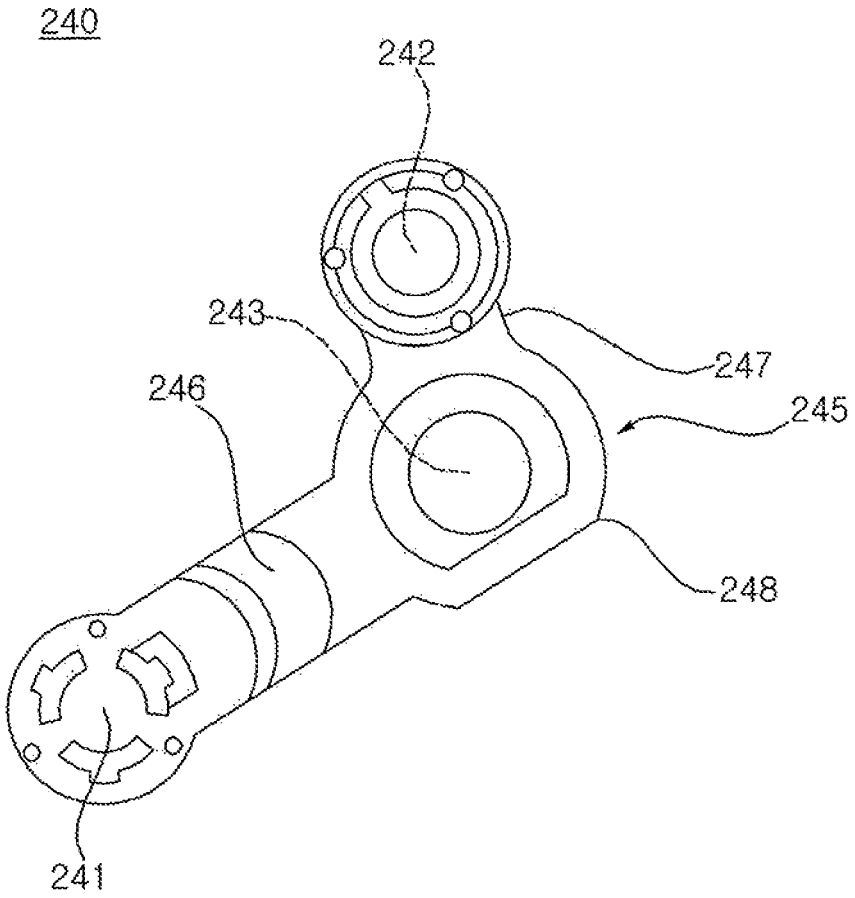
FIG. 12 is a front view of a drive link shown in FIG. 11.
Figure 13:
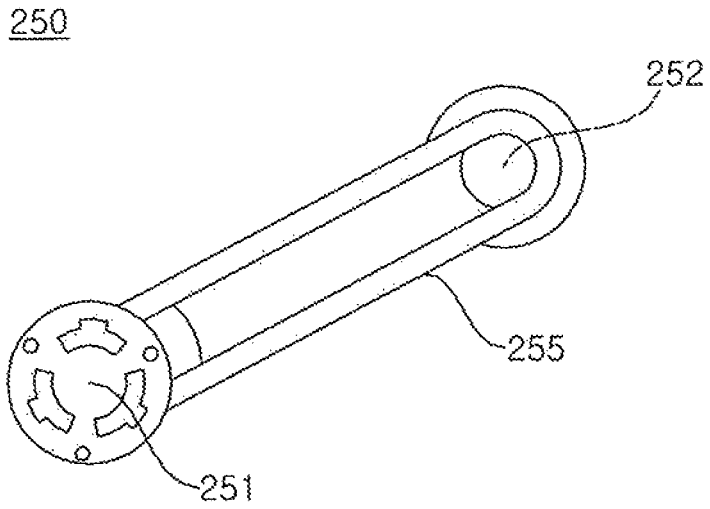
FIG. 13 is a front view of a first vane link shown in FIG. 11.
Figure 14:
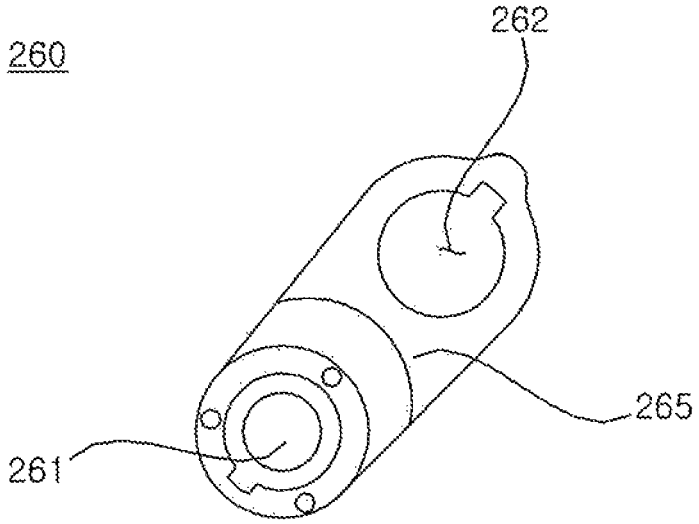
FIG. 14 is a front view of a second vane link shown in FIG. 11.
Figure 15:
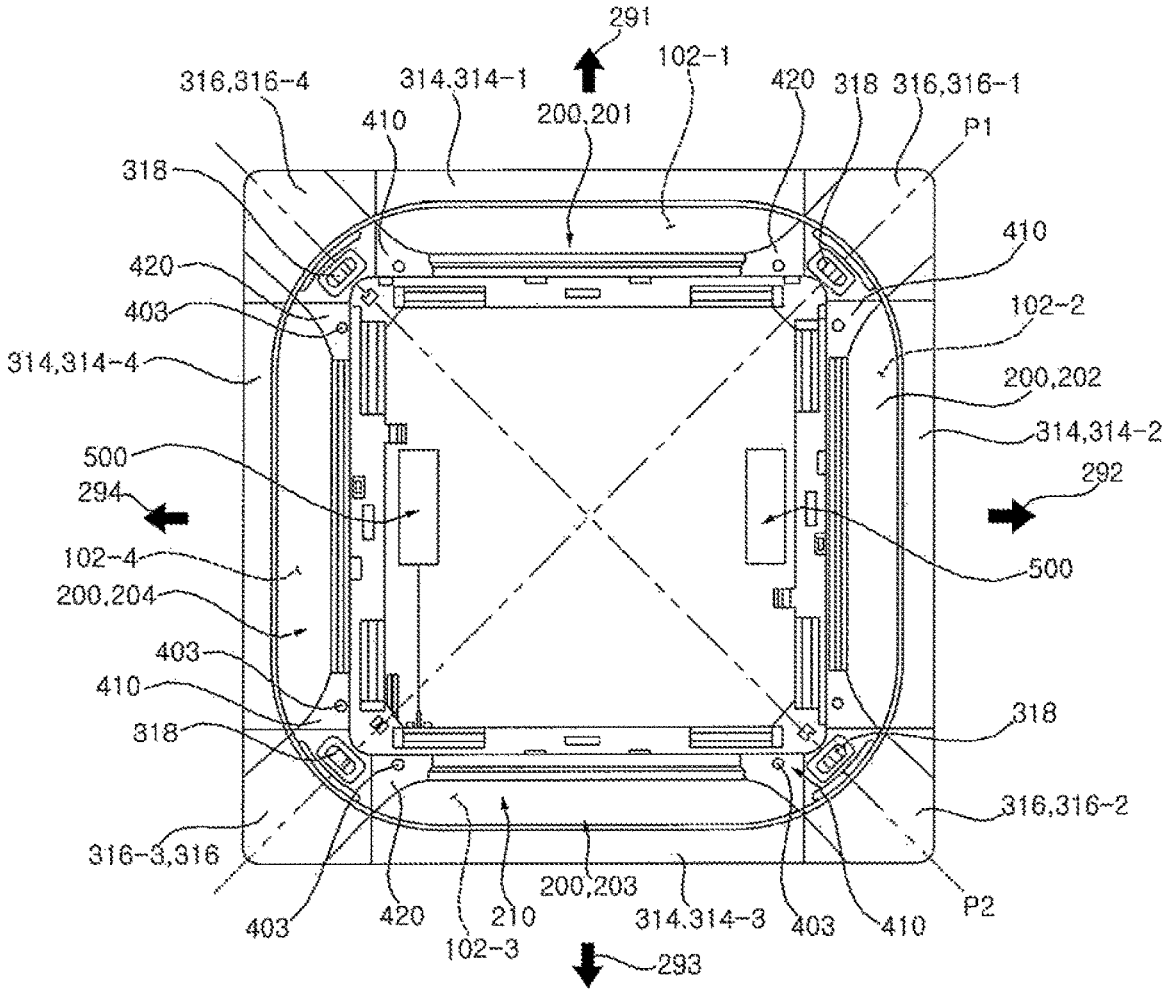
FIG. 15 is a bottom view of the front panel in a state where a suction grill is separated from FIG. 1.
Figure 16:
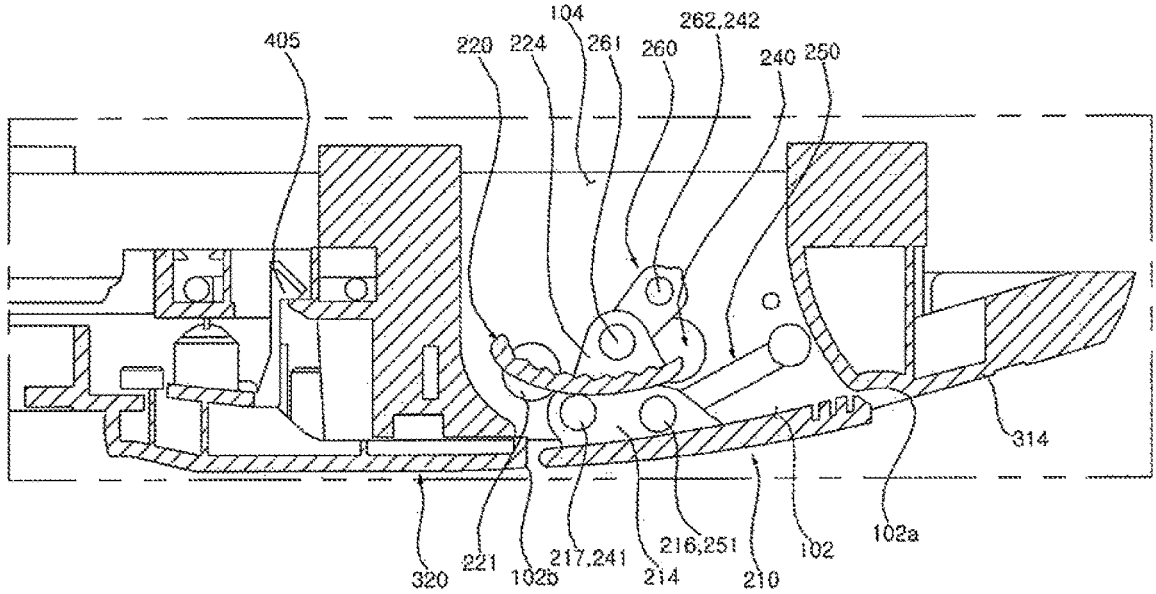
FIG. 16 is a side cross-sectional view of the vane module shown in FIG. 2.
Figure 17:
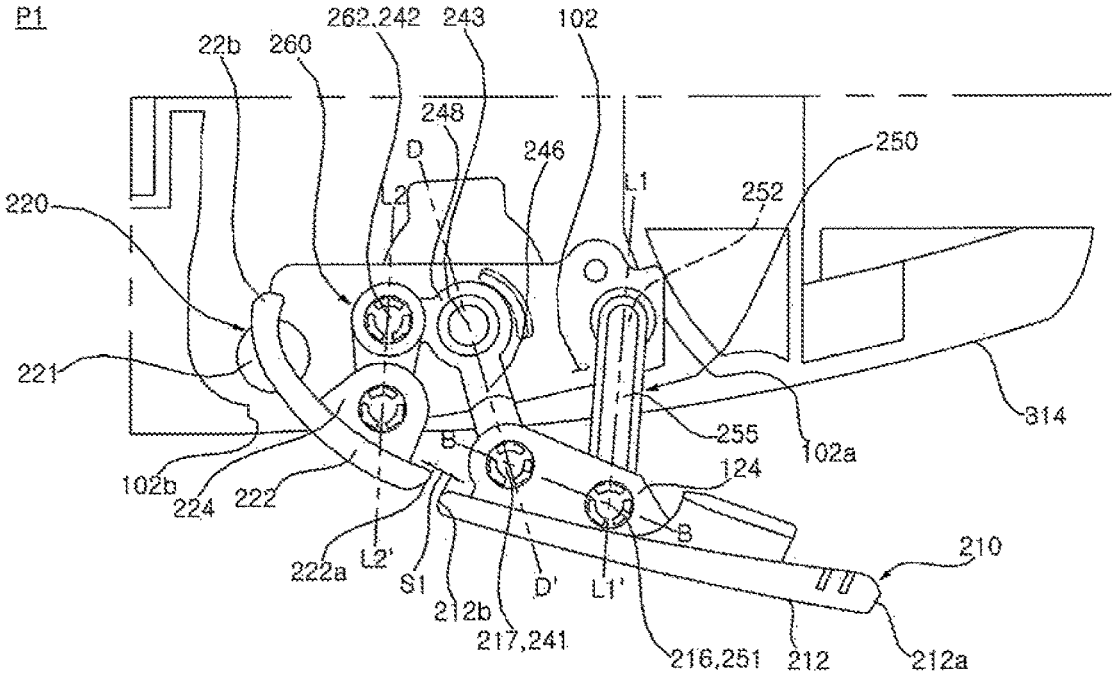
FIG. 17 is an exemplary view of a discharge step P1 according a first embodiment of the present disclosure.
Figure 18:
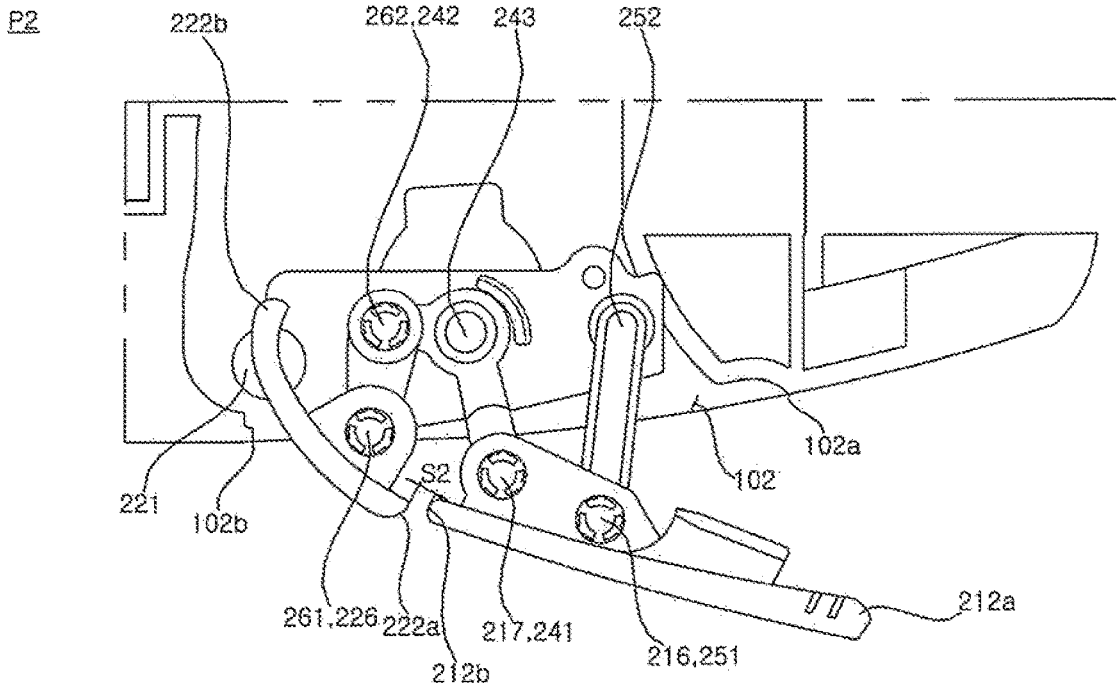
FIG. 18 is an exemplary view of a discharge step P2 according to the first embodiment of the present disclosure.
Figure 19:
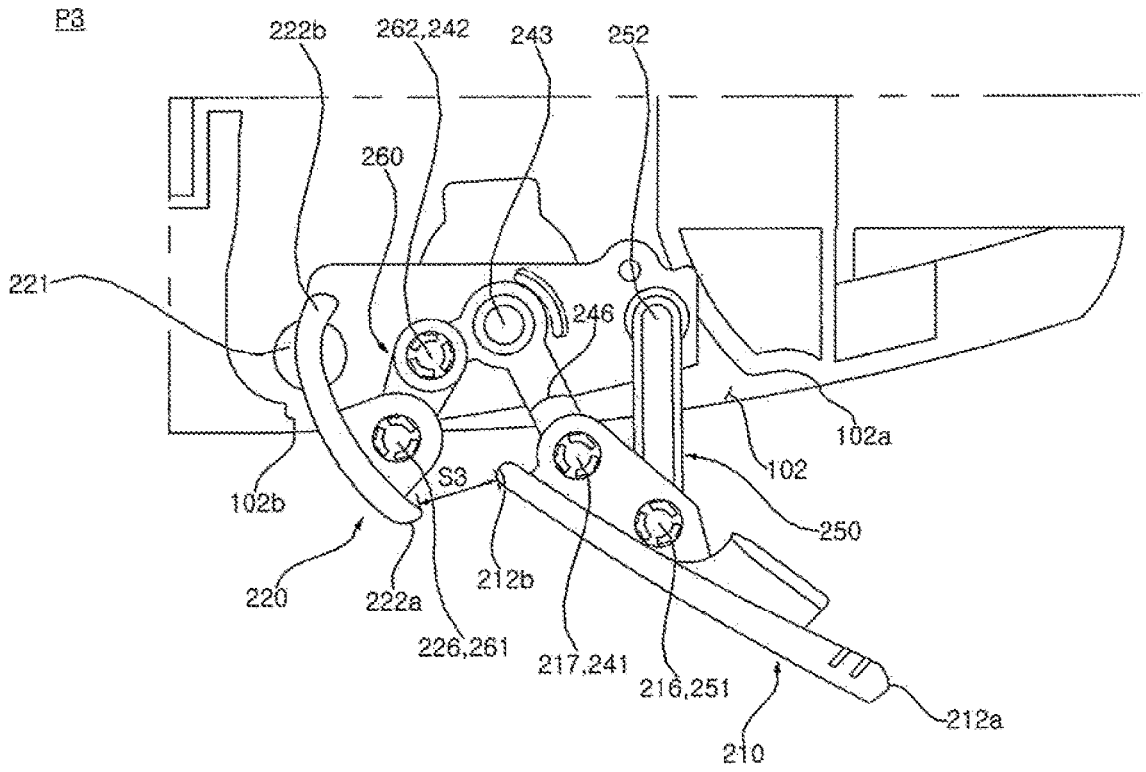
FIG. 19 is an exemplary view of a discharge step P3 according to the first embodiment of the present disclosure.
Figure 20:
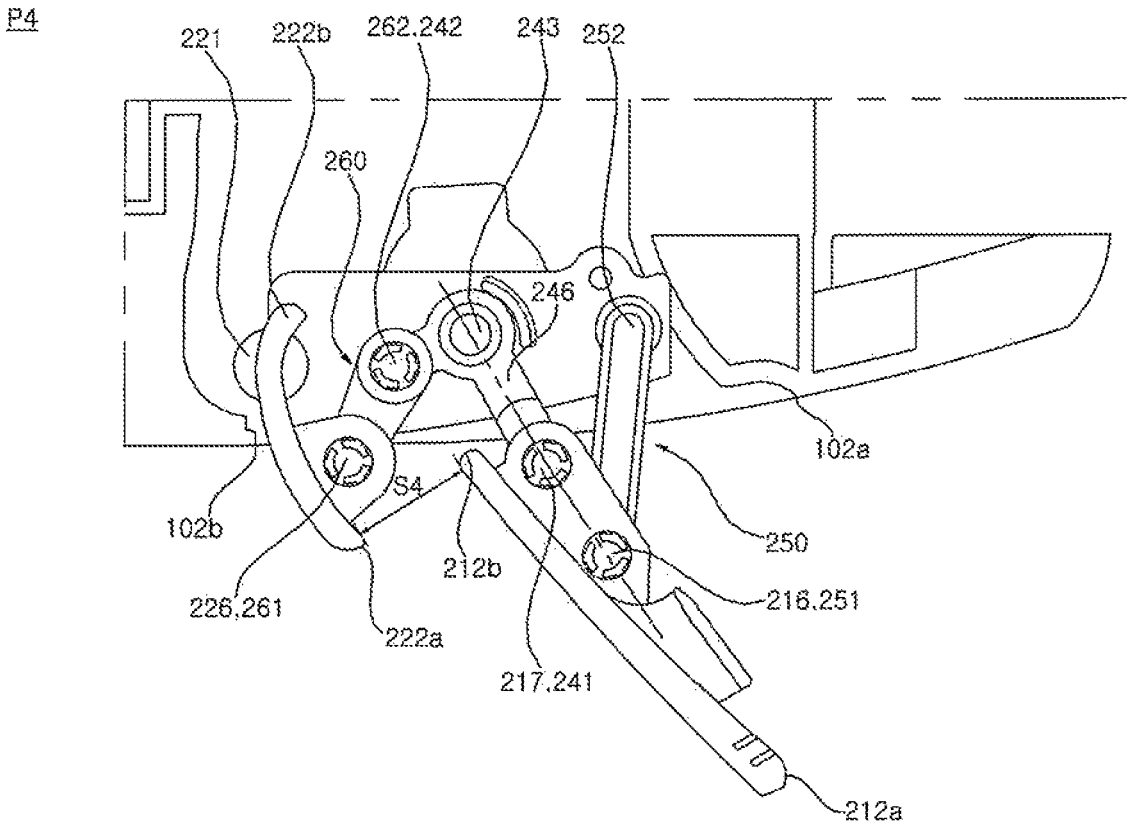
FIG. 20 is an exemplary view of a discharge step P4 according to the first embodiment of the present disclosure.
Figure 21:
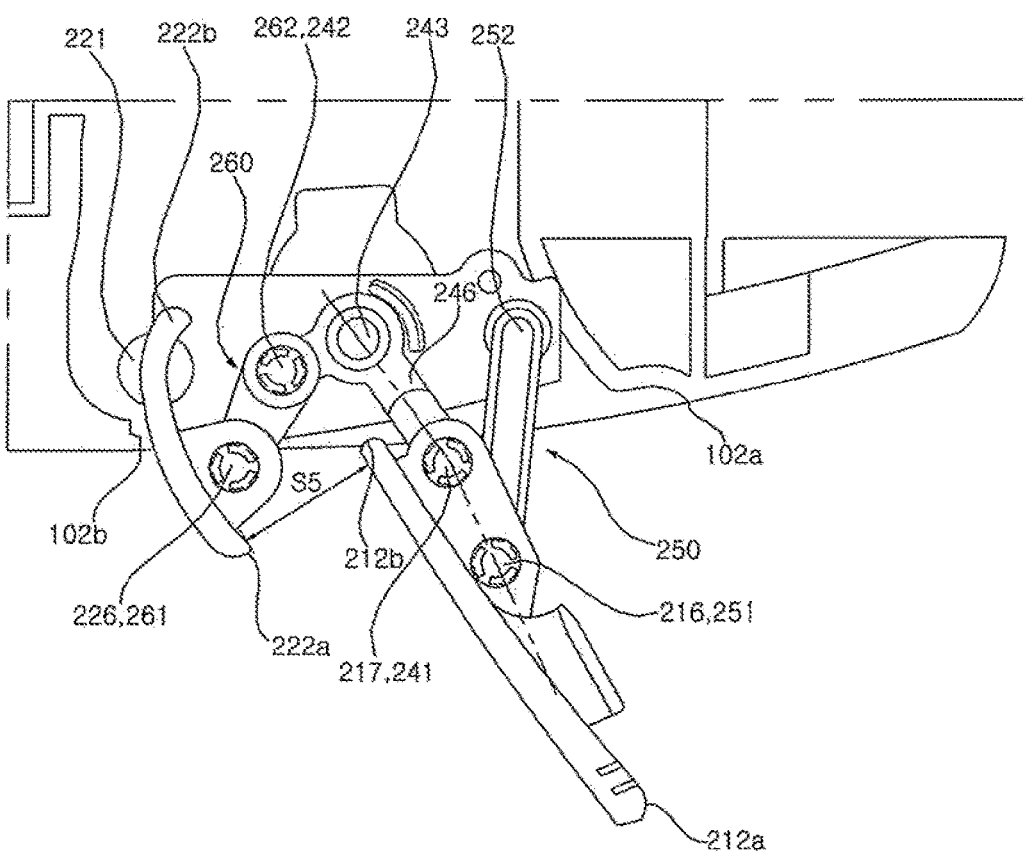
FIG. 21 is an exemplary view of a discharge step P5 according to the first embodiment of the present disclosure.
Figure 22:
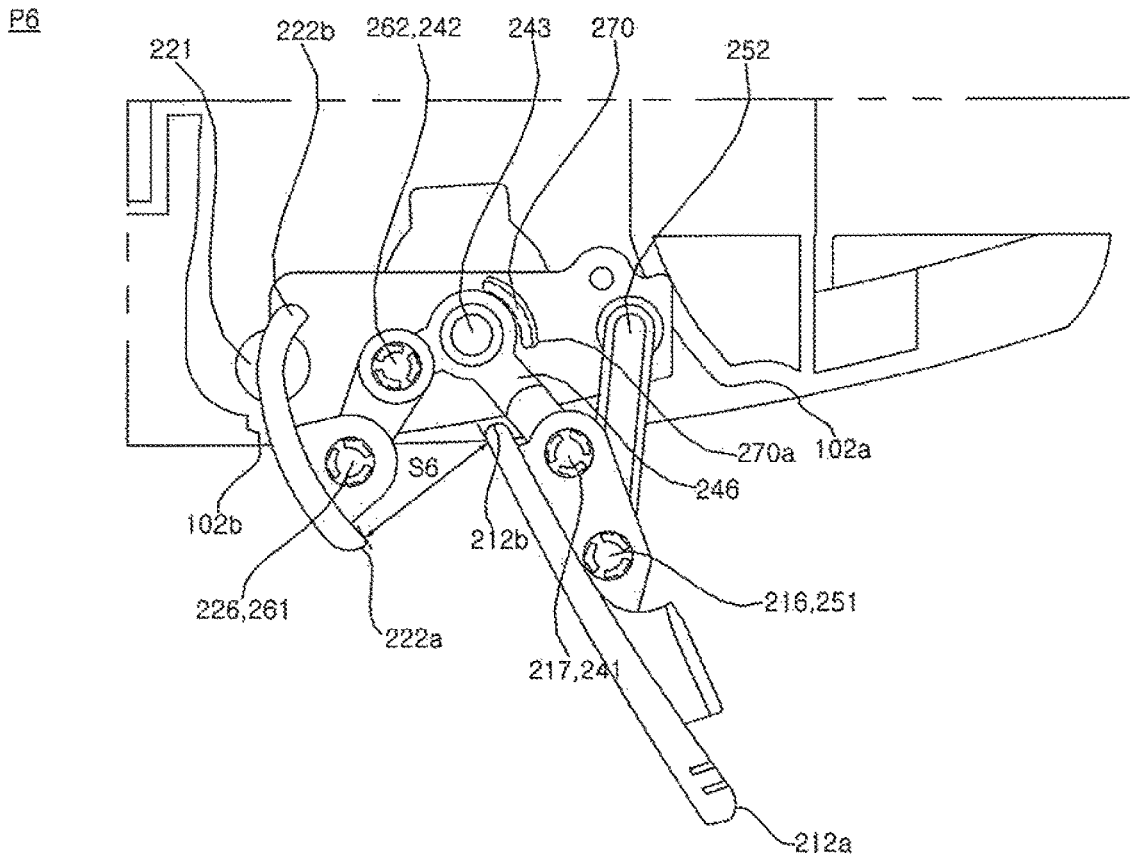
FIG. 22 is an exemplary view of a discharge step P6 according to the first embodiment of the present disclosure.
Figure 23:
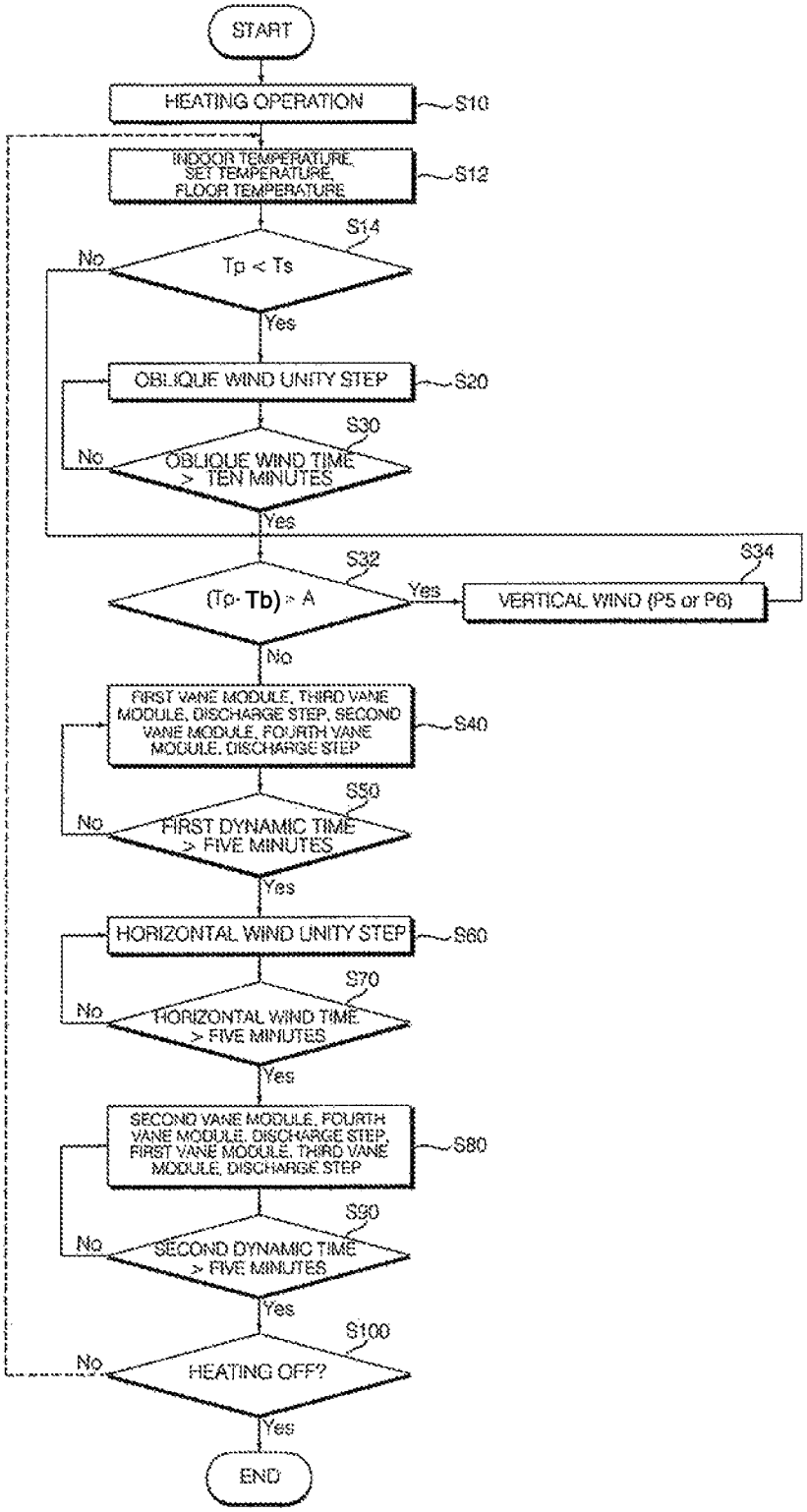
FIG. 23 is a flowchart showing a control method during heating according to the first embodiment of the present disclosure.

FIG. 1 is a perspective view showing an air conditioner indoor unit according to an embodiment of the present disclosure. FIG. 2 is a cross-sectional view of FIG. 1. FIG. 3 is an exploded perspective view showing a front panel of FIG. 1. FIG. 4 is a perspective view showing a front panel upper portion of FIG. 1. FIG. 5 is a perspective view of a vane module shown in FIG. 3. FIG. 6 is a perspective view when viewed in a different direction of FIG. 5. FIG. 7 is a perspective view of the vane module when viewed from above in FIG. 5. FIG. 8 is a front view of the vane module shown in FIG. 3. FIG. 9 is a rear view of the vane module shown in FIG. 3. FIG. 10 is a plan view of the vane module shown in FIG. 3. FIG. 11 is a perspective view showing an operation structure of the vane module shown in FIG. 5. FIG. 12 is a front view of a drive link shown in FIG. 11. FIG. 13 is a front view of a first vane link shown in FIG. 11. FIG. 14 is a front view of a second vane link shown in FIG. 11. FIG. 15 is a bottom view of the front panel in a state where a suction grill is separated from FIG. 1. FIG. 16 is a side cross-sectional view of the vane module shown in FIG. 2. FIG. 17 is an exemplary view of a discharge step P1 according a first embodiment of the present disclosure. FIG. 18 is an exemplary view of a discharge step P2 according to the first embodiment of the present disclosure. FIG. 19 is an exemplary view of a discharge step P3 according to the first embodiment of the present disclosure. FIG. 20 is an exemplary view of a discharge step P4 according to the first embodiment of the present disclosure. FIG. 21 is an exemplary view of a discharge step P5 according to the first embodiment of the present disclosure. FIG. 22 is an exemplary view of a discharge step P6 according to the first embodiment of the present disclosure. FIG. 23 is a flowchart showing a control method during heating according to the first embodiment of the present disclosure.

Configuration of Indoor Unit

An indoor unit of an air conditioner according to the present embodiment includes a case 100 in which a suction port 101 and a discharge port 102 are formed, an indoor heat exchanger 130 which is disposed inside the case 100, and an indoor blowing fan 140 which is disposed inside the case 100 and causes air to flow to the suction port 101 and the discharge port 102.

Configuration of Case

In the present embodiment, the case 100 includes a case housing 110 and a front panel 300. The case housing 100 is installed to be suspended to a ceiling of a room via a hanger (not shown), and an opening is formed in a lower side of the case housing 100. The front panel 300 covers an opening surface of the case housing 110, is displaced to face a bottom of the room, and is exposed to the room, and the suction port 101 and the discharge port 102 are formed in the front panel 300.

The case 100 may be implemented in various ways depending on a manufacturing form, and a configuration of the case 100 does not limit a scope of the present disclosure.

The suction port 101 is disposed at a center of the front panel 300, and the discharge port 102 is disposed outside the suction port 101. The number of suction ports 101 or the number of discharge ports 102 is independent of the scope of the present disclosure. In the present embodiment, one suction port 101 is formed, and a plurality of discharge ports 102 are disposed.

In the present embodiment, the suction port 101 is formed in a rectangular shape when viewed from the bottom, and four discharge ports 102 are spaced apart from each edge of the suction port 101 by a predetermined gap.

Configuration of Indoor Heat Exchanger

The indoor heat exchanger 130 is disposed between the suction port 101 and the discharge ports 102, and the indoor heat exchanger 130 divides an inside of the case 100 into an inside and an outside. In the present embodiment, the indoor heat exchanger 130 is disposed vertically.

The indoor blowing fan 140 is located inside the indoor heat exchanger 130.

When the indoor heat exchanger is viewed from a top or a bottom, an overall shape is formed as "□", and some sections may be separated.

The indoor heat exchanger 130 is disposed such that the air discharged from the indoor blowing fan 140 enters the indoor heat exchanger 130 vertically.

A drain pan 132 is installed inside the case 100, and the indoor heat exchanger 130 is mounted on the drain pan 132. After condensed water generated by the indoor heat exchanger 130 flows to the drain pan 132, and the condensed water may be stored therein. A drain pump (not shown) for discharging the collected condensed water to the outside is disposed in the drain pan 132.

The drain pan 132 may have an inclined surface having a direction to collect and store condensed water flowing down from the indoor heat exchanger 130 to one side.

Configuration of Indoor Blowing Fan

The indoor blowing fan 140 is located inside the case 100 and is disposed above the suction port 101. The indoor blowing fan 140 uses a centrifugal blower which sucks air to the center and discharges the air in a circumferential direction.

The indoor blowing fan 140 includes a bell mouse 142, a fan 144, and a fan motor 146.

The bell mouse 142 is disposed above the suction grill 320 and located below the fan 144. The bell mouse 142 guides the air passing through the suction grill 320 to the fan 144.

The fan motor 146 rotates the fan 144. The fan motor 146 is fixed to the case housing 110. The fan motor 146 is located above the fan 144. At least a portion of the fan motor 146 is located higher than the fan 144.

A motor shaft of the fan motor 146 is disposed downward, and the fan 144 is coupled with the motor shaft.

The indoor heat exchanger 130 is located outside an edge of the fan 144. At least a portion of the fan 144 and at least a portion of the indoor heat exchanger 130 are disposed on the same horizontal line. At least a portion of the bell mouse 142 is inserted into the fan 144. At least a portion of the bell mouse 142 overlaps the fan 144 in a vertical direction.

Configuration of Channel

The indoor heat exchanger 130 is disposed inside the case housing 110 and divides an internal space of the case housing 110 into an inside and an outside.

An inner space surrounded by the indoor heat exchanger 130 is defined as a suction channel 103, and an outer space of the indoor heat exchanger 130 is defined as a discharge channel 104.

The indoor blowing fan 140 is disposed in the suction channel 103. The discharge channel 104 is formed between an outside of the indoor heat exchanger 130 and a side wall of the case housing 110.

When viewed in a top or a bottom, the suction channel 103 is an inside surrounded by "□" of the indoor heat exchanger and the discharge channel 104 is an outside of "□" of the indoor heat exchanger.

The suction channel 103 communicates with the suction port 101 and the discharge channel 104 communicates with the discharge port 103.

The air flows from a lower side of the suction channel 103 to an upper side thereof, and flows from an upper side of the discharge channel 104 to a lower side thereof. A flow direction is converted by 1800 with reference to the indoor heat exchanger 130.

The suction port 101 and the discharge port 102 are formed on the same surface as that of the front panel 300.

The suction port 101 and the discharge port 102 are disposed in the same direction as each other. In the present embodiment, the suction port 101 and the discharge port 102 are disposed to face the bottom of the room.

In a case where a front panel 300 is curved, the discharge port 102 may be formed to have a slight side inclination, but the discharge port 102 connected to the discharge channel 104 is formed to face the lower side.

A vane module 200 is disposed to control a direction of air discharged through the discharge portion 102.

Configuration of Front Panel

The front panel 300 is coupled with the case housing 110, and includes a front body 310 in which the suction port 101 and the discharge ports 102 are formed, the suction grill 320 in which a plurality of grill holes 321 are formed and which covers the suction port 101, a prefilter 330 which is detachably assembled to the suction grill 320, and the vane module 200 which is provided in the front body 310 and controls an air flow direction of the discharge port 102.

The suction grill 320 is detachably installed in the front body 310. The suction grill 320 may be elevated in an up-down direction from the front body 310. The suction grill 320 covers the entire suction port 101.

In the present embodiment, the suction grill 320 has the plurality of grill holes 321 through a lattice form. The grill holes 321 communicate with the suction port 101.

The prefilter 330 is disposed above the suction grill 320. The prefilter 330 filters the air sucked into the case 100. The prefilter 330 is located above the grill holes 321 and filter the air passing through the suction grill 320.

The discharge port 102 is formed in a form of an elongated slit along an edge of the suction port 101. The vane module 200 is located on the discharge port 102 and is coupled with the front body 310.

In the present embodiment, the vane module 200 may be separated from a lower side of the front body 310. That is, the vane module 200 may be disposed regardless of a coupling structure of the front body 310 and may be separated independently from the front body 310. In the structure of the vane module 200 will be described in detail later.

Configuration of Front Body

The front body 310 is coupled with a lower side of the case housing 110 and is disposed toward the inside of the room. The front body 310 is installed on a ceiling of the room and is exposed to the room.

The front body 310 is coupled with the case housing 110 and the case housing 110 supports a load of the front body 310. The front body 310 supports loads of the suction grill 320 and the prefilter 330.

When the front body 310 is viewed from the top, the front body 310 is formed in a rectangular shape. The shape of the front body 310 may be formed variously.

An upper surface of the front body 310 may be formed horizontally to be in close contact with the ceiling, and an edge of a lower surface thereof may form a slight curved surface.

The suction port 101 is disposed at a center of the front body 310, and the plurality of discharge ports 102 are disposed outside the edge of the suction port 101.

When viewed from the top, the suction port 101 may be formed in a square shape, and the discharge port 102 may be formed in a rectangular shape. The discharge port 102 may be formed in an elongated slit shape in which a length is longer than a width.

The front body 310 includes a front frame 312, a side cover 314, and a corner cover 316.

The front frame 312 provides a load and a rigidity of the front panel 300 and is fastened to be fixed to the case housing 110. The suction port 101 and the four discharge ports 102 are formed in the front frame 312.

In the present embodiment, the front frame 312 includes a side frame 311 and corner frame 313.

The corner frame 313 is disposed at each corner of the front panel 300. The side frame 311 is coupled with two corner frames 313. The side frame 311 includes an inner side frame 311*a* and an outer side frame 311*b*.

The inner side frame 311*a* is disposed between the suction port 101 and the discharge port 102 and couples two corner frames 313 to each other. The outer side frame 311*b* is disposed outside the discharge port 102.

In the present embodiment, four inner side frames 311*a* and four outer side frames 311*b* are provided.

The suction port 101 is located inside the four inner side frames 311*a*. Each discharge port 102 is formed to be surrounded by two corner frames 313, the inner side frame 311*a*, and the outer side frame 311*b*.

Moreover, the side cover 314 and the corner 316 are coupled with a bottom surface of the front frame 312. The side cover 314 and the corner cover 316 are exposed to a user and the front frame 312 is not visible to the user.

The side cover 314 is disposed at an edge of the front frame 313 and the corner cover 316 are disposed at a corner of the front frame 312.

The side cover 314 is formed of a synthetic resin material and is fastened to be fixed to the front frame 312. Specifically, the side cover 314 is coupled with the side frame 311, and the corner cover 316 is coupled with the corner frame 313.

In the present embodiment, four side covers 314 and four corner covers 316 are provided. The side covers 314 and the corner covers 316 are coupled with the front frame 312 and connected to each other so as to be one structure. The four side covers 314 and four corner covers 316 in the front panel 300 form one edge.

The side cover 314 is disposed below the side frame 311, and the corner cover 316 is disposed below the corner frame 313.

The four side covers 314 and four corner covers 316 are assembled to form a square edge. The four side covers 314 and four corner covers 316 connected to each other are defined as front decor 350.

The front decor 350 forms a decor outer border 351 and an inner border 352.

When viewed from a top or a bottom, the decor outer boarder 351 is formed in a quadrangle, and the entire decor inner border 352 is also formed in a quadrangle. However, a corner of the decor inner border forms a predetermined curvature.

The suction grill 320 and the four vane modules 200 are disposed inside the decor inner border 352. In addition, the suction grill 320 and the four vane modules 200 are in contact with the decor inner border 352.

In the present embodiment, four side covers 314 are disposed, and each side cover 314 is coupled with the front frame 312. An outer edge of the side cover 314 forms a portion of the decor outer board 351, and the inner edge thereof forms a portion of the decor inner boarder 352.

Particularly, the inner edge of the side cover 314 forms an outer boundary of the discharge port 102. The inner edge of the side cover 314 is defined as a side decor inner border 315.

In the present embodiment, four corner covers 316 are disposed and each corner cover 316 is coupled with the front frame 312. An outer edge of the corner cover 316 forms a portion of the decor outer border 351 and an inner edge thereof forms a portion of the decor inner border 352.

The inner edge of the corner cover 316 is defined as a corner decor inner border 317.

The corner decor inner border 317 may be disposed in contact with the suction grill 320. In the present embodiment, an inner edge of the corner cover 316 is disposed to face the suction grill 320 and is spaced apart by a predetermined gap from the suction grill 320 to form a gap 317*a*.

The side decor inner border 315 is also spaced apart by a predetermined gap from the vane module 200 to form a gap 315*a*, and is disposed to face the outer edge of the vane module 200.

Accordingly, the decor inner border 352 is spaced apart by a predetermined gap from the outer edges of the four vane modules 200 and the suction grill 320, and forms a continuous gap.

A continuous gap formed by the four side decor inner border gaps 315*a* and the four corner decor inner border gaps 317*a* is defined as a front decor gap 350*a*.

The front decor gap 350*a* is formed at the inner edge of the front decor 350. Specifically, the front decor gap 350*a* is formed to be spaced apart from the outer edges of the vane module 200 and the suction grill 320 and the inner edge of the front decor 350.

When the vane module 200 is not operated (when the indoor unit stops), the front decor gap 350*a* makes the suction grill 320 and the vane module 200 appear as one structure.

Configuration of Suction Grill

The suction grill 320 is located below the front body 310. The suction grill 320 can be lifted or lowered in a state of being in close contact with a bottom surface of the front body 310.

The suction grill 320 includes a grill body 322 and the plurality of grill holes 321 which are formed to penetrate the grill body 322 in the vertical direction.

The suction grill 320 is disposed below the suction port 101, communicates with the suction port 101 via the plurality of grill holes 321, and includes the grill body 322 formed in a rectangular shape and a grill corner portion 327 which is formed to extend in a diagonal direction from the edge of the grill body 322.

A bottom surface of the grill body 322 and a bottom surface of a first vane 210 may form a continuous surface. In addition, the bottom surface of the grill body 322 and a bottom surface of the corner cover 316 may form a continuous surface.

A plurality of grills 323 are disposed inside the grill body 322 in a grid shape. The grid-shaped grills 323 form rectangular grill holes 321. A portion in which the grills 323 and the grill holes 321 are formed is defined as a suction portion.

The grill body 322 includes a suction portion which sucks air and a grill body portion 324 which is disposed to surround the suction portion. When viewed from a top or a bottom, the entire shape of the suction portion is rectangular.

Each corner of the suction portion is disposed to face each corner of the front panel 300, and more specifically, is disposed to face the corner cover 316.

When viewed from a bottom, the grill body 322 is formed in a rectangular shape.

An outer edge of the grill body portion 324 is disposed to face the discharge port 102 and the front decor 350.

The outer edge of the grill body portion 324 includes a grill corner border 326 which is disposed to face the corner cover 316 and a grill side border 325 which forms the discharge port 102 and is disposed to face the side cover 314.

The grill corner border 326 may be formed to be curved with an inside of the suction grill 320 as a center, and the grill side border 325 may be formed to be curved with an outside of the suction grill 320 as a center.

The grill body portion 324 further includes the grill corner border 326 and the grill corner portion 327 surrounded by two grill side border 325. The grill corner portion 327 is formed to protrude from the grill body portion 324 toward the corner cover 316 side.

The grill corner portion 327 is disposed at each corner of the grill body 322. The grill corner portion 327 extends toward each corner of the front panel 300.

In the present embodiment, four grill corner portions 327 are disposed. For convenience of description, the four grill corner portions 327 are defined as a first grill corner portion 327-1, a second grill corner portion 327-2, a third grill corner portion 327-3, and a fourth grill corner portion 327-4.

The grill side border 325 is formed to be recessed inward from the outside.

The discharge port 102 is formed between the side cover 314 and the suction grill 320. More specifically, one discharge port 102 is formed between the side decor inner border 315 of the side cover 314 and the grill side border 325 of the grill body 322. The respective discharge ports 102 are formed between the side decor inner borders 315 and the grill side borders 325 of the suction grill 320 disposed in four directions.

In the present embodiment, a length of the grill corner border 326 is the same as a length of the corner decor inner border 317. That is, a width of the corner cover 316 is the same as a width of the grill corner portion 327.

In addition, an inner width of the side cover 314 is the same as a width of the grill side border 325.

The grill side border 325 is described in more detail as follows.

The grill side border 325 forms an inner boundary of the discharge port 102. The side decor inner border 315 and the corner decor inner border 317 form an outer boundary of the discharge port 102.

The grill side border 325 includes a long straight line section 325*a* which extends in a length direction of the discharge port 102 and is formed in a straight line, a first curved section 325*b* which is connected to one side of the long straight line section 325*a* and has a curvature center outside the suction grill 320, a second curved section 325*c* which is connected to the other side of the long straight line section 325*a* and has a curvature center outside the suction grill 320, a first short straight line section 325*d* which is connected to the first curved section 325*b*, and a second short straight line section 325*e* which is connected to the second curved section 325*c*.

Configuration of Vane Module

The vane module 200 is provided in the discharge channel 104 and controls the flow direction of the air discharged through the discharge port 102.

The vane module 200 includes a module body 400, the first vane 210, a second vane 220, a vane motor 230, a drive link 240, a first vane link 250, and a second vane link 260.

The first vane 210, the second vane 220, the vane motor 230, the drive link 240, the first vane link 250, and the second vane link 260 are all installed in the module body 400. The module body 400 is integrally installed in the front panel 300. That is, all components of the vane module 200 are modularized, and thus, are installed in the front panel 300 at once.

Since the vane module 200 is modularized, it is possible to shorten an assembly time and to easily replace the vane module 200 when is failed.

In the present embodiment, a step motor is used as the vane motor 230.

Configuration of Module Body

The module body 400 may be configured in one body. In the present embodiment, in order to minimize an installation space and to minimize the manufacturing cost, the module body 400 is manufactured to be separated into two parts.

In the present embodiment, the module body 400 includes a first module body 410 and a second module body 420.

The first module body 410 and the second module body 420 are formed symmetrically right and left. In the present embodiment, common configurations will be described using the first module body 410 as an example.

The first module body 410 and the second module body 420 are fastened to the front body 310, respectively. Specifically, the first module body 410 and the second module body 420 are respectively installed in the corner frame 313.

The first module 410 is installed in the corner frame 313 disposed on one side of the discharge port 102 in a horizontal direction, and the second module body 420 is disposed in the corner frame 313 on the other side of the discharge port 102 in the horizontal direction.

The first module 410 and the second module body 420 are in close contact with the bottom surfaces of the respective corner frames 313 in the vertical direction and are fastened by a fastening member 401.

Accordingly, the first module body 410 and the second module body 420 are disposed below the front body 310. When viewed from a state where the indoor unit is installed, fastening directions of the first module body 410 and the corner frame 313 are from a lower side toward an upper side, and fastening directions of the first module body 410 and the corner frame 313 also are from the lower side toward the upper side.

According to this structure, the entire vane module 200 can be easily separated from the front body 310 in a service process.

The vane module 200 includes the first module body 410 which is disposed on one side of the discharge port 102, is located below the front body 310, and is detachably assembled to the front body 310 from below, a second module body 420 which is disposed on the other side of the discharge port 102, is located below the front body 310, and is detachably assembled to the front body 310 from below, at least one vane 210 or 220 of which one side and the other side are respectively coupled with the first module body 410 and the second module body 420 and are rotated relative to the first module body 410 and the second module body 420, the vane motor 230 which is installed in at least one of the first module body 410 and the second module body 420 and provides a driving force to the vane, a first fastening hole 403-1 which is disposed in the first module body 410, is disposed downward, and is formed to penetrate the first module body 410, a fastening member 401-1 which is fastened to the front body 310 through the first fastening hole 403-1, a second fastening hole 403-2 which is disposed in the second module body 420, is disposed downward, is formed to penetrate the second module body 420, and a second fastening hole 401-2 which is fastened to the front body through the second fastening hole 403-2.

Particularly, since the first module body 410 and the second module body 420 are located below the front body 310, only the vane module 200 may be separated from the front body 310 in a state where the front body 310 is installed in the case housing 110. This is commonly for all four vane modules 200.

In a case where the module body 400 is separated from the front body 310, the entire vane module 200 is separated below the front body 310.

The first module body 410 includes a module body portion 402 which is coupled with the front body 310, and a link installation portion 404 which protrudes upward from the module body portion 402.

The module body portion 402 is fastened to the front body 310 by a fastening member 401 (not shown). Unlike the present embodiment, the module body portion 402 may be coupled with the front body 310 through hook coupling, interference fit, or the like.

In the present embodiment, in order to minimize a vibration or noise generated by the first vane 210, the second vane 220, the vane motor 230, the drive link 240, the first vane link 250, the second vane link 260, or the like, the module body portion 402 is securely fastened to the front body 310.

The fastening member 401 for fixing the module body portion 402 is fastened in a direction from the lower side toward the upper side and can be separated from the upper side to the lower side.

The module body portion 402 has a fastening hole 403 through which the fastening member 401 passes.

For convenience of description, when it is necessary to distinguish between the fastening hole formed in the first module body 410 and the fastening hole formed in the second module body 420, the fastening hole disposed in the first module body 410 is referred to as a first fastening hole 403-1, and the fastening hole disposed in the second module body 420 is referred to as a second fastening hole 403-1.

In addition, when it is necessary to distinguish the fastening member 401, the fastening member 401 installed in the first fastening hole 403-1 is defined as a first fastening member 401-1, and the fastening member 401 installed in the second fastening hole 403-1 is defined as a second fastening member 401-2.

The first fastening member 401-1 passes through the first fastening hole and is fastened to the front body 310. The second fastening member 401-2 passes through the second fastening hole and is fastened to the front body 310.

Before the module body 400 is fastened to be fixed, a module hook 405 is disposed to temporarily fix a position of the module body 400.

The module hook 405 is coupled with the front panel (300, specifically front body 310). Specifically, the module hook 405 and the front body 310 forms a mutual hook.

A plurality of module hooks 405 may be disposed in one module body. In the present embodiment, the module hooks 405 are disposed at an outer edge and a front edge, respectively. That is, the module hook 405 is disposed outside the first module body 410 and the second module body 420, and each module hook 405 is symmetrical in right and left directions.

The vane module 200 can be temporarily fixed to the frame body 310 by the module hook 405 of the first module body 410 and the module hook 405 of the second module body 420.

In fixing by the module hooks 405, some play may be generated in the coupling structure. The fastening member 401 securely fixes the temporarily fixed module body 400 to the front body 310.

The fastening hole 403 in which the fastening member 401 is installed may be located between the module hooks 405. The fastening hole 403 of the first module body 410 and the fastening hole 403 of the second module body 420 are disposed between the module hook 405 on one side and the module hook 405 on the other side.

In the present embodiment, the module hooks 405 and the fastening holes 403 are disposed in a line.

Even when the fastening members 401 are disassembled, it is possible to maintain a state where the vane module 200 is coupled with the frame body 310 by the module hooks 405.

During repair or failure, when it is necessary to separate the vane module 200, the state where the vane module 200 is coupled with the front panel 300 is maintained even when the fastening member 401 is separated. Accordingly, when a worker dissembles the fastening member 401, the worker does not need to separately support the vane module 200.

Since the vane module 200 is firstly fixed by the module hook 405 and is secondly fixed by the fastening member 401, it is possible to greatly improve convenience of a work during service.

The module body portion 402 is disposed horizontally and the link installation portion 404 is disposed vertically. In particular, the link installation portion 404 protrudes upward from the module body portion 402 when viewed in an installed state.

The link installation portion 404 of the first module body 410 and the link installation portion 404 of the second module body 420 are disposed to face each other. The first vane 210, the second vane 220, drive link 240, first vane link 250, and the second vane link 260 are installed between the link installation portion 404 of the first module body 410 and the link installation portion 404 of the second module body 420. The vane motor 230 is disposed outside the link installation portion 404 of the first module body 410 or outside the link installation portion 404 of the second module body 420.

The vane motor 230 may be installed in only one of the first module body 410 and the second module body 420. In the present embodiment, the vane motor 230 is installed in each of the first module body 410 or the second module body 420.

The first vane 210, the second vane 220, the drive link 240, the first vane link 250, and the second vane link 260 are coupled with each other between the first module body 410 and the second module body 420 such that the vane module 200 is integrated.

In order to install the vane motor 230, a vane motor installation portion 406 protruding outward of the link installation portion 404 is disposed. The vane motor 230 is fastened to be fixed to the vane motor installation unit 406. The vane motor installation portion 406 is formed in a boss shape, and the vane motor 230 is fixed to the vane motor installation portion 406. Due to the vane motor installation unit 406, the link installation portion 404 and the vane motor 230 are spaced apart from each other by a predetermined gap.

The link installation portion 404 includes a drive link coupling portion 407 to which the drive link 240 is assembled and which provides a rotation center to the drive link 240, a first vane link coupling portion 408 to which the first vane link 250 is assembled and provides a center of rotation to the first vane link 250, and a second vane coupling portion 409 which is coupled with the second vane 220 and provides a center of rotation to the second vane 220.

In the present embodiment, each of the drive link coupling portion 407, the first vane link coupling portion 408, and the second vane coupling portion 409 is formed in a hole shape. Unlike the present embodiment, each of the drive link coupling portion 407, the first vane link coupling portion 408, and the second vane coupling portion 409 may be formed in the form of a boss and may be implemented in various forms to provide a rotation shaft.

Meanwhile, the link installation portion 404 includes a stopper 270 for limiting a rotation angle of the drive link 240. The stopper 270 protrudes toward the opposite link installation portion 404.

In the present embodiment, the stopper 270 generates an interference at a specific position when the drive link 240 rotates and limits the rotation of the drive link 240. The stopper 270 is located within a radius of rotation of the drive link 240.

In the present embodiment, the stopper 270 is manufactured integrally with the link installation portion 404. In the present embodiment, the stopper 270 provides an installation position of the drive link 240, maintains a contact state when the drive link 240 is rotated, and suppresses the vibration or play of the drive link 240.

In the present embodiment, the stopper 270 is formed in an arc shape.

Configuration of Drive Link

The drive link 240 is directly connected to the vane motor 230. A motor shaft (not shown) of the vane motor 230 is directly coupled with the drive link 240, and an amount of rotation of the drive link 240 is determined according to a rotation angle of the rotation shaft of the vane motor 230.

The drive link 240 is assembled to the vane motor 230 through the link installation portion 404. In the present embodiment, the drive link 240 passes through the drive link coupling portion 407.

The drive link 240 includes a drive link body 245, a first drive link shaft 241 which is disposed in the drive link body 245 and is rotatably coupled with the first vane 210, a core link shaft 243 which is disposed in the drive link body 245 and is rotatably coupled with the link installation portion 404 (specifically, drive link coupling portion 407), and a second drive link shaft 242 which is disposed in the drive link body 245 and is rotatably coupled with the second vane link 2660.

The drive link body 245 includes a first drive link body 246, a second drive link body 247, and a core body 248.

The core link shaft 243 is disposed in the core body 248, the first drive link shaft 241 is disposed in the first drive link body 246, and the core link shaft 243 is disposed in the second drive link body 247.

The core body 248 is connected to the first drive link body 246 and the second drive link body 247. A shape of each of the first drive link body 246 and the second drive link body 247 is particularly limited. However, in the present embodiment, each of the first drive link body 246 and the second drive link body 247 is approximately formed in a straight line shape.

The first drive link body 246 is formed to be longer than the second drive link body 247.

The core link shaft 243 is rotatably assembled to the link installation portion 404. The core link shaft 243 is assembled to the drive link coupling portion 407 formed in the link installation portion 404. The core link shaft 243 can rotate relative to the drive link coupling portion 407 in a state of being coupling to the drive link coupling portion 407.

The first drive link shaft 241 is rotatably assembled to the first vane 210. The second drive link shaft 242 is rotatably assembled to the second vane link 260.

The first drive link shaft 241 and the second drive link shaft 242 protrude in the same direction as each other. The core link shaft 243 protrudes in a direction opposite to that of each of the first drive link shaft 241 and the second drive link shaft 242.

A predetermined angle is formed between the first drive link body 246 and the second drive link body 247. An imaginary straight line connecting the first drive link shaft 241 and the core link shaft 243 to each other and an imaginary straight line connecting the core link shaft 243 and the second drive link shaft 242 form a predetermined angle E therebetween. The angle E is more than 0° and less than 180°.

The first drive link shaft 241 provides a structure in which the drive link body 245 and the first vane 210 can rotate relative to each other. In the present embodiment, the first drive link shaft 241 is integrally formed with the drive link body 245. Unlike the present embodiment, the first drive link shaft 241 may integrally formed with the first vane 210 or a joint rib 214.

The core link shaft 243 provides a structure in which the drive link body 245 and the module body (specifically, link installation portion 404) can rotate relative to each other. In the present embodiment, the core link shaft 243 is integrally formed with the drive link body 245.

The second drive link shaft 242 provides a structure in which the second vane link 260 and the drive link 240 can rotate relative to each other. In the present embodiment, the second drive link shaft 242 is integrally formed with the drive link body 245. Unlike the present embodiment, the second drive link shaft 242 may be integrally manufactured with the second vane link 260.

In the present embodiment, the second drive link shaft 242 is disposed in the second drive link body 247. The second drive link shaft 242 is disposed on a side opposite to the first drive link shaft 241 based on the core link shaft 243.

An imaginary straight line connecting the first drive link shaft 241 and the core link shaft 243 to each other and an imaginary straight line connecting the core link shaft 243 and the second drive link shaft 242 to each other form a predetermined angle E therebetween. The angle E is more than 0° and less than 180°.

Configuration of First Vane Link

In the present embodiment, the first vane link 250 is formed of a rigid material and is formed in a straight line shape. Unlike the present embodiment, the first vane link 250 may be formed in a curved line.

The first vane link 250 includes a first vane link body 255, a 1-1st vane link shaft 251 which is disposed in the first vane link body 255, is assembled to the first vane 210, and rotates relative to the first vane 210, and a 1-2nd vane link shaft 252 which is disposed in the first vane link body 255, is assembled to the module body (400, specifically, link installation portion 404), and rotates relative to the module body 400.

The 1-1st vane link shaft 251 protrudes to the first vane 210 side. The 1-1st vane link shaft 251 is assembled to the first vane 210 and can rotate relative to the first vane 210.

The 1-2nd vane link shaft 252 is assembled to the link installation portion 404 of the module body 400. Specifically, the 1-2nd vane link shaft 252 is assembled to the first vane link coupling portion 408 and can rotate relative to the first vane link coupling portion 408.

Configuration of Second Vane Link

In the present embodiment, the second vane link 260 is formed of a rigid material and is formed to extend in a straight line shape. Unlike the present embodiment, the first vane link 250 may be formed in a curved line.

The second vane link 260 includes a second vane link body 265, a 2-1st vane link shaft 261 which is disposed in the second vane link body 265, is assembled to the second vane 220, and rotates relative to the second vane 220, and a 2-2nd vane link shaft portion 262 which is disposed in the second vane link body 265, is assembled to the drive link (240, specifically, second drive link shaft 242), and rotates relative to the drive link 240.

In the present embodiment, the 2-2nd vane link shaft portion 262 is formed in a hole shape penetrating the second vane link body 265. Since the 2-2nd vane link shaft portion 262 and the second drive link shaft 242 have a relative structure, if one thereof is formed in the form of a shaft, the other is formed in the form of a hole providing a center of rotation. Accordingly, unlike the present embodiment, the 2-2nd vane link shaft portion may be formed in the form of a shaft, and the second drive link shaft may be formed in the form of a hole.

This configuration can be replaced in all configurations which are coupled with the drive link, the first vane link, and the second vane link relatively, and a modification example thereof will not be described in detail.

Configuration of Vane

For the sake of description, a direction in which the air is discharged is defined as a front side, and a direction opposite to the front side is defined as a rear side. In addition, a ceiling side is defined as an upper side, and a bottom is defined as a lower side.

In the present embodiment, the first vane 210 and the second vane 220 are disposed to control the flow direction of the air discharged from the discharge port 102. A relative disposition and a relative angle of the first vane 210 and the second vane 220 are changed according to each step of the vane motor 230. In the present embodiment, the first vane 210 and the second vane 220 are paired according to each step of the vane motor 230 and provide six discharge steps P1, P2, P3, P4, P5, and P6.

The discharge steps P1, P2, P3, P4, P5, and P6 are defined as fixed states in which the first vane 210 and second vane 220 are not moved. As a concept opposite to the discharge steps, in the present embodiment, a moving step may be provided. The moving step is defined as an airflow provided by the six discharge steps P1, P2, P3, P4, P5, P6 being combined with each other and the first vane 210 and the second vane 220 being operated.

Configuration of First Vane

The first vane 210 is disposed between the link installation portion 404 of the first module body 410 and the link installation portion 404 of the second module body 404.

When the indoor unit is not operated, the first vane 210 covers most of the discharge port 210. Unlike the present embodiment, the first vane 210 may be manufactured to the entire discharge portion 210.

The first vane 210 is coupled with the drive link 240 and the first vane link 250.

The drive link 240 and the first vane link 250 are respectively disposed on one side and the other side of the first vane 210.

The first vane 210 rotates relative to the drive link 240 and the first vane link 250.

When it is necessary to distinguish positions of the drive link 240 and the first vane link 250, the drive link 240 coupled with the first module body 410 is referred to as a first drive link, and the first vane link 250 coupled with the first module body 410 is referred to as a 1-1st vane link. The drive link 240 coupled with the second module body 420 is referred to as a second drive link, and the first vane link 250 coupled with the second module body 420 is referred to as a 1-2nd vane link.

The first vane 210 includes a first vane body 212 which is formed to extend in a length direction of the discharge port 102, and a joint rib which protrudes upward from the first vane body 212 and with which the drive link 240 and the first vane link 250 are coupled.

The first vane body 212 is formed of a smooth curved surface.

The first vane body 212 controls the direction of the air discharged along the discharge channel 104. The discharged air may hit an upper side or a lower side of the first vane body 212 and thus, the flow direction of the air may be guided.

The flow direction of the discharged air and the length direction of the first vane body 212 are orthogonal to each other or intersect each other.

The joint rib 214 is an installation structure for coupling the drive link 240 and the first vane link 250. The joint ribs 214 are disposed on one side and the other side of the first vane 210, respectively.

The joint rib 214 is formed to protrude upward from an upper surface of the first vane body 212. The joint rib 214 is formed along the flow direction of the discharged air and minimizes a resistance to the discharged air. Accordingly, the joint ribs 214 are orthogonal or intersect with respect to the length direction of the first vane body 212.

In the joint rib 214, a side (front side) to which the air is discharged is low and a side (rear side) which air enters is high. In the present embodiment, in the joint rib 214, a side with which the drive link 240 is coupled is low, and a side with which the first vane link 250 is coupled is high.

The joint rib 214 includes a second joint portion 217 which is rotatably coupled with the drive link 240 and a first joint portion 216 which is rotatably coupled with the first vane link 250.

The joint rib 214 may be manufactured integrally with the first vane body 212.

In the present embodiment, each of the first joint portion 216 and the second joint portion 217 are formed in the form of a hole and penetrates the joint rib 214.

Each of the first joint portion 216 and the second joint portion 217 can be coupled via a shaft or a hinge, and can be modified in various forms.

The second joint portion 217 is located higher than the first joint portion 216 when viewed from the front side.

The second joint portion 217 is located behind the first joint portion 216. The first drive link shaft 241 is assembled to the second joint portion 217. The second joint portion 217 and the first drive link shaft 241 are assembled to be rotatable relative to each other. In the present embodiment, the first drive link shaft 241 penetrates the second joint portion 217 and is assembled.

The 1-1st vane link shaft 251 is assembled to the first joint portion 216.

The first joint portion 216 and the 1-1st vane link shaft 251 are assembled to be rotatable relative to each other. In the present embodiment, the 1-1st vane link shaft 251 penetrates the first joint portion 216 and are assembled to each other When viewed from the top, the drive link 250 and first vane link 250 are disposed between the joint rib 214 and the link installation portion 404.

In the present embodiment, a gap between the first joint portion 216 and the second joint portion 217 is narrower than a gap between the core link shaft 243 and the 1-2nd vane link shafts 252.

Configuration of Second Vane

The second vane 220 includes a second vane body 222 which is formed to extend in the length direction of the discharge port 102, a joint rib 224 which protrudes upward from the second vane body 222 and is coupled with be rotatable relative to the second vane link 260, and a second vane shaft 221 which is formed in the second vane body 222 and is coupled rotatably to the link installation portion 404.

The joint rib 224 can be coupled via a shaft or a hinge, and can be modified in various forms. A hole which is formed in the second joint rib 224 and is coupled so as to be rotatable relative to the second vane link 260 is defined as a third joint portion 226.

In the present embodiment, the third joint part 226 is formed in the form of a hole and penetrates the joint rib 224. The third joint part 226 can be coupled via a shaft or a hinge, and can be modified in various forms.

When it is necessary to distinguish the joint rib 214 of the first vane and the joint rib 224 of the second vane, the joint of the first vane is defined as a first joint rib 214, and the joint of the second vane is defined as a second joint rib 224.

The second vane 220 may be relatively rotated about the second joint rib 224 and may be relatively rotated about the second vane shaft 221. That is, the second vane 220 may be rotated relative to each of the second joint rib 224 and the second vane shaft 221.

When viewed from the top, the second joint rib 224 is located in front of the second vane axis 221. The second joint rib 224 moves in a constant trajectory about the second vane shaft 221.

The second vane body 222 may be formed of a smooth curved surface.

The second vane body 222 controls the direction of the air discharged along the discharge channel 104. The discharged air hits an upper surface or a lower surface of the second vane body 222, and the flow direction of the air is guided.

The flow direction of the discharged air and a length direction of the second vane body 222 are orthogonal to each other or intersect each other.

When viewed from the top, at least a portion of the second vane body 22 may be located between the first joint portions 212 of the first vane 210.

Accordingly, when the second vane 220 is located above the first vane 210, an interference therebetween is prevented. A front end of the second vane body 222 is located between the first joint portions 214. That is, a front length of the second vane body 222 is smaller than a length between the first joint portions 214.

The second joint rib 224 is an installation structure for assembling the second vane link 260. The second joint rib 224 is disposed in each of one side and the other side of the second vane body 222.

The second joint rib 224 is coupled with be rotatable relative to the second vane link 260, and in the present embodiment, the third joint portion 226 and the second vane link 260 are coupled by a shaft to be rotatable relative to each other.

The second joint rib 224 is formed upward from an upper surface of the second vane body 222. Preferably, the second joint rib 224 is formed along the flow direction of the discharged air. Accordingly, the second joint rib 224 is disposed to be orthogonal or intersect with respect to the longitudinal direction of the second vane body 222.

The second vane 220 is rotated about the second vane shaft 221. The second vane shaft 221 is formed in each of one side and the other side of the second vane body 222.

The second vane shaft 221 on the one side protrudes toward the link installation portion 404 disposed on one side, and the second vane shaft 221 on the other side protrudes toward the link installation portion 404 disposed on the other side.

The module body 400 includes a second vane coupling portion 411 which is rotatably coupled with the second vane shaft 221. In the present embodiment, the second vane coupling portion 411 is formed in the form of a hole penetrating the module body 400.

The second vane shaft 221 is located behind the second joint rib 224. The second vane link 260, the drive link 240, and the first vane link 250 are sequentially disposed in front of the second vane shaft 221.

In addition, a drive link coupling portion 407 and a first vane link coupling portion 408 are sequentially disposed in front of the second vane coupling portion 411.

Disposition of Vane Module and Suction Grill

A couple structure and a separation structure of the vane module will be described in more detail with reference to FIGS. 1 to 4 and FIG. 15.

When the suction grill 320 is separated from the state of FIG. 1, four vane modules 200 are exposed as shown in FIG. 15. The suction grill 320 is detachably assembled to the front body 310.

The suction grill 320 may be separated from the front body 310 in various manners.

The suction grill 320 may be separated in a manner that the opposite side is separated and rotated based on one edge. Alternatively, the suction grill 320 may be separated by being released in a state in which the suction grill 320 is interlocked with the front body 310. Alternatively, the suction grill 200 may maintain a state coupled with the front body 310 by a magnetic force.

In the present embodiment, the suction grill 320 may be moved in the up-down direction by an elevator 500 installed in the front body 310. The elevator 500 is connected to the suction grill 320 through a wire (not shown). The elevator 500 is operated, and thus, the wire is loosened or wound, and the suction grill 320 can be moved downward or upward.

A plurality of elevators 500 are disposed, and each elevator 500 simultaneously moves both sides of the suction grill 320.

When the suction grill 320 is moved downward, the first module body 410 and the second module body 420 which are covered with the suction grill 320 are exposed.

In a state in which the suction grill 320 is assembled to the front body 310, at least one of the first vane 210 and the second vane 220 of the vane module 200 may be exposed.

When the indoor unit is not operated, only the first vane 210 is exposed to the user. When the indoor unit is operated and the air is discharged, the second vane 220 may be selectively exposed to the user.

In a state where the suction grill 320 assembled to the front body 310, the first module body 410 and the second module body 420 of the vane module 200 are covered with the suction grill 320.

Since the fastening hole 403 is disposed in each of the first module body 410 and the second module body 420, the fastening hole 403 is covered with the suction grill 320 and are hidden from the user.

Moreover, since the first module body 410 and the second module body 420 are positioned above the grill corner portion 327 constituting the suction grill 320, the grill corner portion 327 prevents the first module body 410 and second module body 420 from being exposed to the outside.

The grill corner portion 327 also prevents the fastening holes 403 formed in the first module body 410 and the second module body 420 from being exposed. Since the grill corner portion 327 is located below the fastening hole 403, the fastening hole 403 is hidden by the grill corner portion 327.

In more detail, the suction grill 320 includes the grill body 322 which is disposed below the suction port 101, communicates with the suction port 101 via the plurality of grill holes 321, and is formed in a rectangular shape, and a first grill corner portion 327-1, a second grill corner portion 327-2, a third grill corner portion 327-3, and a fourth grill corner portion 327-4 which are formed to extend in a diagonal direction from the respective corners of the grill body 322.

The vane module 200 includes a first vane module 201 which is disposed outside each edge of the suction grill 320 and is disposed between the first grill corner portion 327-1 and the second grill corner portion 327-2, a second vane module 202 which is disposed outside each edge of the suction grill 320 and is disposed between the second grill corner portion 327-2 and the third grill corner portion 327-3, a third vane module 203 which is located outside each edge of the suction grill 320 and is disposed between the third grill corner portion 327-3 and the fourth grill corner portion 327-4, and a fourth vane module 204 which is disposed outside each edge of the suction grill 320 and is disposed between the fourth grill corner portion 327-4 and the first grill corner portion 327-1.

The first module body 410 and the second module body 420 disposed between the first vane module 201 and the second vane module 202 are located above the first grill corner portion 327-1 and are hidden by the first grill corner portion 327-1. Specifically, the second module body of the first vane module and the first module body of the second vane module are disposed above the first grill corner portion.

The first module body and the second module body disposed between the second vane module 202 and the third vane module 203 are located above the second grill corner portion 327-2 and are hidden by the second grill corner portion 327-2. Specifically, the second module body of the second vane module and the first module body of the third vane module are disposed above the second grill corner portion.

The first module body and the second module body disposed between the third vane module 203 and the fourth vane module 204 are located above the third grill corner portion 327-3 and are hidden by the third grill corner portion 327-3. Specifically, the second module body of the third vane module and the first module body of the fourth vane module are disposed above the third grill corner portion.

The first module body and the second module body disposed between the fourth vane module 204 and the first vane module 201 are located above the fourth grill corner portion 327-4 and are hidden by the fourth grill corner portion 327-4. Specifically, the second module body of the fourth vane module and the first module body of the first vane module are disposed above the fourth grill corner portion.

Referring to FIG. 15, the vane module 200 disposed at 12 o'clock is defined as the first vane module 201, the vane module 200 disposed at 3 o'clock is defined as the second vane module 202, the vane module 200 disposed at 6 o'clock is defined as the third vane module 203, and the vane module 200 disposed at 9 o'clock is defined as the fourth vane module 204.

The first vane module 201, the second vane module 202, the third vane module 203, and the fourth vane module 204 are disposed with a gap of 90° from a center C of the front panel 300.

The first vane module 201 and the third vane module 203 are disposed in parallel to each other, and the second vane module 202 and the fourth vane module 204 are disposed in parallel to each other.

Four side covers 314 are disposed in the front body 310. For convenience of description, the side cover 314 disposed outside the first vane module 201 is defined as a first side cover 314-1, the side cover 314 disposed outside the second vane module 202 is defined as a second side cover 314-2, the side cover 314 disposed outside the third vane module 203 is defined as the third side cover 314-3, and the side cover 314 disposed outside the fourth vane module 204 is defined as a fourth side cover 314-4.

Each side cover 314 is assembled to the edge of the front frame 312, is located below the front frame 312, is exposed to the outside, and is disposed outside each vane module 202.

The corner cover 316 disposed between the first vane module 201 and the second vane module 202 is defined as a first corner cover 316-1. The corner cover 316 disposed between the second vane module 202 and the third vane module 203 is defined as a second corner cover 316-2. The corner cover 316 disposed between the third vane module 203 and the fourth vane module 204 is defined as a third corner cover 316-3. The corner cover 316 disposed between the fourth vane module 204 and the first vane module 201 is defined as a fourth corner cover 316-4.

The first corner cover 316-1 is assembled at the corner of the front frame 312, is located below the front frame 312, is located between the first side cover 314-1 and the second side cover. 314-2, and is exposed to the outside.

The second corner cover 316-2 is assembled at the corner of the front frame 312, is located below the front frame 312, is disposed between the second side cover 314-2 and the third side cover, and is exposed to the outside.

The third corner cover 316-3 is assembled at the corner of the front frame 312, is located below the front frame 312, is located between the third side cover 314-1 and the fourth side cover 314-4, and is exposed to the outside.

The fourth corner cover 316-4 is assembled at the corner of the front frame 312, is located below the front frame 312, is located between the fourth side cover 314-1 and the first side cover 314-1, and is exposed to the outside.

The first corner cover 316-1 and the third corner cover 316-3 are disposed in the diagonal direction based on the center C of the front panel 300 and are disposed to face each other. The second corner cover 316-2 and the fourth corner cover 316-4 are disposed in the diagonal direction based on the center C of the front panel 300 and are disposed to face each other.

Imaginary diagonal lines passing through the center of the front panel 300 are defined as P1 and P2. P1 is the imaginary line connecting the first corner cover 316-1 and the third corner cover 316-3 to each other, and P2 is the imaginary line connecting the second corner cover 316-2 and the fourth corner cover 316-4 to each other.

The first grill corner portion 327-1, the second grill corner portion 327-2, the third grill corner portion 327-3, and the fourth grill corner portion 327-4 which are formed to extend toward the corners are disposed in the suction grill 320.

The first vane module 201 is disposed outside each edge of the suction grill 320 based on the grill corner portions and is disposed between the first grill corner portion 327-1 and the second grill corner portion 327-2.

The second vane module 202 is disposed outside each edge of the suction grill and is disposed between the second grill corner portion 327-2 and the third grill corner portion 327-3.

The third vane module 203 is disposed outside each edge of the suction grill and is disposed between the third grill corner portion 327-3 and the fourth grill corner portion 327-4.

The fourth vane module 204 is disposed outside each edge of the suction grill and is disposed between the fourth grill corner portion 327-4 and the first grill corner portion 327-1.

The first grill corner portion 327-1 extends toward the first corner cover 316-1 and forms a surface which is continuous with an outer surface of the first corner cover 316-1.

The grill corner border 326 of the first grill corner portion 327-1 is opposed to the corner decor inner border 317 of the first corner cover 316-1 and forms a corner decor inner border gap 317*a*.

The grill corner border 326 of the remaining grill corner portion 327 and the corner decor inner border 317 of the corner cover 316 face each other and form the corner decor inner border gaps 317*a*, respectively.

The first module body 410 and the second module body 420 are located inside the corner cover 316 (specifically, the center C side of the front panel). In particular, the first module body 410 and the second module body 420 are disposed to face each other based on the imaginary diagonal lines P1 and P2.

Specifically, the first module body 410 of the first vane module 201 and the second module body 420 of the fourth vane module 204 are disposed to face each other based on an imaginary diagonal line P2.

Moreover, the first module body 410 of the second vane module 202 and the second module body 420 of the first vane module 201 are disposed to face each other based on the imaginary diagonal line P1.

In addition, the first module body 410 of the third vane module 201 and the second module body 420 of the second vane module 202 are disposed to face each other based on an imaginary diagonal line P2.

Moreover, the first module body 410 of the fourth vane module 204 and the second module body 420 of the third vane module 203 are disposed to face each other based on an imaginary diagonal line P1.

Meanwhile, the suction grill 320 is located below the first module bodies 410 and the second module bodies 420, and covers the first module bodies 410 and the second module bodies 420 such that the first module bodies 410 and the second module bodies 420 are not exposed. That is, in a case where the suction grill 320 is in close contact with the front body 310, the first module bodies 410 and the second module bodies 420 are covered by the suction grill 320 so that the first module bodies 410 and the second module bodies 420 are not exposed to the user.

Since the first module bodies 410 and second module bodies 420 are hidden, there is an advantage that the first module bodies 410 and second module bodies 420 also hide the fastening holes 403 formed in the suction grill 320 such that the fastening holes 403 are not exposed to the user.

The four grill corner portions 327 disposed to face the respective corner covers 316 are formed in the suction grill 320. Each grill corner portion 327 is disposed so as to face each corner cover 316.

The grill corner portion 327 disposed to face the first corner cover 316-1 is defined as the first grill corner portion 327-1, the grill corner portion 327 disposed to face the second corner cover 316-2 is defined as the second grill corner portion (327-2), the grill corner portion 327 disposed to face the third corner cover 316-3 is defined as the third grill corner portion 327-3, and the grill corner portion 327 disposed to face the fourth corner cover 316-4 is defined as the fourth grill corner portion 327-4.

When viewed from the bottom, the plurality of module bodies 400 are located above the grill corner portion 327 and are hidden by the grill corner portion 327.

In particular, the grill side border 325 forming the edge of the grill corner portion 327 is disposed to face the corner decor inner border 317 forming an inner edge of the corner cover 316, and curved shapes thereof correspond to each other.

Similarly, the grill corner border 326 forming the edge of the grill corner portion 327 is disposed to face an inner edge of the first vane 210, and curved shapes thereof correspond to each other.

Meanwhile, in the present embodiment, in order to maintain a state where the suction grill 320 is in close contact with the front body 310, a permanent magnet 318 and a magnetic force fixing unit 328 are disposed.

One of the permanent magnet 318 or the magnetic force fixing unit 328 may be disposed in the front body 310, and the other of the magnetic force fixing unit 328 or the permanent magnet 318 may be disposed on an upper surface of each grill corner portion 327.

The permanent magnet 318 and the magnetic force fixing unit 328 are located above each grill corner portion 327 and are hidden by each grill corner portion 327. Since the permanent magnet 318 and the magnetic force fixing unit 328 are located outside each corner of the suction grill 320, the separation between the suction grill 320 and the front body 310 can be minimized.

When the suction grill 320 and the front body 310 are spaced apart from each other, there is a problem that a pressure inside the suction channel 103 decreases.

In the present embodiment, the permanent magnet 318 is disposed in the front body 310. Specifically, the permanent magnet is disposed in the corner frame 313.

The magnetic force fixing unit 328 is formed of a metal material which interacts with the permanent magnet 318 and forms an attractive force. The magnetic force fixing unit 328 is disposed on the upper surface of the suction grill 320. Specifically, the magnetic force fixing unit 328 is disposed on the upper surface of the grill corner portion 327.

In a case where the suction grill 320 is moved upward and close to the permanent magnet 318, the permanent magnet 318 pulls the magnetic force fixing unit 328 and fixes the suction grill 320. The magnetic force of the permanent magnet 318 is formed smaller than own weight of the suction grill 320. Accordingly, in a case where the suction grill 320 is not pulled by the elevator 500, the coupling between the permanent magnet 318 and the magnetic force fixing unit 328 is released.

When viewed from the top or bottom, the permanent magnet 318 is disposed on the imaginary diagonal lines P1 and P2 lines. The permanent magnet 318 is located inside the corner cover 316.

When viewed from the top or bottom, one of the four permanent magnets 318 is disposed between the first module body 410 of the first vane module 201 and the second module body 420 of the fourth vane module 204. Each of the remaining three permanent magnets is also disposed between the first module body 410 and the second module body 420 of each vane module.

The permanent magnet 318 and the magnetic force fixing unit 328 are located above each grill corner portion 327 and are hidden by each grill corner portion 327.

Discharge Step According to Operation of Vane Motor

In the present embodiment, when the indoor unit is not operated (when indoor blower is not operated), as shown in the drawings, in each vane module 200, the second vane 220 is located above the first vane 210 and the first vane 210 covers the discharge port 102. A lower surface of the first vane 210 forms a surface which is continuous with a lower surface of the suction grill 320 and a lower surface of the side cover 314.

When the indoor unit is not operated, since the second vane 220 is located above the first vane 210, the second vane 220 is hidden when viewed from the outside. The second vane 220 is exposed to the use only when the indoor unit is operated. Accordingly, when the indoor unit is not operated, the second vane 220 is located on the discharge channel 104, and the first vane 210 covers most of the discharge port 102.

In the present embodiment, the first vane 210 covers most of the discharge port 102. However, the first vane 210 may be formed to cover the entire discharge port 210 according to a design.

If the indoor blower is operated in a state where the second vane 220 is stored, the vane motor 230 is operated, and the first vane 210 and the second vane 220 can be changed to any one of the six discharge steps P1, P2, P3, P4, P5, and P6.

A step when the indoor unit is stopped and the vane module 200 is not operated is defined as a stop step P0.

Stop Step P0

In a state of the stop step P0, the vane module 200 is not operated. When the indoor unit is not operated, the vane module 200 maintains the state of the stop step P0.

In the state of the stop step P0, in the vane module 200, the vane motor 230 rotates the drive link 240 at maximum in a first direction (the clockwise direction in the drawings of the present embodiment).

In this case, the second drive link body 247 constituting the drive link 240 is supported by one side end 271 of the stopper 270, and thus, a further rotation thereof in the first direction is restricted.

In order to prevent an excessive rotation of the drive link 240, in the stop step P0, the second drive link body 247 and the other side end 270*b* of the stopper 270 interfere with each other. The second drive link body 247 is supported by the stopper 270, and thus, a further rotation thereof is restricted.

The drive link 240 rotates in the first direction about the core link shaft 243, and the first vane link 250 rotates in the first direction about the 1-2nd vane link shaft 252.

The first vane 210 rotates in a state of being constrained by the drive link 240 and the first vane link 250, and is located in the discharge port 102. The lower surface of the first vane 210 forms a surface which is continuous with the suction grill 320 and the side cover 314.

In the state of the stop step P0, the second vane 220 is located above the first vane 210. In a plan view, the second vane 220 is located between the first joints 214 and is located above the first vane body 212.

Moreover, in the state of the stop step P0, the drive link 240, the first vane link 250, and the second vane link 260 are located above the first vane 210. The drive link 240, the first vane link 250, and the second vane link 260 are covered with the first vane 210, and thus, cannot be viewed from the outside. That is, in the state of the stop step P0, the first vane 210 covers the discharge port 102, and thus, components constituting the vane module 200 is prevented from being exposed to the outside.

In the state of the stop step P0, the drive link 240 rotates at maximum in the clockwise direction, and the second vane link 260 is lifted at maximum.

When the indoor unit is not operated, since the second vane 220 is located above the first vane 210, the second vane 220 is hidden from the outside. The second vane 220 is exposed to the user only when the indoor unit is operated.

In the stop step P0, a positional relationship of axes forming the centers of rotation of the respective links is as follows.

First, the first joint portion 216 and the second joint portion 217 of the first vane 210 are disposed approximately horizontally. The second join rib 224 of the second vane 220 is located above the first joint rib 214.

When viewed from the side, the second joint rib 224 is located above the second joint portion 217 and the first joint portion 216, and is located between the first joint portion 216 and the second joint portion 217.

Moreover, since the 2-1st vane link shaft 261 is coupled to the second joint rib 224, the 2-1st vane link shaft 261 also is located above the second joint portion 217 and the first joint portion 216.

The first joint portion 216 and the second joint portion 217 are located above the first vane body 212 and is located below the second vane body 222.

When the indoor unit stops, the second vane 220 is located above the first vane 210 and the 2-1st vane link shaft 261 is located above the first drive link shaft 241 and the 1-1st vane link shaft 251.

In addition, the 2-1st vane link shaft 261 is located above the second vane shaft 221, and the 2-2nd vane link shaft portion 262 is located above the 2-1st vane link shaft 261.

The 2-2nd vane link shaft portion 262 is located above the 2-1st vane link shaft 261 and is located above the core link shaft 243.

Next, in the stop step P0, relative positions and directions of the respective links are as follows.

Meanwhile, the first vane link 250 and the second vane link 260 are disposed in the same direction as each other. Upper ends of the first vane link 250 and the second vane link 260 are located on a front side in a discharge direction of the air, and lower ends thereof are located on a rear side in the discharge direction of the air.

Specifically, the 1-2nd vane link shaft 252 of the first vane link 250 is located on the front side, and the 1-1st vane link shaft 251 of the first vane link 250 is located on the rear side. The 1-2nd vane link shaft 252 of the first vane link 250 is located above the 1-1st vane link shaft 251. The first vane link 250 is disposed to be inclined toward the rear lower side based on the 1-2nd vane link shaft 252.

Similarly, the 2-2nd vane link shaft 262 of the second vane link 260 is located on the front side, and the 2-1st vane link shaft 261 of the second vane link 260 is located on the rear side. The 2-2nd vane link shaft 262 of the second vane link 260 is located above the 2-1st vane link shaft 261. The second vane link 260 is disposed to be inclined toward the rear lower side based on the 2-2nd vane link shaft 262.

The first drive link body 246 of the drive link 240 is disposed in the same direction as those of the first vane link 250 and the second vane link 260, and the second link body 247 intersects disposition directions of the first vane link 250 and the second vane link 260.

Discharge Step P1

In the state of the stop step P0, the drive link 240 rotates in a second direction (the counterclockwise direction in the drawings of the present embodiment) opposite to the first direction to provide the discharge step P1.

In a state of the discharge step P1, the vane module 200 can provide horizontal wind.

In the horizontal wind, the air discharged from the discharge port 102 may be guided by the first vane 210 and the second vane 220 to flow in a horizontal direction with the ceiling or the ground.

When the discharged air flows in the horizontal wind, a flow distance of the air can be maximized.

In the discharge step P1, the horizontal wind is provided, and the discharged air flows along the ceiling of the room.

In addition, the air flow to a lower side toward a bottom after the air hits a wall of the room, and the air returns to the indoor unit side after the air hits the bottom.

That is, in the discharge step P1, not only the air is directly provided to the occupant but also indirect wind is provided to the occupant.

In the state of the discharge step P1, the upper surfaces of the first vane 210 and the second vane 220 may form a continuous surface. In the state of the discharge step P1, the first vane 210 and the second vane 220 are connected to each other as one vane and guide the discharged air.

When the vane module 200 provides the discharge step P1 which is one of a plurality of discharge steps, the first vane 210 is located below the discharge port 102 and a front end 222*a* of the second vane 220 is located above a rear end 212*a* of the first vane 210.

The upper surface of the second vane 220 is located higher than the upper surface of the first vane 210.

In the present embodiment, the first vane 210 is disposed on the front side in the flow direction of the discharged air, and the second vane 220 is disposed on the rear side in the flow direction of the discharged air. The front end 222*a* of the second vane 220 may approach or come into contact with the rear end 212*b* of the first vane 210. In the state of the discharge step P1, a gap S1 between the front end 222*a* of the second vane 220 and the rear end 212*b* of the first vane 210 may be a minimum.

The rear end 222*b* of the second vane is located above the discharge port 102, the front end 222*a* of the second vane is located below the discharge port 102, and the rear end 212*b* of the first vane is located lower than the front end 222*a* of the second vane.

In the state of the discharge step P1, the front end 222*a* of the second vane 220 is located above the rear end 212*b* of the first vane 210.

The front end 222*a* and the rear end 212*b* approach each other or come into contact with each other, and thus, it is possible to minimize leakage of the discharged air between the first vane 210 and the second vane 220.

In the present embodiment, the front end 222*a* and the rear end 212*b* approach each other but are not in contact with each other.

Moreover, when the vane module 200 forms the horizontal wind in the discharge step P1, since the first vane 210 and the second vane 220 are connected to each other and operated as one vane, an intensity of the airflow of the horizontal wind can be increased. That is, since the discharged air is guided in the horizontal direction along the upper surface of the second vane 220 and the upper surface of the first vane 210, directivity of the discharged air can be further enhanced as compared with a case where the horizontal wind is formed by one vane.

When the horizontal wind is formed, the second vane 220 is disposed to be more inclined in the up-down direction than the first vane 210.

In the case of the horizontal wind, when viewed from the side, preferably, the first vane 210 is located below the discharge port 102, and the second vane 220 is disposed to overlap the discharge port 102.

In the state of the discharge step P1, the second vane 220 is rotated in place about the second vane shaft 221. However, since the first vane 210 is assembled together with the drive link 240 and the first vane link 250, the first vane 210 rotates (swings) in the discharge direction of the air.

If the step proceeds from P0 to P1, the second vane 220 rotates about the second vane shaft 221, the first vane 210 descends downward while advancing in the discharge direction of the air, and the front end 212*a* of the first vane rotates in the first direction (the clockwise direction in the drawings).

The drive link 240 and the first vane link 250 rotate, and thus, the first vane 210 can move below the discharge port 102, and the first vane 210 can be disposed approximately horizontally. In the related art, the vane of the indoor unit rotates in place, and thus, the same disposition as the first vane 210 of the present embodiment cannot be implemented.

When the vane motor 230 rotates the drive link 240 in the second direction (counterclockwise direction) in the stop step P0, the second vane link 260 coupled to the drive link 240 also is rotated according to the drive link 240.

Specifically, in a case where the step is changed from the stop step P0 to the discharge step P1, the drive link 240 is rotated in the counterclockwise direction, the first vane link 210 is rotated in the counterclockwise direction in accordance with the rotation of the drive link 240, and the second vane link 260 descends while being rotated relative to the first vane link 210.

Since the second vane 220 is assembled in a state of being rotatable relative to the second vane shaft 221 and the second vane link 260, the second vane 220 rotates in the clockwise direction about the second vane shaft 221 by the descending of the second vane link 260.

In order to form the horizontal wind, when the step is changed from the stop step P0 to the discharge step P1, the rotation directions of the first vane 210 and the second vane 220 are opposite to each other.

In the discharge step P1, the vane motor 230 is rotated 78° (P1 rotation angle), the first vane 210 form an inclination (first vane P1 inclination) of approximately 16° by the rotation of the vane motor 230, and the second vane 220 forms an inclination (second vane P1 inclination) of approximately 56.3°.

In the discharge step P1, the positional relationship of axes forming the centers of rotation of the respective links is as follows.

First, unlike P0, the second joint portion 217 and the first joint portion 216 of the first vane 210 is disposed to be inclined toward the front side in the discharge direction of the air. When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

The 2-1st vane link shaft 261 is located lower than the second vane shaft 221, the first drive link shaft 241 is located lower than the 2-1st vane link shaft 261, and the 1-1st vane link shaft 251 is located lower than the first drive link shaft 241.

In the P1 state, the third joint portion 226, the second joint portion 217, and the first joint portion 216 are disposed in a line, and the disposition direction is directed to the front lower side in the discharge direction of the air. When the discharge step P1 is provided, the second vane shaft 221, the 2-1st vane link shaft 261, the first drive link shaft 241, and the 1-1st vane link shaft 251 are disposed in a line.

In some embodiments, the third joint portion 226, the second joint portion 217, and the first joint portion 216 may not be disposed in a line.

In addition, also in the second vane shaft 221, the third joint portion 226, the second joint portion 217, and the first joint portion 216 may be disposed in a line. In this case, the second vane shaft 221 is located behind the third joint portion 226.

In the P1 state, the first vane 210 and the second vane 220 provide the horizontal wind. The horizontal wind does not mean that the discharge direction of the air is exactly horizontal. In the horizontal wind, the first vane 210 and the second vane 220 is connected to each other as one vane, and thus, it is possible achieve an angle between the first vane 210 and the second vane 220 capable of causing the discharged air to flow farthest in the horizontal direction by the connection between the first vane 210 and the second vane 220.

In the state of the discharge step P1, the gap S1 between the front end 222*a* of the second vane 220 and the rear end 212*b* of the first vane 210 may be formed to a minimum.

In the case of the horizontal wind, the air guided by the second vane 220 is guided to the first vane 210. When the discharged air flows as the horizontal wind in the P1 state, it is possible to maximize the flow distance of the air.

Since the discharge channel 104 is formed in the up-down direction, the inclination of the second vane 220 close to the suction port 101 is steeper than the inclination of the first vane 210.

In the state of the discharge step P1, the 1-1st vane link shaft 251 of the first vane link 250 is located below the 1-2nd vane link shaft 252.

In the state of the discharge step P1, the 2-1st vane link shaft 261 of the second vane link 260 is located below the 2-2nd vane link shaft portion 262.

In the state of the discharge step P1, the first drive link shaft 241 of the drive link 240 is located below the second drive link shaft 242 and the core link shaft 243.

In the state of the discharge step P1, in the up-down direction, the third joint portion 226 is located at the uppermost side, the first joint portion 216 is located at the lowermost side, and the second joint portion 217 is located therebetween.

In the state of the discharge step P1, the first joint portion 216 and the second joint portion 217 are located between the core link shaft 243 and the 1-2nd vane link shaft 252.

When the discharge step P1 is provided, the first drive link shaft 241 and the 1-1st vane link shaft 251 are located between the core link shaft 243 and the 1-2nd vane link shaft 252.

In the state of the discharge step P1, the first drive link shaft 241 and the 1-1st vane link shaft 251 are located below the suction grill 320. In the state of the discharge step P1, the first drive link shaft 241 and the 1-1st vane link shaft 251 are located below the discharge port 102. The 2-1st vane link shaft 261 is located across a boundary of the discharge port 102.

According to this disposition, in the state of the discharge step P1, the first vane 210 is located below the discharge port 102. In the state of the discharge step P2, the front end 222*a* of the second vane 220 is located below the discharge port 102, and the rear end 222*b* is located above the discharge port 102.

Next, in the state of the discharge step P1, relative positions and directions of the respective links are as follows.

A length direction of the first drive link body 246 is defined as D-D'. A length direction of the first vane link 250 is defined as L1-L1'.

A length direction of the second vane link 260 is defined as L2-L2'.

In the state of the discharge step P1, the first vane link 250, the second vane link 260, and the first drive link body 246 are disposed in the same direction as each other. In the present embodiment, the first vane link 250, the second vane link 260, and the first drive link body 246 are all disposed in the up-down direction in the state of the discharge step P1.

Specifically, L1-L1' of the first vane link 250 is disposed substantially vertically, and L2-L2' of the second vane link 260 is disposed substantially vertically. D-D' of the first drive link body 246 is disposed to face downward in the discharge direction of the air.

In the state of the discharge step P1, the first vane 210 is located below the discharge port 102 and the front end 222*a* of the second vane 220 is located below the discharge port 102. That is, in the case of the horizontal wind, only a portion of the second vane 220 is located outside the discharge port 102, and the entire first vane 210 is located outside the discharge port 102.

In the state of the discharge step P1, the front end 212*a* of the first vane 210 based on the discharge port 102 is located in front of the front edge 102*a* of the discharge port 102.

Discharge Step P2

The drive link 240 rotates in the second direction (the counterclockwise direction in the drawings of the present embodiment) opposite to the first direction in a state of the horizontal wind of the discharge step P1, and thus, the discharge step P2 can be formed.

When the vane module provides any discharge step of P2 to P5, the rear end 212*b* of the first vane is located higher than the front end 222*a* of the second vane and is located to be equal to or lower than the 2-1st vane link shaft.

In addition, when the vane module provides any discharge step of P2 to P5, an angle between the core link shaft 243, the first drive link shaft 241, and the 1-1st vane link shaft 251 in the clockwise direction with respect to the imaginary line D-D' connecting the core link shaft 243 and the first drive link shaft 241 to each other is an acute angle.

In the state of the discharge step P2, the vane module 200 may provide oblique wind. The oblique wind is defined as wind generated in a discharge step between the horizontal wind and the vertical wind. In the present embodiment, the oblique wind is generated in P2, P2, P4, and P5 steps.

In the inclined wind, the air is discharged below the horizontal wind of the discharge step P1. In the discharge step P2, both the first vane 210 and the second vane 220 are adjusted to face further downward than in P1.

The discharge step P2 provides wind similar to the horizontal wind, and the discharged air flows along the ceiling of the room. In addition, the air flow to a lower side toward the bottom after the air hits the wall of the room, and the air returns to the indoor unit side after the air hits the bottom.

In the discharge step P2, indirect wind provides for the occupant.

In the discharge step P2, a gap S2 between the front end 222*a* of the second vane 220 and the rear end 212*b* of the first vane 210 is formed wider than the gap S1 in the state of the discharge step P1.

That is, when the discharge step proceeds from P1 to P2, the gap between the front end 222*a* of the second vane 220 and the rear end 212*b* of the first vane 210 is widened. Compared to the discharge P1, in the discharge step P2, the first vane 210 and the second vane 220 are disposed more vertically.

When the step is changed from the discharge step P1 to the discharge step P2, the front end 222*a* of the second vane 220 descends and the rear end 212*b* of the first vane 210 ascends.

In the state of the discharge step P2, the front end 222*a* of the second vane 220 and the rear end 212*b* of the first vane 210 are respectively located at heights similar to each other.

If the discharge step proceeds from P1 to P2, the second vane 220 is rotated in place about the second vane shaft 221. However, since the first vane 210 is assembled together with the drive link 240 and the first vane link 250, the first vane 210 rotates (swings).

In particular, if the step proceeds from P1 to P2, the first vane 210 further advances in the discharge direction of the air, and the front end 212*a* of the first vane further rotates in the first direction (clockwise direction in the drawings).

Since the second vane 220 is assembled to be rotatable relative to the second vane shaft 221 and the second vane link 260, the second vane 220 further rotates in the clockwise direction about the second vane shaft 221 by the rotation of the second vane link 260.

The front end 222*a* of the second vane 220 further rotates in the second direction (the clockwise direction in the drawings).

When the discharge step proceeds from P1 to P2, the rotation directions of the first vane 210 and the second vane 220 are opposite to each other.

In the discharge step P2, the vane motor 230 rotates 82° (P2 rotation angle), the first vane 210 forms an inclination (first vane P2 inclination) of approximately 18.6° by the rotation of the vane motor 230, and the second vane 220 forms an inclination (second vane P2 inclination) of approximately 59.1°.

In the discharge step P2, the positional relationship of axes forming the centers of rotation of the respective links is as follows.

Similarly to P1, in the discharge step P2, the second joint portion 217 and the first joint portion 216 of the first vane 210 is disposed to be inclined toward the front side in the discharge direction of the air.

When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

In the P2 state, when viewed from the side surface of the vane module 200, the third joint portion 226, the second joint portion 217, and the first joint portion 216 are disposed toward the front lower side in the discharge direction of the air.

Based on the discharge step P2, the third joint 226 further moves downward, and the first joint portion 216 and the second joint portion 217 further moves forward. That is, the gap between the second vane 220 and the first vane 210 is further widened.

In the state of the discharge step P2, the disposition of the first vane link 250, the second vane link 260, and the drive link 240 is similar to that of the discharge step P1.

In the state of the discharge step P2, the 1-1st vane link shaft 251 of the first vane link 250 is located below the 1-2nd vane link shaft 252. In the state of the discharge step P2, the 2-1st vane link shaft 261 of the second vane link 260 is located below the 2-2nd vane link shaft portion 262. In the state of the discharge step P2, the first drive link shaft 241 of the drive link 240 is located below the second drive link shaft 242 and the core link shaft 243.

In the state of the discharge step P2, the second vane shaft 221 is located at the uppermost side, the third joint portion 226 is located below the second vane shaft 221, the second joint portion 217 is located below the third joint portion 226, and the first joint portion 216 is located below the second joint portion 217.

In the state of the discharge step P2, the second joint portion 217 is further rotated to the 1-2nd vane link shaft 252 about the core link shaft 243.

Based on the suction grill 320 or the discharge port 102, in the state of the discharge step P2, the entire first vane 210 is located below the discharge port 102. In the state of the discharge step P2, the front end 222*a* of the second vane 220 is located below the discharge port 102, and the rear end 222*b* thereof is located above the discharge port 102.

Accordingly, in the state of the discharge step P2, the first drive link shaft 241 and the 1-1st vane link shaft 251 are located below the suction grill 320. In the state of the discharge step P2, the first drive link shaft 241 and the 1-1st vane link shaft 251 are located below the discharge port 102. The 2-1st vane link shaft 261 is located across a boundary of the discharge port 102.

Next, in the state of the discharge step P2, relative positions and directions of the respective links are as follows.

In the state of the discharge step P2, the first vane link 250 and the second vane link 260 are disposed in approximately the same direction, and the first drive link body 246 is disposed to be inclined toward the front lower side. In particular, in the state of the discharge step P2, the first vane link 250 and the second vane link 260 are disposed approximately vertically.

Specifically, when the state is changed from the state of the discharge step P1 to the state of the discharge step P2, L1-L1' of the first vane link 250 further rotates in the discharge direction of the air. When the state is changed from the state of the discharge step P1 to the state of the discharge step P2, L2-L2' of the second vane link 260 further rotates in a direction opposite to the discharge direction of the air. When the state is changed from the state of the discharge step P1 to the state of the discharge step P2, D-D' of the first drive link body 246 further rotates in the discharge direction of the air.

In the state of the discharge step P2, the entire first vane 210 is located below the discharge port 102, and only the front end 222*a* of the second vane 220 is located below the discharge port 102.

When the state is changed from the state of the discharge step P1 to the state of the discharge step P2, based on the discharge port 102, the front end 212*a* of the first vane 210 further moves to the front side from the front edge 102*a* of the discharge port 102.

Discharge Step P3

The drive link 240 rotates in the second direction (the counterclockwise direction in the drawings of the present embodiment) opposite to the first direction in the state the discharge step P2, and thus, the discharge step P3 can be formed.

In the state of the discharge step P3, the vane module 200 can provide oblique wind which is discharged to a lower side than the discharge step P2. In the discharge steps P3 to P5, the oblique wind directly providing the air to the occupant is generated.

During cooling, the discharged air is heavier than indoor air and flows to the lower side, and during heating, the discharged is lighter than the indoor air and flow to the upper side. Accordingly, the discharge step P3 is mainly used during the cooling, and the discharge step P4 described later is mainly used during heating.

The oblique wind of the discharge step P3 discharges air below the oblique wind of the P2 step. The discharge step P3 is adjusted so that both the first vane 210 and the second vane 220 face further downward than at P2.

In the discharge step P3, a gap 33 of the front end 222*a* of the second vane 220 and the rear end 212*b* of the first vane 210 is wider than the gap S2 in the state of the discharge step P2.

That is, if the discharge step proceeds from P2 to P3, the gap between the front end 222*a* of the second vane 220 and the rear end 212*b* of the first vane 210 is widened. In the discharge step P3, the first vane 210 and the second vane 220 are disposed more vertically than P2.

When the state is changed from the state of the discharge step P2 to the state of the discharge step P3, the front end 222*a* of the second vane 220 further descends, and the rear end 212*b* of the first vane 210 further ascends.

In the state of the discharge step P3, the front end 222*a* of the second vane 220 is located below the rear end 212*b* of the first vane 210.

If the discharge step proceeds from P2 to P3, the second vane 220 is rotated in place about the second vane shaft 221. However, since the first vane 210 is assembled together with the drive link 240 and the first vane link 250, the first vane 210 rotates (swings).

If the discharge step proceeds from P2 to P3, the first vane 210 is located approximately in place and rotates in the first direction (clockwise direction). If the discharge step proceeds from P2 to P3, the second vane 220 further rotates in the first direction (clockwise direction).

When the discharge step proceeds from P2 to P3, the first vane 210 in place rotates in the first direction (clockwise direction) instead of advancing in the discharge direction.

When the discharge step proceeds from P2 to P3, the front end 222*a* of the second vane 220 is further rotated in the first direction (clockwise direction) by the descending of the second vane link 260.

When the step is changed from the discharge step P2 to the discharge step P3, the rotation directions of the first vane 210 and the second vane 220 are the same as each other.

In the discharge step P3, the vane motor 230 rotates 95° (P3 rotation angle), the first vane 210 forms an inclination (first vane P3 inclination) of approximately 29.6° by the rotation of the vane motor 230, and the second vane 220 forms an inclination (second vane P3 inclination) of approximately 67.3°.

In the discharge step P3, the positional relationship of axes forming the centers of rotation of the respective links is as follows.

Similarly to P2, in the discharge step P3, the second joint portion 217 and the first joint portion 216 of the first vane 210 is disposed to be inclined toward the front side in the discharge direction of the air.

When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

Based on the discharge step P3, the third joint portion 226 moves further downward. Based on the discharge step P3, the first joint portion 216 and the second joint portion 217 ascend upward by the rotations of the first vane link 250 and the first drive link body 246 in the second direction.

Since a length of the first drive link body 246 is shorter than a length of the first vane link 250, the upper height of the second joint portion 217 is greater.

In the state of the discharge step P3, the dispositions in the respective axes of the drive link 240, the first vane link 250, and the second vane link 260 are similar to those of the state of the discharge step P2.

However, relative heights of the first drive link shaft 241, the 1-1st vane link shaft 251, and the 2-1st vane link shaft 261 rotated by the operations of the drive link 240, the first vane link 250, and the second vane link 260 are different from each other.

In the state of the discharge step P3, the first drive link shaft 241 ascends, and the 2-1 vane link shaft 261 descends, and thus, the heights of the first drive link shaft 241 and the 2-1st vane link shaft 261 are similar to each other in the vertical direction.

When the state of the discharge step is changed from P2 to the P3, the second joint portion 217 further rotates to the 1-2st vane link shaft 252 about the core link shaft 243, and the second joint portion 217 is further away from the 2-1st vane link shaft 261.

In the state of the discharge step P3, the 2-2nd vane link shaft portion 262 is located lower than the core link shaft 243.

When the state is changed from the discharge step P2 to the discharge step P3, the 2-1 vane link shaft 261 move rearward from the 2-2 vane link shaft portion 262.

Based on the suction grill 320 or the discharge port 102, the positions of the first vane 210 and the second vane 220 in the state of the discharge step P3 are similar to those in the discharge step P2.

Accordingly, in the state of the discharge step P3, the first drive link shaft 241 and the 1-1st vane link shaft 251 are located below the suction grill 320 and the discharge port 102. The 2-1 vane link shaft 261 is located across the boundary of the discharge port 102.

Next, in the state of the discharge step P3, relative positions and directions of the respective links are as follows.

In the state of the discharge step P3, the first vane link 250 and the second vane link 260 are disposed in directions opposite to each other.

In the state of the discharge step P3, the first drive link body 246 and the first vane link 250 are disposed to be inclined toward the front lower side. In the state of the discharge step P3, the second drive link body 247 is disposed toward the rear side and the second vane link 260 is disposed toward the rear lower side.

Specifically, when the state is changed from the state of the discharge step P2 to the state of the discharge step P3, L1-L1' of the first vane link 250 further rotates in the discharge direction of the air. When the state is changed from the state of the discharge step P2 to the state of the discharge step P3, L2-L2' of the second vane link 260 further rotates in a direction opposite to the discharge direction of the air. When the state is changed from the state of the discharge step P2 to the state of the discharge step P3, D-D' of the first drive link body 246 further rotates in the discharge direction of the air.

When the step is changed from the discharge step P2 to the discharge step P3, based on the discharge port 102, both the first vane 210 and the second vane 220 rotates more vertically toward the lower side.

Discharge Step P4

The drive link 240 rotates in the second direction (the counterclockwise direction in the drawings of the present embodiment) opposite to the first direction in the state the discharge step P3, and thus, the discharge step P4 can be formed.

In the state of the discharge step P4, the vane module 200 can provide oblique wind which is discharged to a lower side than the discharge step P3. In the oblique wind of the discharge step P4, the air is discharged below the oblique wind of the P3 step.

The discharge step P4 is adjusted so that both the first vane 210 and the second vane 220 face further downward than at the discharge step P3.

In the discharge step P4, a gap S4 of the front end 222*a* of the second vane 220 and the rear end 212*b* of the first vane 210 is wider than the gap S3 in the state of the discharge step P3.

If the discharge step proceeds from P3 to P4, the gap between the front end 222*a* of the second vane 220 and the rear end 212*b* of the first vane 210 is widened. In the discharge step P4, the first vane 210 and the second vane 220 are disposed more vertically than P3.

When the state is changed from the state of the discharge step P3 to the state of the discharge step P4, the front end 222*a* of the second vane 220 further descends, and the rear end 212*b* of the first vane 210 further ascends.

In the state of the discharge step P4, the front end 222*a* of the second vane 220 is located below the front end 222*a* in the discharge step P3, and the rear end 212*b* of the first vane 210 is located above the rear end 212*b* in the discharge step P3.

When the discharge step is changed from P3 to P4, the second vane 220 rotates in place about the second vane shaft 221. When the discharge step is changed from P3 to P4, the first joint portion 216 of the first vane 210 remain substantially in place, and the second joint portion 217 rotates in the first direction (clockwise direction) about the first joint portion 216.

That is, when the discharge step is changed from P3 to P4, the movement of the first vane 210 hardly occurs, and forms a rotational movement in place. When the discharge step is changed from P3 to P4, the first vane 210 rotates in a first direction (clockwise direction) about the first joint portion 216.

If the discharge step is changed from P3 to P4, the second vane 220 further rotates in the first direction (clockwise direction).

When the discharge step proceeds from P3 to P4, the front end 222*a* of the second vane 220 is further rotated in the first direction (clockwise direction) by the descending of the second vane link 260.

When the step s changed from the discharge step P3 to the discharge step P4, the rotation directions of the first vane 210 and the second vane 220 are the same as each other.

When the step is changed from the discharge step P3 to the discharge step P4, the 1-1st vane link shaft 251 may be located in front of the 1-2nd vane link shaft 252.

In the discharge step P4, the vane motor 230 rotates 100° (P4 rotation angle), the first vane 210 forms an inclination (first vane P4 inclination) of approximately 35.8° by the rotation of the vane motor 230, and the second vane 220 forms an inclination (second vane P4 inclination) of approximately 70°.

In the discharge step P4, the positional relationship of axes forming the centers of rotation of the respective links is as follows.

Similarly to P3, in the discharge step P4, the second joint portion 217 and the first joint portion 216 of the first vane 210 is disposed to be inclined toward the front side in the discharge direction of the air.

When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

Based on the discharge step P4, the third joint portion 226 moves further downward. Based on the discharge step P4, the first joint portion 216 of the first vane link 250 slight ascends in the second direction (counterclockwise direction) or is located in place, and the second joint portion 217 rotates in the first direction (clockwise direction) about the first joint portion 216.

If the first vane 210 rotates beyond the rotation in the discharge step P4, the first vane 210 moves in a direction opposite to the advance direction so far. From the discharge step P1 to the discharge step P4, the first vane 210 moves in the discharge direction of the air and rotates in the first direction (clockwise direction) about the second joint portion 217.

In the state of the discharge step P4, the dispositions in the respective axes of the drive link 240, the first vane link 250, and the second vane link 260 are similar to those of the state of the discharge step P3. However, in the state of the discharge step P4, the length direction of the first drive link body 246, the second joint portion 217, and the first joint portion 216 are disposed in a line.

The relative heights of the first drive link shaft 241, the 1-1st vane link shaft 251, and the 2-1st vane link shaft 261 rotated by the operations of the drive link 240, the first vane link 250, and the second vane link 260 are different from each other.

In the state of the discharge step P4, the first drive link shaft 241 ascends, the 2-1 vane link shaft 261 descends, and thus, the first drive link shaft 241 is located slight higher than the 2-1st vane link shaft 261.

When the state of the discharge step is changed from P3 to the P4, the second joint portion 217 further rotates to the 1-2st vane link shaft 252 about the core link shaft 243, and the core link shaft 243, the first drive link shaft 241, and the 1-1st vane link shaft 251 may be disposed in a line in the form of a straight line.

In the state of the discharge step P4, the 2-2nd vane link shaft portion 262 is located lower than the core link shaft 243.

When the state is changed from the discharge step P3 to the discharge step P4, the 2-1 vane link shaft 261 further move rearward from the 2-2 vane link shaft portion 262.

Based on the suction grill 320 or the discharge port 102, the positions of the first vane 210 and the second vane 220 in the state of the discharge step P4 are similar to those in the discharge step P3.

Next, in the state of the discharge step P4, relative positions and directions of the respective links are as follows.

When the state is changed from the discharge step P3 to the discharge step P4, the first vane link 250 and the second vane link 260 are disposed in directions opposite to each other. When the state is changed from the discharge step P3 to the discharge step P4, the first vane link 250 hardly rotates, and only the second vane link 260 may rotate to the rear side.

In the present embodiment, there is no separate configuration for limiting the movement of the first vane link 250. In the present embodiment, the movement of the first vane link 250 may be limited through a coupling relationship between the first vane link 250, the first vane 210, and the first drive link body 246.

In the state of the discharge step P4, the first drive link body 246 and the first vane link 250 are disposed to be inclined toward the front lower side. In the state of the discharge step P4, the second drive link body 247 is disposed toward the rear side and the second vane link 260 is disposed toward the rear lower side.

In the present embodiment, when the state is changed from the state of the discharge step P3 to the state of the discharge step P4, L1-L1' of the first vane link 250 further rotates in the discharge direction of the air. When the state is changed from the state of the discharge step P3 to the state of the discharge step P4, L2-L2' of the second vane link 260 further rotates in the direction opposite to the discharge direction of the air. When the state is changed from the state of the discharge step P3 to the state of the discharge step P4, D-D' of the first drive link body 246 further rotates in the discharge direction of the air. An imaginary straight line connecting the first joint portion 216 and the second joint portion 217 to each other is defined as B-B'.

In the discharge step P4, D-D' and B-B' are connected to each other by a straight line, and an angle of 180° is formed therebetween.

An angle less than 180° between D-D' and B-B' is formed from the discharge step P1 to the discharge step P3, an angle of 180° is formed therebetween in the discharge step P4, and an angle equal to or more than 180° is formed therebetween in the discharge steps P5 and P6.

Discharge Step P5

The drive link 240 rotates in the second direction (the counterclockwise direction in the drawings of the present embodiment) opposite to the first direction in the state the discharge step P4, and thus, the discharge step P5 can be formed.

In the state of the discharge step P5, the vane module 200 can provide oblique wind which is discharged to a lower side than the discharge step P4. In the oblique wind of the discharge step P5, the air is discharged below the oblique wind of the discharge step P3.

The discharge step P5 is adjusted so that both the first vane 210 and the second vane 220 face further downward than at the discharge step P4.

In the discharge step P5, a gap S5 of the front end 222*a* of the second vane 220 and the rear end 212*b* of the first vane 210 is wider than the gap S4 in the state of the discharge step P4.

If the discharge step proceeds from P4 to P6, the gap between the front end 222*a* of the second vane 220 and the rear end 212*b* of the first vane 210 is widened. In the discharge step P5, the first vane 210 and the second vane 220 are disposed more vertically than P4.

When the state is changed from the state of the discharge step P3 to the state of the discharge step P4, the front end 222*a* of the second vane 220 further descends, and the rear end 212*b* of the first vane 210 further ascends.

In the state of the discharge step P5, the front end 222*a* of the second vane 220 is located below the front end 222*a* in the discharge step P4, and the rear end 212*b* of the first vane 210 is located above the rear end 212*b* in the discharge step P3.

When the discharge step is changed from P4 to P5, the second vane 220 rotates in place about the second vane shaft 221. When the discharge step is changed from P4 to P5, the first joint portion 216 of the first vane 210 remain substantially in place, and the second joint portion 217 further rotates in the first direction (clockwise direction) about the first joint portion 216.

That is, when the discharge step is changed from P4 to P5, the movement of the first vane 210 hardly occurs, and the first vane 210 rotates in place about the first joint portion 216.

When the discharge step is changed from P4 to P5, the first vane 210 further rotates in a first direction (clockwise direction) about the first joint portion 216. When the discharge step is changed from P4 to P5, the second vane 220 further rotates in the first direction (clockwise direction).

When the discharge step proceeds from P4 to P5, the front end 222*a* of the second vane 220 is further rotated in the first direction (clockwise direction) by the descending of the second vane link 260.

When the step is changed from the discharge step P4 to the discharge step P5, the rotation directions of the first vane 210 and the second vane 220 are the same as each other.

When the step is changed from the discharge step P4 to the discharge step P5, the 1-1st vane link shaft 251 may be located in front of the 1-2nd vane link shaft 252.

In the discharge step P5, the vane motor 230 rotates 105° (P5 rotation angle), the first vane 210 forms an inclination (first vane P5 inclination) of approximately 44.1° by the rotation of the vane motor 230, and the second vane 220 forms an inclination (second vane P5 inclination) of approximately 72.3°.

In the discharge step P5, the positional relationship of axes forming the centers of rotation of the respective links is as follows.

Similarly to P4, in the discharge step P5, the second joint portion 217 and the first joint portion 216 of the first vane 210 is disposed to be inclined toward the front side in the discharge direction of the air.

When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

Based on the discharge step P5, the third joint portion 226 moves further downward, and the second joint portion 217 of the first vane link 250 rotates in the first direction (clockwise direction) about the first joint portion 216.

In the discharge step P5, based on an imaginary straight line connecting the core link shaft 243 and the first joint portion 216 to each other, the second joint portion 217 is located to protrude the 1-2nd vane link shaft 252 side.

In the state of the discharge step P5, the dispositions in the respective axes of the drive link 240, the first vane link 250, and the second vane link 260 are similar to those of the state of the discharge step P4.

The relative heights of the first drive link shaft 241, the 1-1st vane link shaft 251, and the 2-1st vane link shaft 261 rotated by the operations of the drive link 240, the first vane link 250, and the second vane link 260 are different from each other.

When the state is changed from the state of the discharge step P4 to the state of the discharge step P5, the first drive link shaft 241 ascends, the 2-1 vane link shaft 261 descends. Accordingly, in the discharge step P5, the first drive link shaft 241 is located slight higher than the 2-1st vane link shaft 261.

When the state is changed from the state of the discharge step P4 to the state of the discharge step P5, the second joint portion 217 rotates about the core link shaft 243, and the second joint portion 217 further rotates to the 1-2nd vane link shaft 252.

In the discharge step P4, the core link shaft 243, the first drive link shaft 241, and the 1-1st vane link shaft 251 are disposed in a line, and in the discharge step P5, the core link shaft 243, the first drive link shaft 241, and the 1-1st vane link shaft 251 form an obtuse angle (based on D-D') equal to or more than 180°.

In the state of the discharge step P5, the 2-2nd vane link shaft portion 262 is located lower than the core link shaft 243.

When the step proceeds from the discharge step P1 to the discharge step P6, an angle formed between the core link shaft 243, the 2-2nd vane link shaft portion 262, and the third joint portion 226 gradually increases.

However, when the step proceeds from the discharge step P1 to the discharge step P6, the angle formed between the core link shaft 243, the 2-2nd vane link shaft portion 262, and the third joint portion 226 is less than 180°.

When the state is changed from the state of the discharge step P4 to the state of the discharge step P5, the 2-1 vane link shaft 261 further move rearward from the 2-2 vane link shaft portion 262 and is located between the third joint portion 226 and the core link shaft 243.

Based on the suction grill 320 or the discharge port 102, the positions of the first vane 210 and the second vane 220 in the state of the discharge step P5 are similar to those in the discharge step P4.

Next, in the state of the discharge step P5, relative positions and directions of the respective links are as follows.

When the state is changed from the discharge step P4 to the discharge step P5, the first vane link 250 and the second vane link 260 are disposed in directions opposite to each other. When the state is changed from the discharge step P4 to the discharge step P5, the first vane link 250 hardly rotates, and only the second vane link 260 may further rotate to the rear side.

In the state of the discharge step P5, a disposition of the first drive link body 246, the first vane link 250, and the second vane link 260 is similar to that of the discharge step P4.

In the present embodiment, when the state is changed from the state of the discharge step P4 to the state of the discharge step P5, L1-L1' of the first vane link 250 may rotate in the direction opposite to the discharge direction of the air. When the state is changed from the state of the discharge step P4 to the state of the discharge step P5, L2-L2' of the second vane link 260 further rotates in the direction opposite to the discharge direction of the air. When the state is changed from the state of the discharge step P4 to the state of the discharge step P5, D-D' of the first drive link body 246 rotates in the discharge direction of the air.

In the discharge step P5, the angle between D-D' and B-B' is an obtuse angle.

When the state proceeds from the state of the discharge step P1 to the state of the discharge step P4, the front end 212*a* of the first vane moves in the discharge direction of the air. However, when the state proceeds from the state of the discharge step P4 to the state of the discharge step P6, the front end 212*a* of the first vane moves to a side (rear side) opposite in the discharge direction of the air.

Accordingly, when the state proceeds from the state of the discharge step P4 to the state of the discharge step P6, the first vane 210 may be disposed more vertically.

Discharge Step P6

In the present embodiment, the state of the vane module 200 in the discharge step P6 is defined as the vertical wind.

The vertical wind does not means that the first vane 210 and the second vane 220 constituting the vane module 200 are disposed vertically. The vertical wind means that the air discharged from the discharge port 102 is discharged below the discharge port 102.

The drive link 240 rotates in the second direction (the counterclockwise direction in the drawings of the present embodiment) opposite to the first direction in the state the discharge step P5, and thus, the discharge step P6 can be formed. In the discharge step P6, a flow of the discharged air in the horizontal direction is minimized, and a flow thereof in the vertical direction is maximized. In the vertical wind of the discharge step P6, the air is discharged below the oblique wind of the discharge step P5.

The discharge step P6 is adjusted so that both the first vane 210 and the second vane 220 face further downward than at the discharge step P5.

When the discharge step P6 is provided, the rear end 222*b* of the second vane is located above the discharge port, the front end 222*a* of the second vane is located below the discharge port, the rear end 212*b* of the first vane is located higher than the front end 222*a* of the second vane and located higher than the discharge port. In addition, the front end 212*a* of the first vane is located lower than front end 222*a* of the second vane.

When the discharge step P6 is provided, the rear end 212*b* of the first vane is disposed to face the discharge port 102.

In the discharge step P6, a gap S6 of the front end 222*a* of the second vane 220 and the rear end 212*b* of the first vane 210 is wider than the gap S5 in the state of the discharge step P5.

If the discharge step proceeds from P5 to P6, the gap between the front end 222*a* of the second vane 220 and the rear end 212*b* of the first vane 210 is widened. In the discharge step P6, the first vane 210 and the second vane 220 are disposed more vertically than P5.

When the state is changed from the state of the discharge step P5 to the state of the discharge step P6, the front end 222*a* of the second vane 220 further descends, and the rear end 212*b* of the first vane 210 further ascends.

In the state of the discharge step P6, the front end 222*a* of the second vane 220 is located below the front end 222*a* in the discharge step P5, and the rear end 212*b* of the first vane 210 is located above the rear end 212*b* in the discharge step P5.

When the discharge step is changed from P5 to P6, the second vane 220 rotates in place about the second vane shaft 221. When the discharge step is changed from P5 to P6, the first joint portion 216 of the first vane 210 remain substantially in place, and the second joint portion 217 further rotates in the first direction (clockwise direction) about the first joint portion 216.

That is, when the discharge step is changed from P5 to P6, the first vane 210 may move to the rear side. When the discharge step is changed from P5 to P6, since the first vane 210 further rotates in the first direction (clockwise direction) about the first joint portion 216, the front end 212*a* of the first vane 210 moves to the rear side.

When the discharge step is changed from P5 to P6, the second vane 220 further rotates in the first direction (clockwise direction). When the discharge step is changed from P5 to P6, the front end 222*a* of the second vane 220 is further rotated in the first direction (clockwise direction) by the descending of the second vane link 260.

When the step is changed from the discharge step P5 to the discharge step P6, the rotation directions of the first vane 210 and the second vane 220 are the same as each other.

In the discharge step P4, the vane motor 230 rotates 110° (P6 rotation angle), the first vane 210 forms an inclination (first vane P6 inclination) of approximately 56.7° by the rotation of the vane motor 230, and the second vane 220 forms an inclination (second vane P6 Inclination) of approximately 74°.

In the discharge step P6, the positional relationship of axes forming the centers of rotation of the respective links is as follows.

Similarly to the discharge step P5, in the discharge step P6, the second joint portion 217 and the first joint portion 216 of the first vane 210 is disposed to be inclined toward the front side in the discharge direction of the air.

When viewed from the side, the third joint portion 226 of the second vane 220 is disposed at the rearmost side, the first joint portion 216 is disposed at the most front side, and the second joint portion 217 is disposed between the first joint portion 216 and third joint portion 226.

Based on the discharge step P6, the third joint portion 226 moves further downward, and the second joint portion 217 of the first vane link 250 rotates in the first direction (clockwise direction) about the first joint portion 216.

In the discharge step P6, based on an imaginary straight line connecting the core link shaft 243 and the first joint portion 216 to each other, the second joint portion 217 is located to further protrude the 1-2nd vane link shaft 252 side.

In the state of the discharge step P6, the dispositions in the respective axes of the drive link 240, the first vane link 250, and the second vane link 260 are similar to those of the state of the discharge step P5.

The relative heights of the first drive link shaft 241, the 1-1st vane link shaft 251, and the 2-1st vane link shaft 261 rotated by the operations of the drive link 240, the first vane link 250, and the second vane link 260 are different from each other.

When the discharge step P6 is provided, the rear end 212*b* of the first vane is located below the core link shaft 243 and is located in front of the core link shaft 243. When the discharge step P6 is provided, the front end 212*a* of the first vane is behind the front edge 102*a* of the discharge port.

When the state is changed from the state of the discharge step P5 to the state of the discharge step P6, the first drive link shaft 241 ascends, the 2-1 vane link shaft 261 descends. Accordingly, in the discharge step P6, the first drive link shaft 241 is located slight higher than the 2-1st vane link shaft 261.

When the discharge step P6 is provided, the 2-2nd vane link shaft portion 262 is located lower than the core link shaft 243, the first drive link shaft 241 is located lower than the 2-2nd vane link shaft portion 262, the 2-1st vane link shaft 261 is located lower than the first drive link shaft 241, and the 1-1st vane link shaft 251 is located lower than the 2-1st vane link shaft 261.

When the state is changed from the state of the discharge step P5 to the state of the discharge step P6, the second joint portion 217 rotates about the core link shaft 243, and the second joint portion 217 further rotates to the 1-2nd vane link shaft 252.

When viewed from the side, in the discharge step P6, at least a portion of the second joint portion 217 may overlap the first vane link body 255. Since the second joint portion 217 moves to a position at which the second joint portion 217 and the first vane link body 255 overlap each other, the first vane 210 may be disposed more vertically.

However, in the discharge step P6, the second joint portion 217 does not move beyond L1-L1'. The second joint portion 217 does not move forward from the first vane link body 255. In a case where the second joint portion 217 excessively move forward, even when the vane motor is rotated in the first direction (clockwise direction), the second joint portion 217 cannot be returned to an original position.

Accordingly, in order to prevent the excessive rotation of the drive link 240, in the discharge step P6, the first drive link body 246 and one end 270*a* of the stopper 270 interfere with each other. The first drive link body 246 is supported by the stopper 270 and a further rotation of the first drive link body 246 is limited.

In the discharge step P6, the core link shaft 243, the first drive link shaft 241, and the 1-1st vane link shaft 251 form an obtuse angle (clockwise direction based on D-D') equal to or more than 180°.

When the step is changed from the discharge step P5 to the discharge step P6, the 1-1st vane link shaft 251 may be located in front of the 1-2 vane link shaft 252.

In the state of the discharge step P6, the 2-2nd vane link shaft portion 282 is located below the core link shaft 243, the second joint portion 217 is located below the 2-2nd vane link shaft portion 262, the third joint portion 226 is located below the second joint portion 217, and the first joint portion 216 is located below the third joint portion 226.

When the state is changed from the state of the discharge step P5 to the discharge step P6, the 2-1st vane link shaft 216 further moves rearward from the 2-2nd vane link shaft portion 262 and is located between the third joint portion 226 and the core link shaft 243.

Next, in the state of the discharge step P6, relative positions and directions of the respective links are as follows.

When the state is changed from the state of the discharge step P5 to the state of the discharge step P6, the first vane link 250 and the second vane link 260 are disposed in directions opposite to each other. When the state is changed from the discharge step P4 to the discharge step P5, the first vane link 250 hardly rotates, and only the second vane link 260 may further rotate to the rear side.

In the state of the discharge step P6, a disposition of the first drive link body 246, the first vane link 250, and the second vane link 260 is similar to that of the discharge step P5.

When the discharge step P6 is provided, the 2-1st vane link shaft 261 is located in front of the second vane shaft 221, the 2-2nd vane link shaft portion 262 is located in front of the 2-1st vane link shaft 261, and the 1-1st vane link shaft 251 is located in front of the first drive link shaft 241, the core link shaft 243 is located in front of the 2-2nd vane link shaft portion 262, the first drive link shaft 241 is located in front of the core link shaft 243, and the 1-1st vane link shaft 251 is located in front of the first drive link shaft 241.

In the present embodiment, when the state is changed from the state of the discharge step P5 to the state of the discharge step P6, L1-L1' of the first vane link 250 further rotates in the direction opposite to the discharge direction of the air. When the state is changed from the state of the discharge step P5 to the state of the discharge step P6, L-L' of the second vane link 260 further rotates in the direction opposite to the discharge direction of the air. When the state is changed from the state of the discharge step P5 to the state of the discharge step P6, D-D' of the first drive link body 246 may further rotate in the direction opposite to the discharge direction of the air.

In the obtuse angle which is the angle between D-D' and B-B' in the discharge step P6 is larger than the obtuse angle which is the angle between D-D' and B-B' in the discharge step P5.

When the state proceeds from the state of the discharge step P1 to the state of the discharge step P4, the front end 212*a* of the first vane moves the discharge direction (front side) of the air.

When the state proceeds from the state of the discharge step P1 to the state of the discharge step P4, the first vane link 250 rotates in the second direction (counterclockwise direction). However, when the state proceeds from the state of the discharge step P4 to the state of the discharge step P6, the first vane link 250 rotates in the first direction (clockwise direction).

Accordingly, when the state proceeds from the state of the discharge step P1 to the state of the discharge step P4, the front end 212*a* of the first vane rotates in the second direction and ascends. However, when the state proceeds from the state of the discharge step P4 to the state of the discharge step P6, the front end 212*a* of the first vane rotates in the first direction and descends. That is, the movement of the first vane 210 is changed based on the discharge step P4.

When the state proceeds from the state of the discharge step P4 to the state of the discharge step P6, the first vane 210 can be disposed more vertically. In the state of the discharge step P6, the rear end 212*b* of the first vane 210 is located in front of the core link shaft 243.

In the discharge step P6, when the vane module 200 forms the vertical wind, the first vane 210 and the second vane 220 are spaced apart from each other at maximum.

In the discharge step P6, when viewed from the side surface of the vane module 200, any one of the second joint portion 217 and the first drive link shaft 241 overlaps the first vane link 250.

In the discharge step P6, when viewed from the side surface of the vane module 200, any one of the second joint portion 217 and the first drive link shaft 241 is located on the line L1-L1' of the first vane link 250 or is located behind the line L1-L1'.

In the discharge step P6, when viewed from the side surface of the vane module 200, the rear end 212*b* of the first vane 210 is located inside the discharge port 102 and is located higher than an outer surface of the side cover 314. Since the rear end 212*b* of the first vane 210 is located inside the discharge port 102, the discharge port 102 can guide the air more vertically.

Concentration Improvement Heating Mode

A concentration improvement heating mode of the ceiling type indoor unit according to the present embodiment will be described with reference to FIGS. 1 to 4, 15, and 23.

The indoor unit according to the present embodiment includes the first vane module 201 which is disposed at the edge of the suction port 101 based on the suction port 101, the third vane module 203 which is disposed at the edge of the suction port 101 and is disposed on a side opposite to the first vane module 201 based on the suction portion 101, the second vane module 202 which is disposed at the edge of the suction port 101 and is disposed to form an angle of 90° between the second vane module 202 and each of the first vane module 201 and the third vane module 203 based on the suction port 101, and the fourth vane module 204 which is disposed at the edge of the suction port 101 and is disposed on a side opposite to the second vane module 202 based on the suction port 101.

Unlike the present embodiment, only two vane modules may be disposed in the indoor unit, and the two vane modules may be disposed in directions different from each other.

Moreover, in the present embodiment, two vanes are disposed in each vane module. However, only one vane may be disposed in each vane module and may operate the concentration improvement cooling mode.

When viewed from the bottom, the indoor unit includes the first vane module 201 which is disposed at the edge of the suction port 101 and is disposed at 12 o'clock based on the suction port 101, the second vane module 202 which is disposed at the edge of the suction port 101 and is disposed at 3 o'clock based on the suction port 101, the third vane module 203 which is disposed at the edge of the suction port 101 and is disposed at 6 o'clock based on the suction port 101, and the fourth vane module 204 which is disposed at the edge of the suction port 101 and is disposed at 9 o'clock based on the suction port 101.

For convenience of description, the discharge port in which the first vane module 201 is disposed is defined as a first discharge port 102-1, the discharge port in which the second vane module 202 is disposed is defined as a second discharge port 102-2, the discharge port in which the third vane module 203 is disposed is defined as a third discharge port 102-3, and the discharge port in which the fourth vane module 204 is disposed is defined as a fourth discharge port 102-4.

When viewed from the bottom, the first vane module 201 is disposed in a direction of 12 o'clock and discharges the air in the direction of 12 o'clock, the second vane module 201 is disposed in a direction of 3 o'clock and discharges the air in the direction of 3 o'clock, the third vane module 203 is disposed in a direction of 6 o'clock and discharges the air in the direction of 6 o'clock, and the fourth vane module 204 is disposed in a direction of 9 o'clock and discharges the air in the direction of 9 o'clock.

When viewed from the bottom, the air discharge directions of the first vane module 201 and the third vane module 203 are opposite to each other. The air discharge directions of the second vane module 202 and the fourth vane module 204 are opposite to each other.

When viewed from the bottom, the air discharge direction of the first vane module 201 is orthogonal to the air discharge directions of the second vane module 202 and the fourth vane module 204. The air discharge direction of the third vane module 203 is orthogonal to the air discharge directions of the second vane module 202 and the fourth vane module 204.

The air discharge direction of the first vane module 201 is defined as a first discharge direction 291, the air discharge direction of the second vane module 202 is defined as a second discharge direction 292, the air discharge direction of the third vane module 203 is defined as a third discharge direction 293, and the air discharge direction of the fourth vane module 204 is defined as a fourth discharge direction 294.

In the heating mode of the ceiling type indoor unit according to the present embodiment, the room is more rapidly heated, the temperature difference between the room temperature and the floor temperature is minimized, and discomfort of the occupant is minimized.

In the related art, a heating mode is operated according to a temperature difference between a room temperature Tp and a set temperature Ts.

In the heating mode according to the present embodiment, the indoor unit is controlled in consideration of a temperature difference between the room temperature Tp and a floor temperature Tb as well as the temperature difference between the room temperature Tp and the set temperature Ts.

In a In a control method of the ceiling type indoor unit according to the present embodiment, during heating, each pair of vane modules out of two pairs of vane modules is controlled to discharge the air in different directions.

Particularly, a pair of the first vane module 201 and the third vane module 203 disposed to face each other, and the other pair of the second vane module 202 and the fourth vane module 204 can discharge the air in different directions.

When viewed from the bottom, the first vane module 201, the second vane module 202, the third vane module 203, and the fourth vane module 204 are disposed with an interval of 90° based on the suction port 101.

When viewed from the bottom, based on the suction port 101, the discharge direction of the first vane module 201 and the discharge direction of the second vane module 202 form an angle of 90° therebetween, the discharge direction of the second vane module 202 and the discharge direction of the third vane module 203 form an angle of 90° therebetween, the discharge direction of the third vane module 203 and the discharge direction of the fourth vane module 204 form an angle of 90° therebetween, and the discharge direction of the fourth vane module 204 and the discharge direction of the first vane module 201 form an angle of 90° therebetween.

When viewed from the bottom, the first vane module 201 and the third vane module 203 are located on sides opposite to each other based on the suction port 101. When viewed from the bottom, the second vane module 202 and the third vane module 204 are located on sides opposite to each other based on the suction port 101.

In the present embodiment, the first vane module 201 and the third vane module 203 which are disposed to face each other based on the suction port 101 are defined as a first discharge pair, and the second vane module 202 and the fourth vane module 204 are defined as a second discharge pair.

In The control method of a ceiling type indoor unit according to the present embodiment includes a step S10 of turning on the heating mode, a temperature setting step S12 of, after Step S10, sensing the room temperature Tp and a floor temperature Tb and receiving the set temperature Ts, a step S14 of, after Step S12, comparing the room temperature Tp and the set temperature Ts with each other, and an oblique wind unity step S20 of, in a case where the room temperature is less than the set temperature TS, operating both the first discharge pair including the first vane module 201 and the third vane module 203 and the second discharge pair including the second vane module 202 and the fourth vane module 204 in the discharge step P4.

In a case where the room temperature Tp is equal or more than the set temperature Ts, the step proceeds to a step S32 of determining a floor heating load.

The control method of a ceiling type indoor unit according to the present embodiment includes a step S30 of, after Step S20, determining whether or not the oblique wind unity step S20 exceeds an oblique wind time (ten minutes in the present embodiment), a step S32 of, in a case where Step S30 is satisfied, comparing a temperature difference between the room temperature Tp and the floor temperature Tb with a first reference value A, and a step S34 of, in a case where the temperature difference exceeds the first reference value A after Step S32, determining that the floor temperature Tb is lower than the room temperature Tp and setting the first discharge pair and the second discharge pair to a vertical wind (discharge step P5 in the present embodiment).

The control method of a ceiling type indoor unit according to the present embodiment includes a first dynamic heating step S40 of, in a case where the temperature difference is equal or less than the first reference value after Step S32, operating the first discharge pair in the discharge step P2 and discharging the second discharge pair in the discharge step P5, a step S50 of determining whether or not the first dynamic heating step S40 exceeds a first dynamic time (five minutes in the present embodiment), a horizontal wind unity step 360 of, in a case where Step S50 is satisfied, operating the first discharge pair and the second discharge pair in the discharge step P2, a step S70 of determining whether or not the horizontal wind unity step 360 exceeds a horizontal wind time (five minutes in the present embodiment), a second dynamic heating step S80 of, in a case where Step S70 is satisfied, operating the first discharge pair in the discharge step P and operating the second discharge pair in the discharge step P2, a step S90 of determining whether or not the second dynamic heating step S80 exceeds a second dynamic time (five minutes in the present embodiment), a step S100 of, in a case where Step S90 is satisfied, determining whether or not the heating mode is turned off, and a step of, in a case where Step S100 is satisfied, ending the heating mode.

The concentration improvement cooling mode according to the present embodiment can be implemented in three discharge steps.

Accordingly, a fourth discharge step may be defined as one inclination angle, a fifth discharge step or a sixth discharge step may be defined as another inclination angle, and a second discharge step may be defined as the other inclination angle. The first vane module, the second vane module, the third vane module, and the fourth vane module may be set to any one of the discharge steps P1 to P6.

The first vane module, the second vane module, the third vane module, and the fourth vane module may be set to any one of the discharge steps P1 to P6.

On the horizontal basis, the inclination of each first vane satisfies "0°<first vane inclination of discharge step P1<first vane inclination of discharge step P2<first vane inclination of discharge step P3<first vane inclination of discharge step P4<first vane inclination of discharge step P5<first vane inclination of discharge step P6<90°".

On the horizontal basis, the inclination of each second vane satisfies "0°<second vane inclination of discharge step P1<second vane inclination of discharge step P2<second vane inclination of discharge step P3<second vane inclination of discharge step P4<second vane inclination of discharge step P5<second vane inclination of discharge step P6<90°".

In addition, in each discharge step, the inclination of the second vane is always set larger than the inclination of the first vane.

The user can select the heating mode through a wireless remote control (not shown) or a wired remote control (not shown). (S10) In the present embodiment, the heating mode is selected by the user, but unlike the present embodiment, the heating mode may be automatically performed under specific conditions.

In Step S12, the room temperature Tp is sensed through an indoor air temperature sensor (not shown) which is installed in the case 100. The indoor air temperature sensor may be installed on the front panel 300 or the suction channel 103.

An installation structure of the temperature sensor sensing the indoor air is a general technique to those skilled in the art, and thus, a detail description thereof is omitted.

According to the present embodiment, a thermopile sensor 301 for detecting a temperature of an indoor floor and a vision sensor 302 for capturing an image of an interior are disposed in the front panel 300.

The floor temperature (Tb) is sensed through the thermopile sensor 301 installed on the front panel (300). The thermopile sensor 301 is installed to face the floor.

The thermopile sensor 301 measures the floor temperature by detecting infrared radiation radiated from the floor. An operation principle and a structure of the thermopile sensor 301 are a general technique to those skilled in the art, and thus, a detailed description thereof will be omitted.

Similarly, the vision sensor 302 photographs the room through an image element and converts the image into image data. Accordingly, the vision sensor 302 is a general technique to those skilled in the art, and thus, a detailed description thereof will be omitted.

The set temperature Ts may be a temperature input by the user or may be a temperature set during an operation immediately before starting.

In Step S14, the room temperature Tp and the set temperature are compared with each other.

In the present embodiment, in a case where the room temperature Tp is less than the set temperature Ts, it is determined that there is the heating load, the step proceeds to Step S20.

In a case where the room temperature Tp is equal to or more than the set temperature Ts, it is determined that the heating load is satisfied, the step proceeds to Step S32 and the floor heating load is determined.

In the oblique wind unity step S20, all the first vane module 201, the second vane module 202, the third vane module, 203 and the fourth vane module 204 are operated in the same manner. In the oblique wind unity step S20, a controller operates all of the first vane module 201, the second vane module 202, the third vane module 203, and the fourth vane module 204 in the discharge step P4.

In the present embodiment, in the oblique wind unity step S20, all four vane modules are operated in the discharge step P4 which is most effective for heating among the discharge steps P1 to P6.

During heating, the temperature of the discharged air is higher than the temperature of the indoor air, and thus, the discharged air ascends upward due to a temperature difference between the temperature of the discharged air and the temperature of the indoor air. Accordingly, in a case where the discharged air is discharged at an angle close to the angle of the horizontal wind, it is difficult for the user to feel the discharged air. Therefore, the oblique wind unity step S20 is performed before the dynamic heating step 340 and S80 is performed, and thus, warm air is supplied to the user.

In the present embodiment, the oblique wind is the discharge steps P2 to P5, and the discharge step P4 is used in consideration of the discharged air ascending after being discharged to the lower side. Unlike the present embodiment, in a case where the indoor space is narrow, the discharge step P5 may be applied to the oblique wind unity step.

In the discharge step P4, inclination angles and disposition of the first vane and the second vane refer to the above descriptions.

The oblique wind unity step S20 is operated during the oblique wind time. In the present embodiment, the oblique wind time is set to ten minutes. Unlike the present embodiment, the oblique wind time can be changed variously. It is preferable that the oblique wind time is set to be greater than the first dynamic time. It is desirable to supply the user with sufficient hot air before the first dynamic heating step to meet the user's needs.

In the oblique wind unity step S20, heated air is discharged to a periphery of the indoor unit through the first vane module 201, the second vane module 202, the third vane module 203, and the fourth vane module 204.

In the oblique wind unity step S20, the air around the indoor unit is mixed to reduce a temperature deviation around the indoor unit.

If Step S30 is satisfied, the step proceeds to Step S32. If the Step S30 is not satisfied, the step is returned to the step S20.

In Step S32, it is determined whether or not it is necessary to heat the floor of the room after the predetermined heating in the room through the oblique wind unity step (S20).

If the room is not used and the heating is performed through the ceiling type indoor unit, the discharged warm air is collected on the ceiling due to a density difference with the Indoor air, and the indoor floor is kept cold.

If a large temperature is formed between the indoor floor and the indoor air, a large discomfort occurs in the occupant.

In Step S32, a temperature difference between the room temperature Tp and the floor temperature Tb is compared with the first reference value A. In a case where the temperature difference exceeds the first reference value A, the first discharge pair and the second discharge pair provide the vertical wind and directly heat the indoor floor.

In the present embodiment, an entry condition of Step S34 is determined based on the temperature difference between the room temperature Tp and the floor temperature Tb. However, unlike the present embodiment, the entry condition of Step S34 may be determined through a specific temperature.

For example, in a case where the floor temperature is a first set value (for example, 19° C.), the step proceeds to Step S34 to provide the vertical wind, and in a case where the floor temperature is a second set value (for example, 23° C.), the step proceeds to Step S40, and the floor temperature is controlled.

In Step S34, the vertical wind may directly supply the heated air toward the floor to heat the floor. The discharge step P5 or the discharge step P6 may be applied to the vertical wind. When the vertical wind is provided in Step S34, both the first discharge pair and the second discharge pair are operated in the same discharge step.

In a large room, the discharge step P5 is preferable, and in a narrow room, the discharge step P6 is preferable.

In the discharge step P5 or the discharge step S6, inclination angles and disposition of the first vane and the second vane refer to the above descriptions.

Unlike the present embodiment, the position of the occupant in the room may be determined by the vision sensor 302. When the vertical wind is provided, the position of the occupant is determined by the vision sensor 302, and the first discharge pair and the second discharge pair may be controlled to face the floor where the occupant is located.

In this way, in a case where the heated air is discharged toward a periphery of the floor where the occupant is located as described above, the first vane module 201, the second vane module 202, the third vane module 203, and the fourth vane module 204 may be controlled at rotation angles different from each other.

Meanwhile, after S34 is performed for a predetermined time, the step is returned to Step S32.

In a case where Step S32 is satisfied, the step proceeds to the step S40. Step S40 is the first dynamic heating step.

In the oblique wind unity step S20, both the first discharge pair and the second discharge pair discharge the air in the discharge step P4. However, in the first dynamic heating step S40, unlike the oblique wind unity step S20, the first discharge pair and the second discharge pair are formed of discharge steps different from each other.

In the first dynamic heating step S40, supply targets or supply objectives of the first discharge pair and the second discharge pair are different form each other. In the first dynamic heating step S40, the first discharge pair and the second discharge pair are operated in different ways.

In the present embodiment, when the step is the first dynamic heating step S40, the first discharge pair is set to the discharge step P2, and the second discharge pair is set to the discharge step P5.

In the first dynamic heating step S40, the first discharge pair is changed to the discharge step P2 and then maintained. In the first dynamic heating step S40, the second discharge pair is changed to the discharge step P5 and then maintained.

In the discharge step P2, it is possible to send the discharged air farthest except the horizontal wind (discharge step P1). In the discharge step P2, it is possible to provide the indirect wind to the user.

Meanwhile, the second discharge pair provides direct wind for providing heated air directly to the user.

In Step S40, in order to cool the indoor air rapidly, the discharged air is preferably provided as the oblique wind rather than as the horizontal wind or the vertical wind. In particular, the first discharge pair provides the discharged air to a location located at a long distance because the first discharge pair provides the indirect wind close to the horizontal wind, and the second discharge pair provides the discharged air to a location closer than this.

In Step S40, the first discharge pair provides the oblique wind close to the horizontal wind, and thus, provides the discharged air to a location located at a long distance. The second discharge pair disposed to be orthogonal to the discharge direction of the first discharge pair provides the oblique wind, and thus, provides the discharged air to a location located at a short distance.

For example, in a case where the first discharge pair supplies the air to a location far from the indoor unit through the discharge step P2 in the first dynamic heating step S40, the cooled air is discharged at a gentle angle, and the discharged air is collected in the upper side due to a density difference with the indoor air.

In a case where the first discharge pair supplies the discharged air with the indirect wind to the discharge step P2 in the first dynamic heating step S40, the second discharge pair causes the heated air to flow from a location close to the indoor unit to a location far from the indoor unit through the discharge step P5. In this case, since the air discharged from the second discharge pair is directed to be closer to the ground than the air discharged from the first discharge pair, the air reaches the floor of the location close to the indoor unit and then flows to the location far from the indoor unit along the floor. The air discharged from the second discharge pair is warmer than the indoor air, and thus, the air flows to upper side after being discharged toward the floor.

Air convection in the discharge direction (second discharge direction and fourth discharge direction) of the second discharge pair is promoted by the air discharged from the second discharge pair.

In a case where the air discharged from the second discharge pair reaches the location far from the indoor unit while gradually ascending, the indoor air is pushed by the heated discharged air and flows to the surroundings.

In this way, in a case where the first discharge pair provides the discharged air to a location located at a long distance and the second discharge pair disposed to be orthogonal to the first discharge pair provides the discharged air to the location located at a short distance, it is possible to promote circulation of the indoor air. That is, in a case where the air is discharged in directions different from each other, and thus, a distance different and a height difference are generated, the heated air and the indoor air can be mixed more rapidly.

Accordingly, in a case where the heated discharged air is supplied in the first dynamic heating step S40, a temperature deviation may be generated around the indoor unit. In particular, a temperature deviation according to a height in a vertical direction as well as a temperature deviation according to a horizontal distance based on the indoor unit may be greatly generated. In addition, a large temperature deviation in the first discharge pair direction and the second discharge pair direction may be formed.

This is a natural phenomenon caused by different targets of the first discharge pair and the second discharge pair in the first dynamic heating step S40.

In Step S50, an operation time of Step S40 is determined. In a case where Step S50 is satisfied, the step proceeds to Step S60, and in a case where Step S50 is not satisfied, the step is returned to Step S40.

Step S60 is the horizontal wind unity step. Similarly to the oblique wind unity step, in the horizontal wind unity step, all the four vane modules are set to the same discharge step. However, unlike the oblique wind unity step S20, in the horizontal wind unity step S60, the four vane modules are set to the discharge step S2 close to the horizontal wind.

An operation time of the horizontal wind unity step S60 is set to the horizontal wind time (five minutes in the present embodiment). In the present embodiment, the operation time of the horizontal wind unity step S60 is the same as the first dynamic time.

Since the horizontal wind unity step S60 is set to the discharge step P2, the first discharge pair is continuously maintained in the discharge step P from the first dynamic heating step S40 to the horizontal wind unity step S60. Since the horizontal wind unity step S60 is set to the discharge step P2, the second discharge pair is changed from the discharge step P5 to the discharge step P2.

Since the horizontal wind unity step S60 is set to the discharge step P2, it is possible to provide the air to a location far from the indoor unit in the form of the horizontal wind. In the horizontal wind unity step S60, the air provided in the form of the horizontal wind descends by hitting a wall of the room, and thereafter, the flow direction of the air can be switched 180°, and the indoor air can flow to the indoor unit side by the air hitting the wall and descending.

That is, the air discharged in the horizontal wind unity step S60 may send hot air away, and collect indoor air having a low temperature in the indoor unit side.

In the present embodiment, the horizontal wind unity step S60 is set to the discharge step P2 close to the horizontal wind. However, unlike the present embodiment, the discharge step P1 may be set. In the horizontal wind unity step S60, it is possible to eliminate a temperature deviation generated in the first dynamic heating step S40.

If the oblique wind unity step S20, the first dynamic heating step S40, and the horizontal wind unity step S60 are performed, the heated air can be provided to all the upper side, the lower side, the location located at a short distance, and the location located at a far distance in the first discharge direction, the second discharge direction, the third discharge direction, and the fourth discharge direction.

In the first discharge direction and the third discharge direction, the heated air is supplied to a location located at a short distance through the discharge step P4 of the oblique wind unity step 20, and the heated air is supplied to the location located at a far distance through the discharge step P2 of the horizontal wind unity step S60.

In the second discharge direction and the fourth discharge direction, the heated air is supplied to a location located at a short distance through the discharge step P4 of the oblique wind unity step 20, the heated air is supplied to a location located at a short distance through the discharge step P5 of the first dynamic heating step S40, and the heated air is supplied to a location located at a far distance through the discharge step P2 of the horizontal wind unity step S60.

If Step S70 is satisfied, the step proceeds to Step S80. If Step S70 is not satisfied, the step is returned to Step S60.

Step S80 is the second dynamic heating step.

In the second dynamic heating step S80, the first discharge pair and the second discharge pair are operated in a manner opposite to the first dynamic heating step S40. Accordingly, when the step is the second dynamic heating step S80, the first discharge pair is set to the discharge step P5, the second discharge pair is set to the discharge step P2.

In the second dynamic heating step S80, the first discharge pair is changed to the discharge step P5 and then maintained for the second dynamic time. In the second dynamic heating step S80, the second discharge pair is changed to the discharge step P2 and then maintained for the second dynamic time.

In contrast to the first dynamic heating step S40, in the second dynamic heating step S80, the direct wind is provided through the first discharge pair and the indirect wind is provided through the second discharge pair.

In the present embodiment, the discharge step of the second dynamic heating step S80 is the discharge step P2 or the discharge step P5.

By alternately operating the first dynamic heating step S40 and the second dynamic heating step S80, the air in the indoor space can be mixed more effectively. In addition, by alternately operating the first dynamic heating step S40 and the second dynamic heating step S80, it is possible to minimize a dead zone in which the indoor air does not reach.

In particular, since the indirect wind and the direct wind are alternately provided in the first dynamic heating step S40 and the second dynamic heating step S80, it is possible to minimize the dead zones in which the indoor air cannot reach.

For example, the first discharge pair discharges the air to a location located far from the indoor unit through the discharge step P2 in the first dynamic heating step S40. Thereafter, the first discharge pair discharges the air to a location close to the indoor unit through the discharge step P5 in the second dynamic heating step S80. In this way, when the air is discharged, it is possible to minimize the dead zone in the discharge directions of the first vane module 201 and the third vane module 203.

In addition, when the first discharge pair is operated, the second discharge pair is operated in reverse. Accordingly, the second discharge pair discharges the air to the location close to the indoor unit in the first dynamic heating step S40, and discharges the air to the location far from the indoor unit in the second dynamic heating step S80. In this way, when the air is discharged, it is possible to minimize the dead zone in the discharge directions of the second vane module 202 and the fourth vane module 204.

For example, in the second dynamic heating step S80, the first discharge pair causes the heated air to flow from the location close to the indoor unit to the location far from the indoor unit through the discharge step P5. In this case, since the air discharged from the first discharge pair is directed to the ground, the air reaches the floor close to the indoor unit, and then flows to the location far from the indoor unit along the floor. Moreover, while the air flows, the air may ascend due to a density difference with the indoor air.

In a case where the air discharged from the first discharge pair descends and then, reaches the location located far from the indoor unit while ascending, the indoor air is pushed by the heated discharged air and flows to the surroundings.

In a case where the second discharge pair supplies the air to the location far from the indoor unit through the discharge step P2, the heated air is discharged at a gentle angle, and the discharged air stays on the upper side due to a density difference with the indoor air. The air discharged from the second discharge pair can reach the location located far from the indoor unit in a state where descending of the air is minimized. The descending of the air discharged from the second discharge pair in the form of the horizontal wind is minimized, flows far, hits the wall of the room, and can flow to the floor.

In the first dynamic heating step S40 and the second dynamic heating step S80, the air supplied the location far from the indoor unit in the form of the horizontal wind descends by hitting the wall of the room, and the flow direction can be switched 180°, and the indoor air can flow to the indoor unit side by the air descending by hitting.

In this way, according to the first dynamic heating step S40 and the second dynamic heating step S80, the heated air is alternately supplied to the location dose to the indoor unit and the location far from the indoor unit based on the horizontal distance from the indoor unit, and thus, it is possible to effectively mix the indoor air.

In addition, according to the first dynamic heating step S40 and the second dynamic heating step S80, the heated air is alternately supplied to the upper and lower sides based on the height in the vertical direction, it is possible to effectively mix the indoor air.

In Step S90, it is determined whether or not the time exceeds the second dynamic time (five minutes in the present embodiment), and in a case where Step S90 is satisfied, the step proceeds to Step S100. In a case where Step S90 is not satisfied, the step is returned to Step S80.

The first dynamic time and the second dynamic time are set to the same as each other, and thus, the air temperature around the indoor unit can be uniform. In a case where the first dynamic time and the second dynamic time are set differently, there is a possibility that the temperature of any one of the first discharge pair or the second discharge pair is formed higher or lower.

In Step S100, it is determined whether or not the heating mode is turned off. In the present embodiment, if an operation signal of the user is received, Step S100 is performed. Accordingly, in Step S100, it is determined whether or not the user inputs an OFF signal of the heating mode.

In the present embodiment, even when the user inputs OFF signal of the heating mode before Step S100, Step S100 is determined after Step S90. Unlike the present embodiment. Step S100 may be disposed between Step S10 and Step S90, and Step S100 may be determined after each step ends. In this case, if the user inputs the heating mode OFF, after an ongoing step ends, the heating mode may end immediately.

In a case where Step S10 is not satisfied (in a case where the user does not input the heating mode OFF), the step is returned to Step S12.

Figure 24:
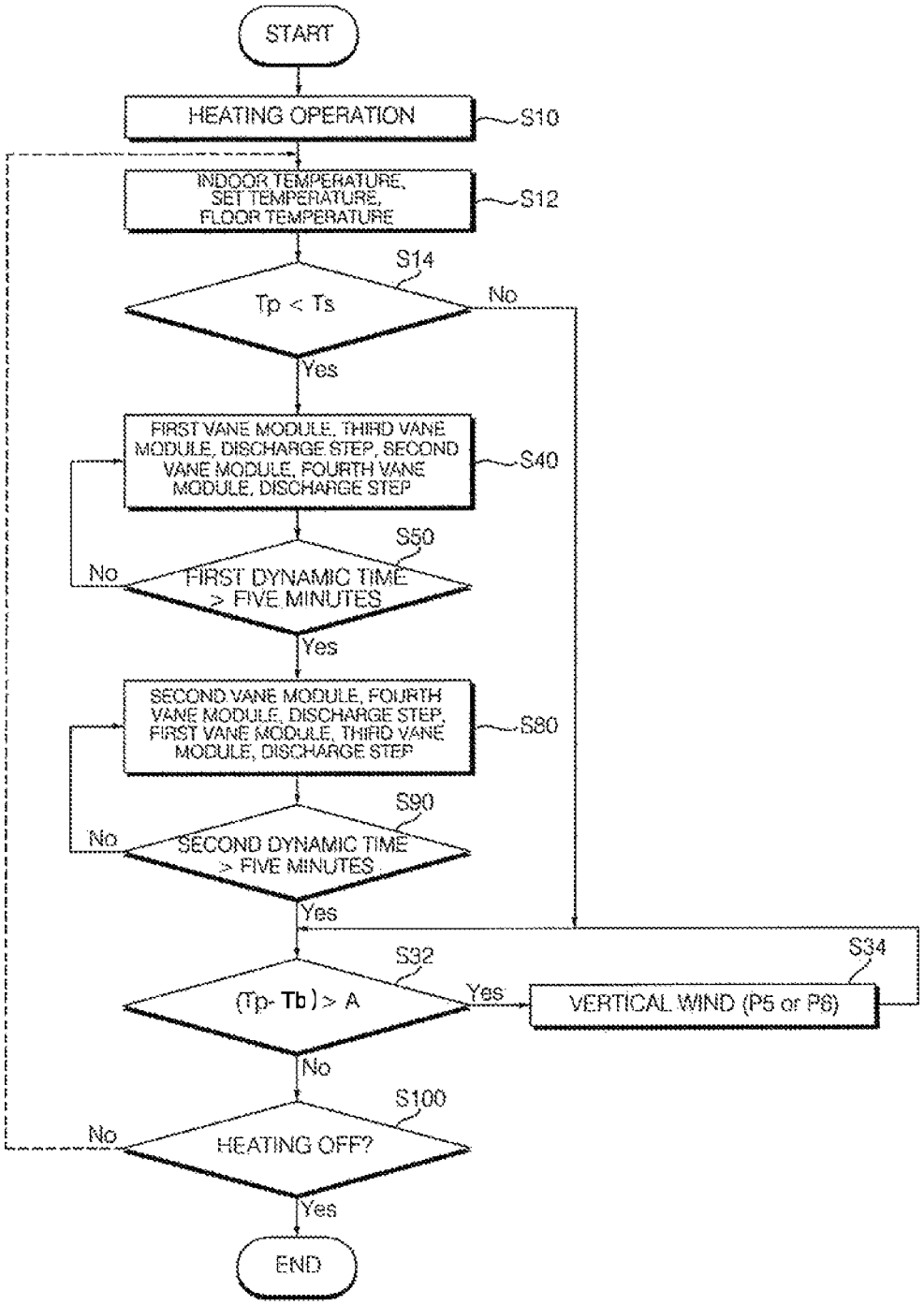
FIG. 24 is a flowchart showing a control method during heating according to a second embodiment of the present disclosure.

FIG. 24 is a flowchart showing a control method during heating according to a second embodiment of the present disclosure.

In the control method of a ceiling type indoor unit according to the second embodiment, whether or not the room is heated is determined according to the temperature difference between the room temperature Tp and the set temperature Ts, and even when there is little or no heating load due to the temperature difference between the room temperature Tp and the set temperature Ts, the temperature between the room temperature Tp and the floor temperature Tb is determined to perform the floor heating.

Accordingly, in a case where it is determined that there is a heating load due to the temperature difference between the room temperature Tp and the set temperature Ts, the room is heated.

Even when it is determined that there is little or no heating load due to the temperature difference between the room temperature Tp and the set temperature Ts, the floor heating load is determined according to the temperature difference between the room temperature Tp and the floor temperature Tb.

Accordingly, even when there is little or no heating load due to the temperature difference between the room temperature Tp and the set temperature TS, in a case where the temperature difference between the room temperature Tp and the floor temperature Tb exceeds the first reference value A, it is determined that the floor heating load is large, and the vertical wind may be provided to the floor.

The control method of a ceiling type indoor unit according to the present embodiment includes a step S10 of turning on the heating mode, a temperature setting step S12 of, after Step S10, sensing the room temperature Tp and the floor temperature Tb and receiving the set temperature Ts, and a step S14 of, after Step S12, comparing the room temperature Tp and the set temperature Ts with each other, and in a case where the room temperature Tp is equal to or more than the set temperature Ts in Step S14, the step proceeds to Step S32.

The control method of a ceiling type indoor unit according to the present embodiment includes the first dynamic heating step S40 of, in a case where the room temperature Tp is less than the set temperature Ts after Step S14, operating the first discharge pair in the discharge step P2 and operating the second discharge pair in the discharge step P5, a step S50 of determining whether or not the first dynamic heating step S40 exceeds the first dynamic time (five minutes in the present embodiment), a second dynamic heating step S80 of, in a case where Step S50 is satisfied, operating the first discharge pair in the discharge step P5 and operating the second discharge pair in the discharge step P2, and a step S90 of determining whether or not the second dynamic heating step S80 exceeds the second dynamic time (five minutes in the present embodiment).

Moreover, the control method of a ceiling type indoor unit according to the present embodiment includes a step S32 of, in a case where Step S90 is satisfied, comparing the temperature difference between the room temperature Tp and the floor temperature Tb with the first reference value A, and a step S34 of, in a case where the temperature difference exceeds the first reference value A after Step S32, determining that the floor temperature Tb is lower than the room temperature Tp and setting the first discharge pair and the second discharge pair to the vertical wind (in the present embodiment, discharge step P5), in which in a case where the temperature difference after Step S32 is equal to or less than the first reference value A after Step S32, it is determined that the temperature difference between the room temperature Tp and the floor temperature Tb is appropriate.

In addition, the control method of a ceiling type indoor unit according to the present embodiment includes a step S100 of, in a case where the temperature difference is equal to or less than the first reference value A after Step S32, determining whether or not the heating mode is turned off, and a step of, in a case where Step S100 is satisfied, ending the heating mode.

Since the rest of the configuration is the same as that of the first embodiment, detailed description thereof will be omitted.

Figure 25:
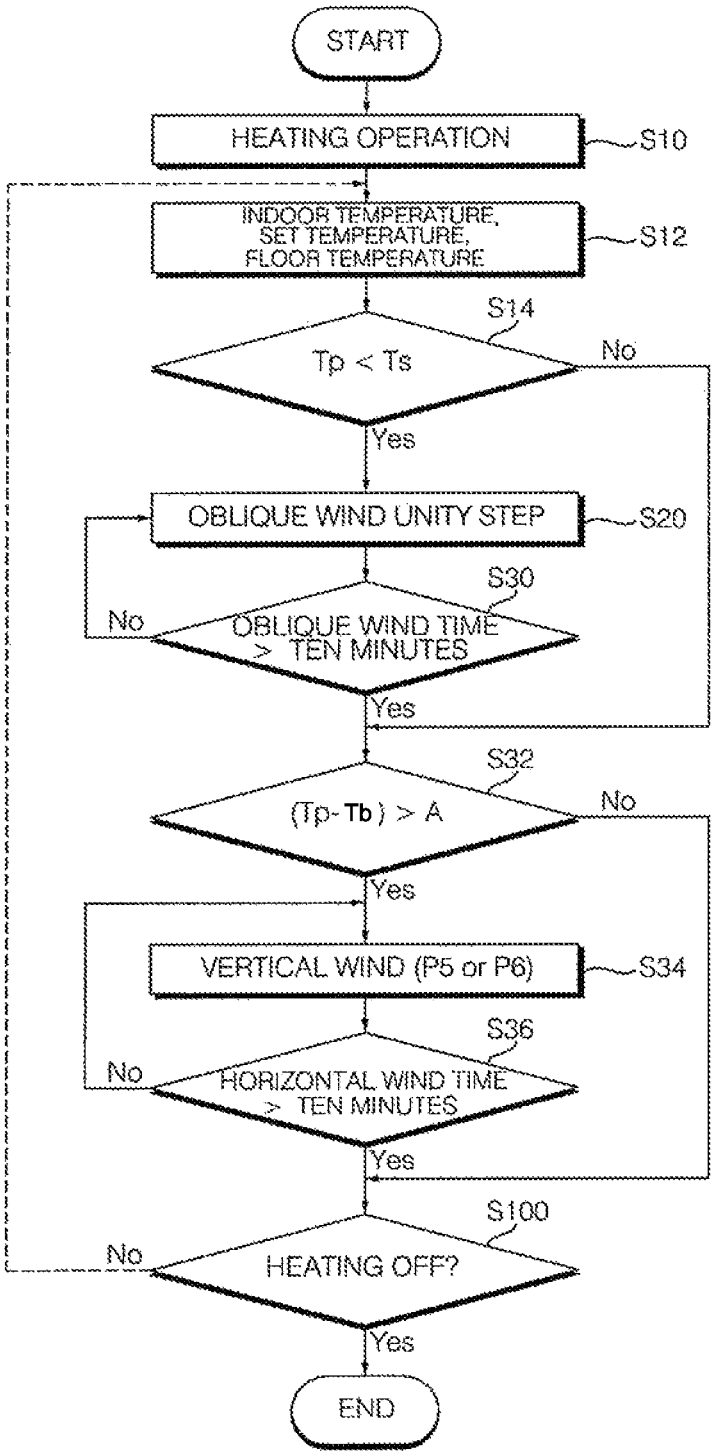
FIG. 25 is a flowchart showing a control method during heating according to a third embodiment of the present disclosure.

FIG. 25 is a flowchart showing a control method during heating according to a third embodiment of the present disclosure.

In the control method of a ceiling type indoor unit according to the present embodiment, it is determined whether or not the room is heated according to the temperature difference between the room temperature Tp and the set temperature Ts, and even when there is little or no heating load due to the temperature difference between the room temperature Tp and the set temperature Ts, the floor heating load is determined according to the temperature difference between the room temperature Tp and the floor temperature Tb.

In a case where it is determined that there is the heating load according to the temperature difference between the room temperature Tp and the set temperature Ts, the room is heated.

Thereafter, even when it is determined that there is little or no heating load according to the temperature difference between the room temperature Tp and the set temperature Ts, the floor heating load is determined according to the temperature difference between the room temperature Tp and the floor temperature Tb.

Accordingly, even when it is determined that there is little or no heating load according to the temperature difference between the room temperature Tp and the set temperature Ts, in a case where the temperature difference between the room temperature Tp and the floor temperature Tb exceeds the first reference value, it is determined that the floor heating load is large, the vertical wind may be provided to the floor.

Unlike the second embodiment, in the control method according to the third embodiment, the oblique wind or the vertical wind is provided instead of performing the dynamic heating.

The control method of a ceiling type indoor unit according to the present embodiment includes a step S10 of turning on the heating mode, a temperature setting step S12 of, after Step S10, sensing the room temperature Tp and the floor temperature Tb and receiving the set temperature Ts, a step S14 of, after Step S12, comparing the room temperature Tp and the set temperature Ts with each other, and an oblique wind unity step S20 of, in a case where the room temperature Tp is less than the set temperature Ts, operating both the first discharge pair including the first vane module 201 and the third vane module 203 and the second discharge pair including the second vane module 202 and the fourth vane module 204 in the discharge step P4.

In Step S14, in a case where the room temperature Tp is equal to or more than the set temperature Ts, the step proceeds to Step S32 described later.

The control method of a ceiling type indoor unit according to the present embodiment includes a step S30 of, after Step S20, determining whether or not the oblique wind unity step S20 exceeds the oblique wind time (ten minutes in the present embodiment), a step S32 of, in a case where Step S30 is satisfied, comparing the temperature difference between the room temperature Tp and the floor temperature Tb with the first reference value A, a step S34 of, in a case where the temperature difference exceeds the first reference value A after Step S32, determining that the floor temperature Tb is lower than the room temperature Tp and the floor heating load is large and setting the first discharge pair and the second discharge pair to the vertical wind (discharge step P5 in the present embodiment), a step S36 of, after Step S34, determining whether or not Step S34 exceeds the vertical wind time (ten minutes in the present embodiment), a step S100 of, in a case where Step S36 is satisfied, determining whether or not the heating mode is turned off, and a step of, in a case where Step S100 is satisfied, ending the heating mode.

In a case where Step S14 is not satisfied, Step S20 and Step S30 are omitted, and the step proceeds to Step S32.

In Step S32, in a case where the temperature difference is equal to or less than the first reference value A, it is determined that there is little or no floor heating load, the step proceeds to Step S100.

In a case where Step S36 is not satisfied, the step is returned to Step S34.

Since the rest of the configuration is the same as that of the first embodiment, detailed description thereof will be omitted.

Although the embodiments of the present disclosure are described above with reference to the accompanying drawings, the present disclosure is not limited to the above embodiments, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the embodiments described above are exemplary in all respects and not restrictive.

According to the present disclosure, the control method of the ceiling type indoor unit has the following effects.

Firstly, according to the present disclosure, it is determined whether or not a room is heated according to the temperature difference between the room temperature Tp and the set temperature Ts, and even when there is litter or no heating load due to the temperature difference between the room temperature Tp and the set temperature Ts, it is possible to perform floor heating by determining the temperature difference between the room temperature Tp and a floor temperature Tb.

Secondly, according to the present disclosure, the heating load is determined according to the temperature difference between the room temperature Tp and the set temperature Ts, and the floor heating load is determined according to the temperature difference between the room temperature Tp and the floor temperature Tb.

Thirdly, according to the present disclosure, even when there is litter or no heating load due to the temperature difference between the room temperature Tp and the set temperature Ts, in a case where the temperature difference between the room temperature Tp and the floor temperature Tb exceeds a first reference A, it is determined that the floor heating load is large, and thus, a vertical wind may be provided to the floor.

Fourthly, according to the present disclosure, when the room is heated according to the temperature difference between the room temperature Tp and the set temperature Ts, dynamic heating is provided in which the first discharge pair and the second discharge pair discharge the air in directions different from each other and at inclinations different from each other, and thus, it is possible to heat more rapidly the room.

Fifthly, according to the present disclosure, the first discharge pair and the second discharge pair discharge the air at angles different from each other, and thus, it is possible to minimize the dead zone in which the discharged air does not reach.

Sixthly, according to the present disclosure, when the vertical wind, the first discharge pair and the second discharge pair directly discharge the heated air toward the floor, and thus, it is possible to rapidly heat the floor.

What is claimed is:

1. A control method of a ceiling type indoor unit including a case which is installed to be suspended to a ceiling of a room, includes a suction port formed on a bottom surface, and includes a first discharge port and a third discharge port disposed to face each other based on the suction port and a second discharge port and a fourth discharge port disposed to face each other based on the suction port, a first vane module which is disposed in the first discharge port, constitutes one of a first discharge pair, and discharges air in a first discharge direction, a second vane module which is disposed in the second discharge port, constitutes one of a second discharge pair, and discharges air in a second discharge direction, a third vane module which is disposed in the third discharge port, constitutes the other one of the first discharge pair, and discharges air in a third discharge direction, and a fourth vane module which is disposed in the fourth discharge port, constitutes the other one of the second discharge pair, and discharges air in a fourth discharge direction, the control method comprising:

a step S10 of turning on a cooling mode;

a temperature setting step S12 of, after Step S10, sensing a room temperature Tp and a floor temperature Tb and receiving a set temperature Ts;

a step S14 of, after Step S12, comparing the room temperature Tp and the set temperature with each other;

a step S20 of, in a case where the room temperature Tp is less than the set temperature Ts, operating at least on of the first discharge pair and the second discharge pair at one inclination angle;

a step S32 of, after Step S20, comparing a temperature difference between the room temperature Tp and the floor temperature Tb with a first reference value A;

a step S34 of, in a case where the temperature difference exceeds the first reference value A after Step S32, operating at least one of the first discharge pair and the second discharge pair at another inclination angle;

a step S100 of, after Step S34, determining whether or not the heating mode is turned off; and a step of, in a case where Step S100 is satisfied, ending the heating mode, and in a case where the room temperature Tp is equal to or more than the set temperature Ts after Step S14, the step proceeds to Step S32, and another inclination angle is disposed more vertically in an up-down direction than the one inclination angle.

2. The control method of claim 1, wherein in a case where the temperature difference is equal to or less than the first reference value A after Step S32, the step proceeds to Step S100, and in a case where Step S100 is not satisfied, the step is returned to a step before Step S14.

3. The control method of claim 1, wherein in Step S20, both the first discharge pair and the second discharge pair is operated at the one inclination angle.

4. The control method of claim 1, further comprising:

a step S30 of, after Step S20, determining whether or not Step S20 exceeds a first predetermined time, wherein in a case where the first predetermined is satisfied, the step proceeds to Step S32.

5. The control method of claim 1, further comprising:

a step S36 of, after Step S34, determining whether or not Step S34 exceeds a second predetermined time, wherein in a case where the second predetermined is satisfied, the step is returned to Step S32.

6. The control method of claim 1, wherein in a case where the temperature difference is equal to or less than the first reference value after Step S32, the first discharge pair and the second discharge pair are operated at inclination angles different from each other.

7. The control method of claim 1, further comprising:

a first dynamic heating step S40 of, in a case where the temperature difference is equal to or less than the first reference value after Step S32, operating the first discharge pair and the second discharge pair at inclination angles different from each other; and a second dynamic heating step S80 of, after Step S40, alternating the inclation angles of the first discharge pair and the second discharge pair, wherein in a case where Step S80 is satisfied, the step proceeds to Step S100.

8. The control method of claim 1, further comprising:

a step S60 of, in a case where Step S50 is satisfied, operating the first discharge pair and the second discharge pair at the other inclination angle which is more horizontal than the one inclination angle, wherein the other inclination angle is disposed more horizontally than the one inclination angle.

9. The control method of claim 1, further comprising:

a step S70 of determining whether or not Step S60 exceeds a third predetermined time, wherein in a case where Step S70 is satisfied, the step proceeds to Step S80.

10. The control method of claim 1, wherein each vane module includes a first vane configured to be disposed in the discharge port, a second vane configured to be disposed in the discharge port, a vane motor configured to be assembled to the case and supply a driving force to the first vane and the second vane, a drive link configured to be assembled to be rotatable relative to the case, to be coupled to the vane motor, and transmit the driving force of the vane motor to the first vane and the second vane, a first vane line configured to be assembled to be rotatable relative to the case and the first vane, and a second vane link configured to be assembled to be rotatable relative to the drive link and the second vane.

11. The control method of claim 10, wherein when the one inclination angle is provided, a rear end of the first vane is located higher than a front end of the second vane.

12. The control method of claim 10, wherein in the one inclination angle, an inclination of the second vane is more vertically in an up-down direction than an inclination of the first vane.

13. The control method of claim 12, wherein in another inclination angle, the inclination of the second vane is more vertically in the up-down direction than the inclination of the first vane.

14. The control method of claim 10, wherein in the one inclination angle, the inclination of the second vane is more vertically in the up-down direction than the inclination of the first vane, in another inclination angle, the inclination of the second vane is more vertically in the up-down direction than the inclination of the first vane, the inclination of the first vane at another inclination angle is more vertically in the up-down direction than the inclination of the first vane at the one inclination angle, and the inclination of the second vane at another inclination angle is more vertically in the up-down direction than the inclination of the second vane at the one inclination angle.

15. The control method of claim 10, wherein in Step S20, both the first discharte pair and the second discharge pair are operated at the one inclination angle, and in a case where the temperature difference is equal to or less than the first reference value A after Step S32, the step proceeds to Step S100, and in a case where Step S100 is not satisfied, the step proceeds to a step before Step S14.

16. The control method of claim 15, wherein in a case where the temperature difference is equal to or less than the first reference value A after Step S32, the first discharge pair and the second discharge pair are operated at inclination angles different from each other.

17. The control method of claim 15, further comprising:

a first dynamic heating step S40 of, in a case where the temperature difference is equal to or less than the first reference value, operating the first discharge pair and the second discharge pair at inclination angles different from each other, and a second dynamic heating step S80 of, after Step S40, alternating the inclation angles of the first discharge pair and the second discharge pair, wherein in a case where Step S80 is satisfied, the step proceeds to Step S100.

18. The control method of claim 17, further comprising:

a step S60 of, in a case where Step S50 is satisfied, operating the first discharge pair and the second discharge pair at the other inclination angle which is more horizontal than the one inclination angle, wherein the other inclination angle is disposed more horizontally than the one inclination angle.

19. The control method of claim 18, further comprising:

a step S70 of determining whether or not Step S60 exceeds a third predetermined time, wherein in a case where Step S70 is satisfied, the step proceeds to Step S80.

20. A ceiling type indoor unit to which the control method according to claim 1 is applied.

* * * * *